US006283318B1

(12) United States Patent
Lee

(10) Patent No.: US 6,283,318 B1
(45) **Date of Patent: *Sep. 4, 2001**

(54) BOTTLE CAP MADE OF SYNTHETIC RESIN

(76) Inventor: Jeong-Min Lee, 172-31, Myunmok-5 dong, Chungrang-ku Seoul 131-205 (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/142,600

(22) PCT Filed: Mar. 12, 1997

(86) PCT No.: PCT/KR97/00038

§ 371 Date: Dec. 30, 1998

§ 102(e) Date: Dec. 30, 1998

(87) PCT Pub. No.: WO97/33802

PCT Pub. Date: Sep. 18, 1997

(30) Foreign Application Priority Data

| | | |
|---|---|---|
| Mar. 12, 1996 | (KR) | 96/6537 |
| Jun. 1, 1996 | (KR) | 96/19531 |
| Jun. 1, 1996 | (KR) | 96/19533 |
| Jun. 1, 1996 | (KR) | 96/19534 |
| Jun. 1, 1996 | (KR) | 96/19535 |
| Jun. 28, 1996 | (KR) | 96/25429 |
| Jun. 28, 1996 | (KR) | 96/25434 |
| Sep. 19, 1996 | (KR) | 96/40730 |
| Sep. 19, 1996 | (KR) | 96/40732 |
| Sep. 19, 1996 | (KR) | 96/40735 |
| Sep. 19, 1996 | (KR) | 96/40736 |
| Sep. 19, 1996 | (KR) | 96/40741 |
| Sep. 19, 1996 | (KR) | 96/40743 |
| Sep. 19, 1996 | (KR) | 96/40744 |
| Sep. 19, 1996 | (KR) | 96/40746 |
| Jan. 22, 1997 | (KR) | 97/1964 |
| Feb. 12, 1997 | (KR) | 97/4064 |
| Feb. 12, 1997 | (KR) | 97/4065 |

(51) Int. Cl.[7] ..... B65D 41/46; B65D 41/48; B65D 41/58

(52) U.S. Cl. ..... 215/254; 215/256; 215/305; 215/345; 215/354; 220/270; 220/276; 220/792

(58) Field of Search ..... 215/224, 225, 215/250, 253, 305, 298, 254, 344, 355, 307, 201, 211, 235, 256, 258, 295, 316, 317, 320, 321, 341, 343, 345, 354; 220/265, 266, 268, 270, 276, 792

(56) References Cited

U.S. PATENT DOCUMENTS 3,142,404 * 7/1964 Krieps et al. ..... 215/254

(List continued on next page.)

FOREIGN PATENT DOCUMENTS 364611 11/1981 (AT) .

(List continued on next page.)

OTHER PUBLICATIONS

PCT International Search Report; Mar. 12, 1997/PCT KR/97/00038, Lee, Jeong Min.

* cited by examiner

*Primary Examiner*—Allan N. Shoap
*Assistant Examiner*—Niki M. Eloshway
(74) *Attorney, Agent, or Firm*—Alston & Bird LLP

(57) ABSTRACT

Disclosed is a bottle cap comprising an upper body (100) including a plurality of longitudinal grooves (116), an inner cap (114), at least two seals (123, 124), and at least one stopper (120) projection for catching on an upper portion of a bottle; a lower body (102) having a plurality of longitudinal grooves (130) and at least one stopper projection (131), wherein an upper cutting line (132) is formed between the upper body (100) and the lower body (102) except for a non-cutting portion and a vertical cutting line (133) is formed; and a pull-tab (106) to allow the upper body (100) and inner cap (114) to be removed from the bottle by a user. There is further provided a bottle cap comprising an upper body, a side portion, a bottle plug, and a circumferential ring; a lower body including a vertical cutting line and a circumferential groove; and a pull-tab, integrally fixed to one side of the vertical cutting line.

136 Claims, 96 Drawing Sheets

U.S. PATENT DOCUMENTS

| | | | | |
|---|---|---|---|---|
| 3,944,104 | * | 3/1976 | Watson et al. | 215/307 |
| 3,974,931 | | 8/1976 | Moller . | |
| 4,003,488 | * | 1/1977 | Moller | 215/254 |
| 4,227,619 | | 10/1980 | Magnusson . | |
| 4,522,308 | * | 6/1985 | Sullivan | 215/254 X |
| 4,564,112 | | 1/1986 | Breuer . | |
| 4,605,138 | * | 8/1986 | Taragna et al. | 215/254 |
| 4,768,667 | | 9/1988 | Magnusson . | |
| 5,050,754 | * | 9/1991 | Marino | 215/256 |
| 5,085,333 | * | 2/1992 | Dutt et al. | 215/254 X |
| 5,373,955 | * | 12/1994 | Marino | 215/256 |
| 5,687,865 | * | 11/1997 | Adams et al. | 215/253 |
| 5,842,592 | * | 12/1998 | Beck | 215/253 |
| 5,909,827 | * | 6/1999 | Bietzer et al. | 215/254 X |

FOREIGN PATENT DOCUMENTS

| | | |
|---|---|---|
| 634523 | 2/1983 | (CH) . |
| 3737467 | 5/1988 | (DE) . |
| 2 531 931 | 2/1984 | (FR) . |
| 2 017 663 | 4/1979 | (GB) . |
| 2 125 386 | 8/1983 | (GB) . |
| WO 84/0269 | 7/1984 | (WO) . |

BOTTLE CAP MADE OF SYNTHETIC RESIN

This application claims priority from PCT Patent Application No. WO 97/33802 filed on Mar. 12, 1997, which, in turn, claims priority from Korean Patent Application Nos. 96-6537 filed on Mar. 12, 1996; 96-19531 filed on Jun. 1, 1996; 96-19533 filed on Jun. 1, 1996; 96-19534 filed on Jun, 1, 1996; 96-19535 filed on Jun. 1, 1996; 96-25429 filed on Jun. 28, 1996; 96-25434 filed on Jun. 28, 1996; 96-40730 filed on Sep. 19, 1996; 96-40732 filed on Sep. 19, 1998; 96-40735 filed on Sep. 19, 1998; 96-40736 filed on Sep. 19, 1998; 96-40741 filed on Sep. 19, 1998; 96-40743 filed on Sep. 19, 1998; 96-40744 filed on Sep. 19, 1998; 96-40746 filed on Sep. 19, 1998; 97-1964 filed on Jan. 22, 1997; 97-4064 filed on Feb. 12, 1997; 97-4065 filed on Feb. 12, 1997, the contents of which are incorporated in their entirety herein.

FIELD OF THE INVENTION

The present invention relates to a bottle cap, and more particularly, to a bottle cap made of synthetic resin having a pull-tab allowing easy removal from a bottle, and as a result of the material from which it is made and its structure, has a variety of advantages.

BACKGROUND OF THE INVENTION

The most widely-used bottle cap is the crown cork bottle cap which was invented by William Painter in 1982. The crown cork bottle cap is made of steel, and as it is used on the vast majority of glass bottles today, the crown cork bottle cap is familiar to most consumers throughout the world. The London Crown Cork Company was established resulting from this invention after which utilization of their bottle caps began in many countries.

A white cap was developed in the U.S. by the White brothers in 1926. The white cap is still used widely today.

However, there are many disadvantages of the above two types of bottle caps. For example, the crown cap cannot be opened without the use of a bottle opener. Also, because it is made of steel, the crown cap can corrode. This corrosion is unaesthetic and unhygienic. With regard to the white cap, although it can be opened without the use of a bottle opener, it cannot withstand gas pressure, limiting the scope of usage of the bottle cap to only bottles of un-carbonated beverages.

To solve these disadvantages, a screw-type PP cap (pilfer proof cap) made of aluminum was developed. The PP cap has the advantage of allowing opening without a bottle opener, but as a result of its construction, a skirt portion of the PP cap often becomes sharp after opening which can cut into a user's hands when the cap is screwed on and off. As a result, a PP cap made of synthetic resin is increasingly replacing the aluminum PP cap. However, the screw-type PP cap made of synthetic resin is difficult to open, and during the twisting packaging process, an extreme top end of a bottle can become damaged.

Another type of bottle cap is the ring pull cap made of metal. The ring pull cap is extensively used in the U.S. and Japan. However, the ring pull cap can also become sharp after opening like the aluminum PP cap, it can not reseal the bottle after opening, and due to the thinness of the ring pull cap, it cannot withstand pressure created in carbonated beverages.

SUMMARY OF THE INVENTION

The present invention has been made in an effort to solve the above problems.

It is a first object of the present invention to provide a bottle cap which can be used regardless of the kind of material a bottle is made of.

It is a second object of the present invention to provide a bottle cap which is applicable for any capping method whether it be a pressurized method or a vacuum method.

It is a third object of the present invention to provide a bottle cap which has exceptional sealing attributes able to withstand pressures created in carbonated beverages.

It is a fourth object of the present invention to provide a bottle cap that does not corrode and is thus hygienic.

It is a fifth object of the present invention to provide a bottle cap which can be easily opened without the use of a separate implement (i.e., a bottle opener).

It is a sixth object of the present invention to provide a bottle cap that can reseal the contents of the bottle after opening.

It is a seventh object of the present invention to provide a bottle cap that is attractive in appearance.

And finally, it is an eighth object of the present invention to provide a bottle cap that does not produce any sharp edges such that the bottle cap is safe even for children.

To achieve the above objects, the present invention provides a bottle cap comprising an upper body including a plurality of longitudinal grooves formed around an outer circumferential surface, an inner cap extending downward from an inside of the upper body, at least two seals formed between an inner circumferential surface of the upper body and the inner cap, and at least one stopper projection for catching on an upper portion of a bottle;

a lower body connected to a lower end of the upper body and having a plurality of longitudinal grooves formed around an inner circumferential surface and at least one stopper projection;

wherein an upper cutting line is formed between the upper body and the lower body except for a non-cutting portion; and a vertical cutting line is formed such that the upper body and the inner cap of the upper body can be separated from remaining parts of the bottle cap, and a pull-tab is further provided to cut the vertical cutting line and to allow the upper body and inner cap to be removed from the bottle by a user.

According to one aspect of the present invention, the upper cutting line is formed around a border between the upper body and the lower body and the pull-tab is formed on the upper body such that when the pull-tab is pulled, the upper cutting line is cut and the upper body is removed from the bottle.

According to another aspect of the present invention, the upper cutting line is formed around the border between the upper body and the lower body except for the non-cutting portion, and the upper cutting line extends downward to meet two vertical cutting lines formed at a predetermined distance extending to a bottom; of the lower body such that when the pull-tab is pulled upward, the vertical cutting lines are cut and the upper cutting line is cut while the upper body is removed from the bottle.

According to a feature of the present invention, there is provided a bottle cap comprising an upper body including a side portion, having a an upper surface, a bottle plug extending downward from the upper surface on an inside of the upper body, and a circumferential ring formed protruding on a lower end of the side portion;

a lower body including a vertical cutting line formed vertically on an outside thereof, and a circumferential groove formed on an inside portion, a connection between the circumferential groove and the circumferential ring securely fixing the lower body and upper body; and a pull-tab, integrally fixed to one side of the vertical cutting line.

According to still another feature of the present invention, a catch protrusion, for connecting under an upper lip of a bottle, is formed on an inside circumference of the lower body, and a ring protrusion, for catching on an inside of a top of the bottle, is formed around an outside circumference of the bottle plug.

BRIEF DESCRIPTION OF THE DRAWINGS

The accompanying drawings, which are incorporated in and constitute a part of the specification, illustrate an embodiment of the invention, and, together with the description, serve to explain the principles of the invention:

FIGS. 1A–1E are drawings illustrating a bottle cap made of synthetic resin according to a first embodiment of the present invention, wherein:

FIG. 1A is a sectional view,

FIG. 1B is a sectional view taken along line A—A of FIG. 1A,

FIG. 1C is a sectional view taken along line X—X of FIG. 1A,

FIG. 1D is a sectional view illustrating the bottle cap in a state sealing a bottle, FIG. 1E is a sectional view of the bottle cap used for explaining the removal of the bottle cap from the bottle;

DETAILED DESCRIPTION OF THE PREFERRED EMBODIMENTS

Figure 1A:
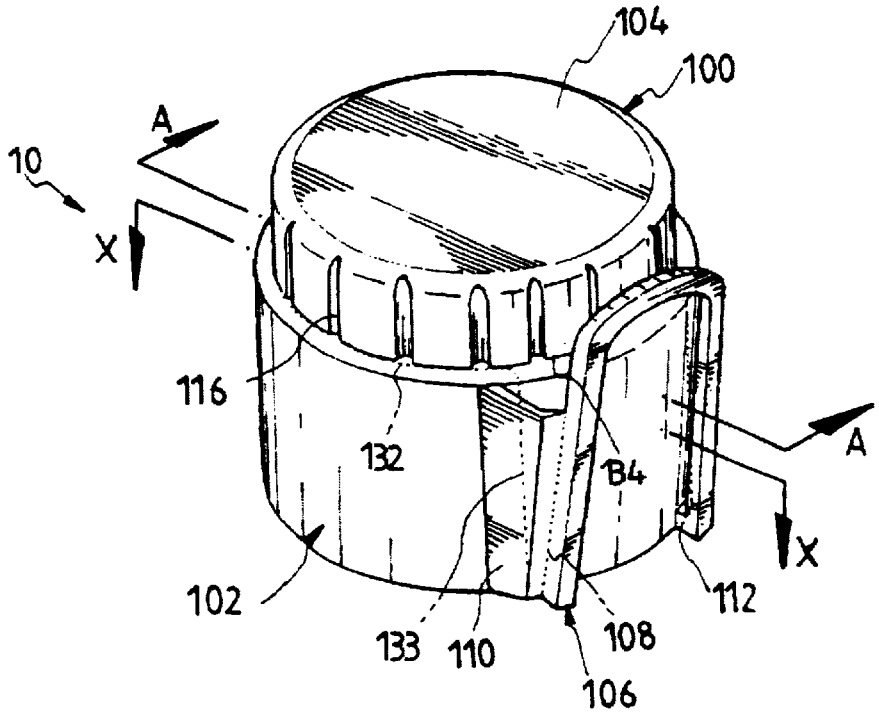

Preferred embodiments of the present invention will now be described with reference to the drawings.

Referring to FIGS. 1A–1E, there is shown a bottle cap 10 made of synthetic resin according to a first embodiment of the present invention. As shown in the drawings, the bottle cap 10 is comprised of an upper body 100 and a lower body 102. A top surface 104 that is substantially flat is formed on the upper body 100. Two supports 110 are provided on an outer circumferential surface of the lower body 102 at predetermined distances from each other. A pull-tab 106 is formed on the supports 110 and tab cutting lines 108 are formed on both sides of the pull-tab 106. A lower end of the pull-tab 106 is connected to the outer circumferential surface of the lower body 102 by connecting portions 112. Further, a plurality of longitudinal grooves 116 are formed on an outer circumferential surface of the upper body 100, the grooves 116 being formed at predetermined distances.

Figure 1B:
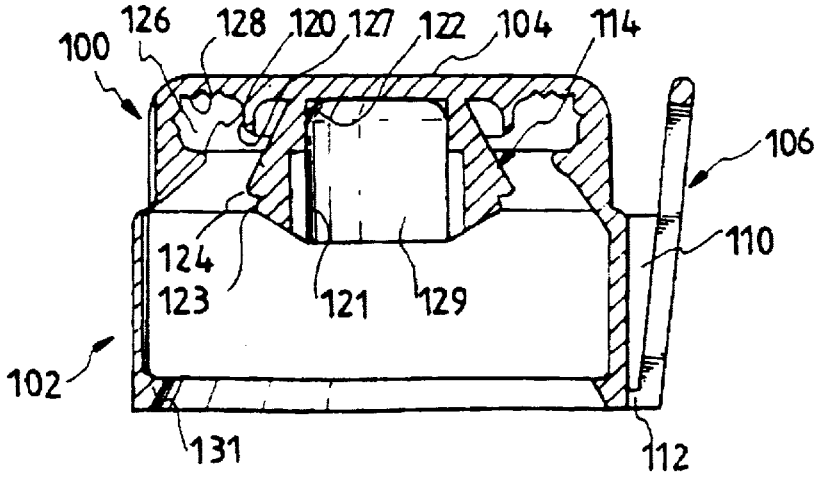
Figure 1C:
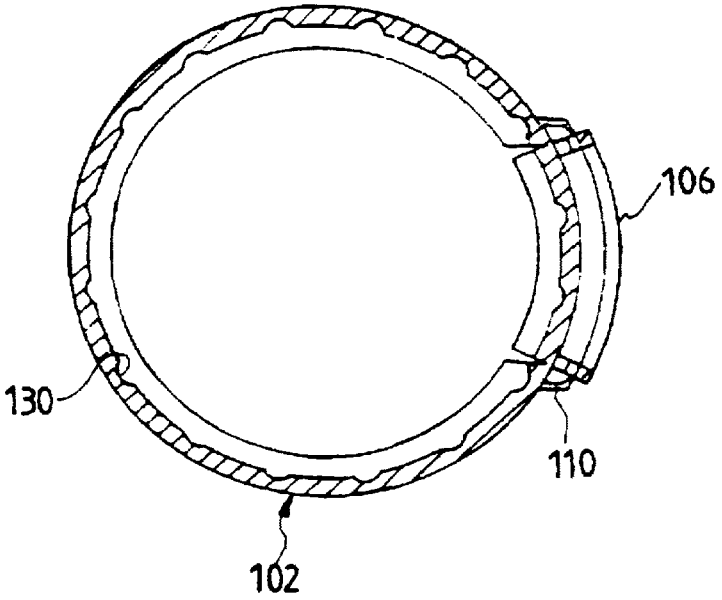
Figure 1D:
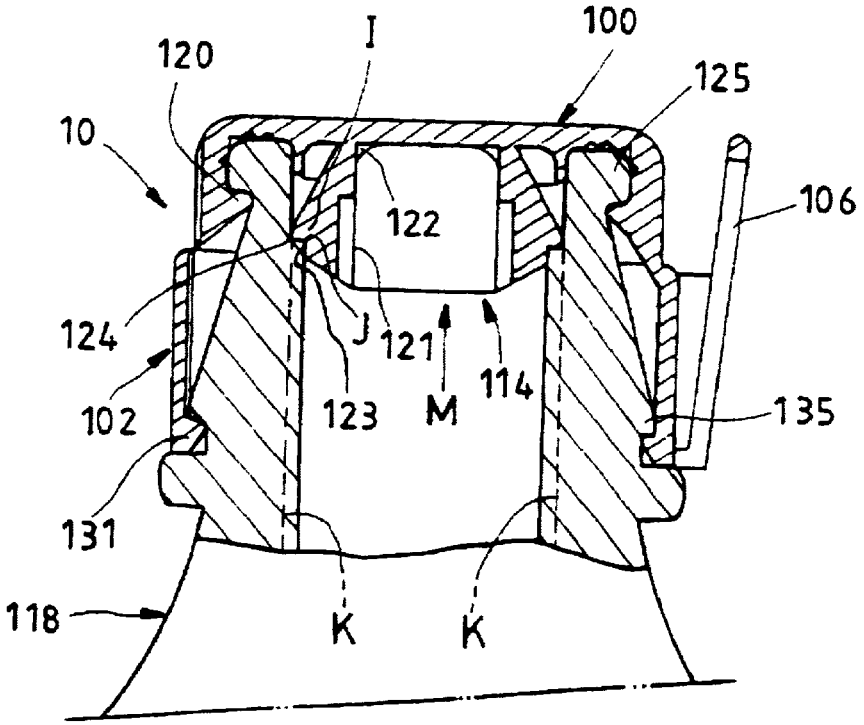

As shown in FIG. 1B, an inner cap 114 is formed extending downward from a center part of the top surface 104 of the upper body 100 inside the bottle cap 10. A cavity 129 is formed in the inner cap 114, and corner reinforcements 122 and side reinforcements 121 are formed are provided on inner walls of the inner cap 114 in the cavity 129. First and second seals 123 and 124 are formed between the inner cap 114 and an inner circumferential surface of the upper body 100. Also, an upper stopper projection 120 is proved in the inner circumferential surface of the upper body 100, the upper stopper projection 120 defining an insertion groove 126. Accordingly, as shown in FIG. 1D, when the bottle cap 10 is placed on a bottle 118, an upper lip 125 of the bottle 118, formed around an upper end-outer circumferential surface thereon, is inserted in the insertion groove 126 (FIG. 1B) and stops against the upper stopper projection 120.

Referring back to FIG. 1B, third and fourth seals 127 and 128 are formed between the inner cap 114 and the inner circumferential surface of the upper body 100 in an area defined by the insertion groove 126. Also, a lower stopper projection 131 is formed protruding from a lower end-inner circumferential surface of the lower body 102. As shown in FIG. 1C, taken along line X-X of FIG. 1A, a plurality of longitudinal grooves 130 are formed at predetermined distances around the inner circumferential surface of the lower body 102.

As shown in FIG. 1A, a upper cutting line 132 is provided on a border formed between the upper body 100 and the lower body 102. The upper cutting line 132 is connected to vertical cutting lines 133 which extend down along an inside of both the supports 110 and stop directly above the connecting portions 112. A non-cutting portion 134 is formed between the vertical cutting lines 133 between the upper body 100 and lower body 102.

The operation of the present invention according to the first embodiment will now be explained with reference to FIG. 1D.

The bottle cap 10 is placed on the bottle 118 and pressed down onto an upper portion thereon through a series of mechanical devices such that the lower body 102 of the bottle cap 10 is positioned around the upper portion of the bottle 118 and the inner cap 114 is located inside a mouth of the bottle 118 as shown in FIG. 1D.

When this is done, the upper lip 125 and a lower protrusion 135 of the bottle 118 come to be caught on the first stopper projection 120 and the lower stopper projection 131, respectively. As a result, the first and second seals 123 and 124 (FIG. 1B) of the inner cap 114 fit snugly against an inside and outside upper circumference of the bottle 118, while the third and fourth seals 127 and 128 tightly adhere to an inside and outside circumference of the upper lip 125.

Accordingly, in the first embodiment of the present invention, as there are at least 4 seal locations, the bottle 118 is thoroughly and securely sealed, and as there are at least two stopper projections, the bottle cap 10 cannot become damaged and the bottle cap 10 is not overly easy to remove, preventing inadvertent removal from carbonation pressure.

Referring back to FIG. 1A, the upper cutting line 132 and vertical cutting lines 133 are realized between the upper and lower bodies 100 and 102 through a thin membrane. As a result of this construction and because the upper body 100 is held firmly to the bottle (not shown) by third and fourth seals 127 and 128, the bottle cap 10 can still be removed without the use of the pull-tab 106 by twisting the lower body 100 which will break the connection of the upper cutting line 132 and the vertical cutting lines 133.

Because of the thin nature of the upper cutting line 132, it is not possible to form the same above the fourth seal 128 when the bottle cap 10 is sealed with the contents of the bottle (not shown) emits internal pressure (i.e., from soda beverages).

That is, when the bottle cap 10 is vacuum-sealed, as pressure is given in a L or downward direction, as shown in FIG. 1D, no problem results from the formation of the upper cutting line 132 above the fourth seal 128. However, when internal pressure is formed in the bottle 118, as force is exerted on the bottle cap 10 in a M or upward direction, the upper cutting line 132 is preferably not formed above the fourth seal 128. Also, if the bottle cap 10 is used to reseal the bottle 118, as the upper lip 125 of the bottle 118 must be completely sealed, it is not preferable to form the upper cutting line 132 above the fourth seal 128.

However, it is still possible to form the upper cutting line 132 above the fourth seal 128 depending on how the contents in should be stored in the bottle 118, the expiration period, etc.

The tight fit between the bottle 118 and the first, second, third, and fourth seals 123, 124, 127, and 128 is made possible through the side reinforcements 121, an elastic force of which is controlled by the corner reinforcements 122.

Figure 1E:
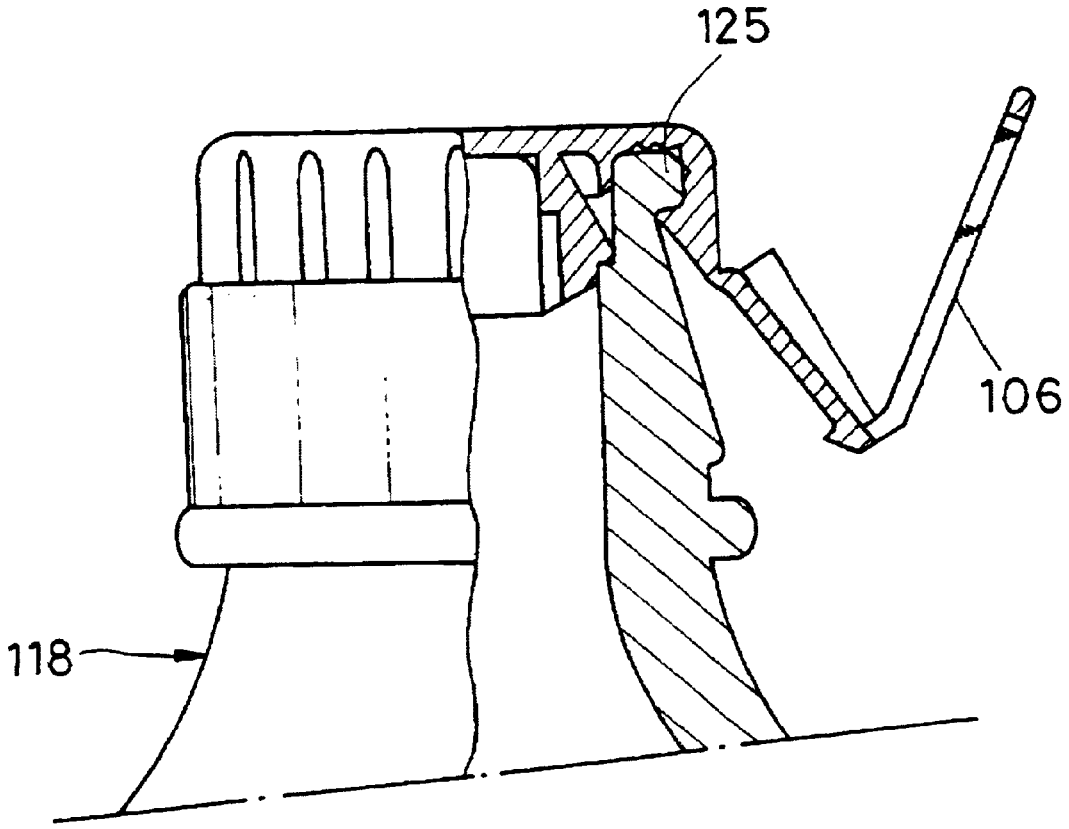

Referring to FIG. 1A, when the user desires to remove the bottle cap 10 from the bottle (not shown), the pull-tab 106 is first pulled in an outward direction which cuts the tab cutting lines 108. Next, if the user continues a pulling action in an up and outward direction while grasping the pull-tab 106, the vertical cutting lines 133 are cut then, simultaneously, the upper cutting line 132 is cut and the upper stopper projection 120 is pulled away from the upper lip 125 of the bottle 118, as shown in FIG. 1E. From this state, continued force in the upward direction by the user forces the bottle cap 10 to be removed from the bottle 118. The bottle cap 106 can be resealed on the bottle 118 by first removing the lower body 102 as this portion is no longer needed, and then by pressing down on bottle cap 10 after the same has been correctly positioned over the mouth of the bottle 118.

Figure 2:
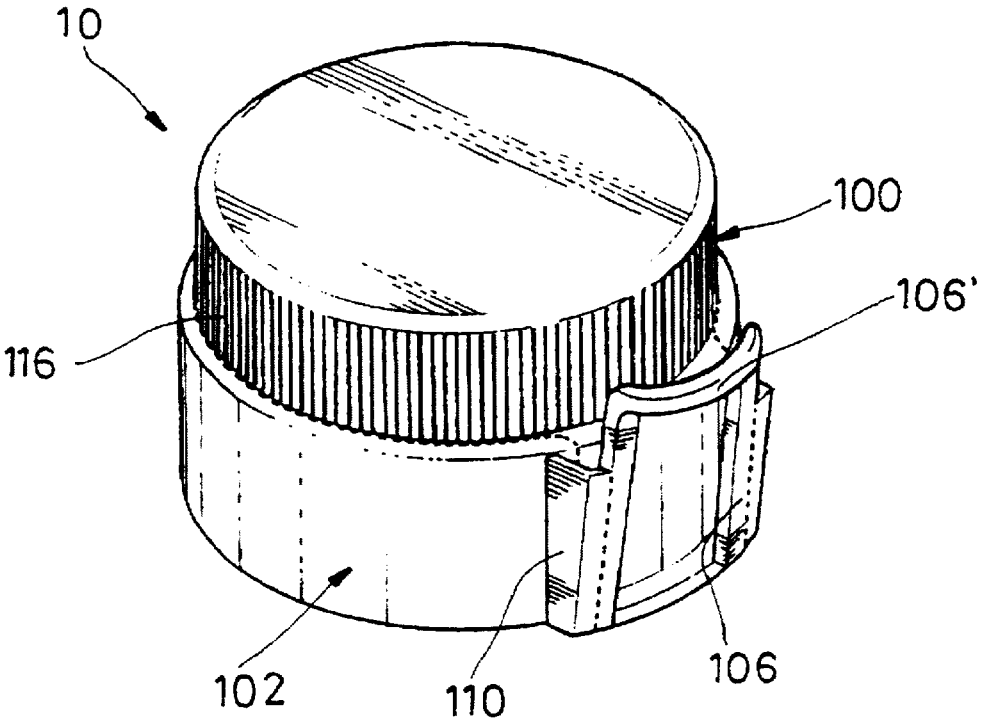
FIG. 2 is a perspective view of a modified example of the first embodiment of the present invention as shown in FIG. 1A.

Referring to FIG. 2, there is shown a modified example of the above first embodiment of the present invention. In this modified example, all parts of the bottle cap 10 are identical to that of the first embodiment except that a ridge portion 106' is provided on the pull-tab 106. The ridge portion 106' is formed extending outward on an upper portion of the pull-tab 106 such that the user can more easily grab the same. Also, this modified example provides more grooves 116 on the upper body 100 which are formed closely together.

Figure 3:
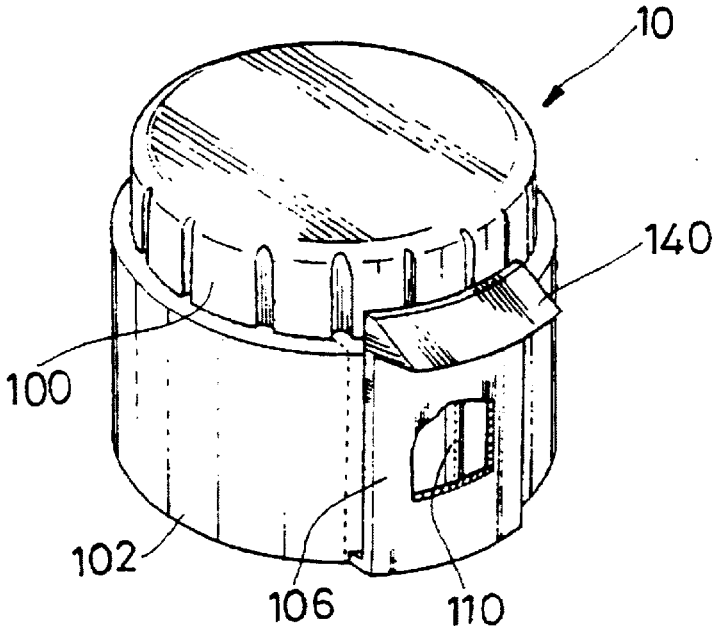
FIG. 3 is a perspective view of a modified example of the first embodiment of the present invention as shown in FIG. 1A.

Referring to FIG. 3, there is shown another modified example of the first embodiment of the present invention. As shown in the drawing, there is provided only one support 110 which is formed on an inside, middle portion of the pull-tab 106, the support 110 fixing the pull-tab 106 to the lower body 102. Also, a grip 140 is formed on the top of the pull-tab 106 to allow for easy grasping of the same.

Figure 4:
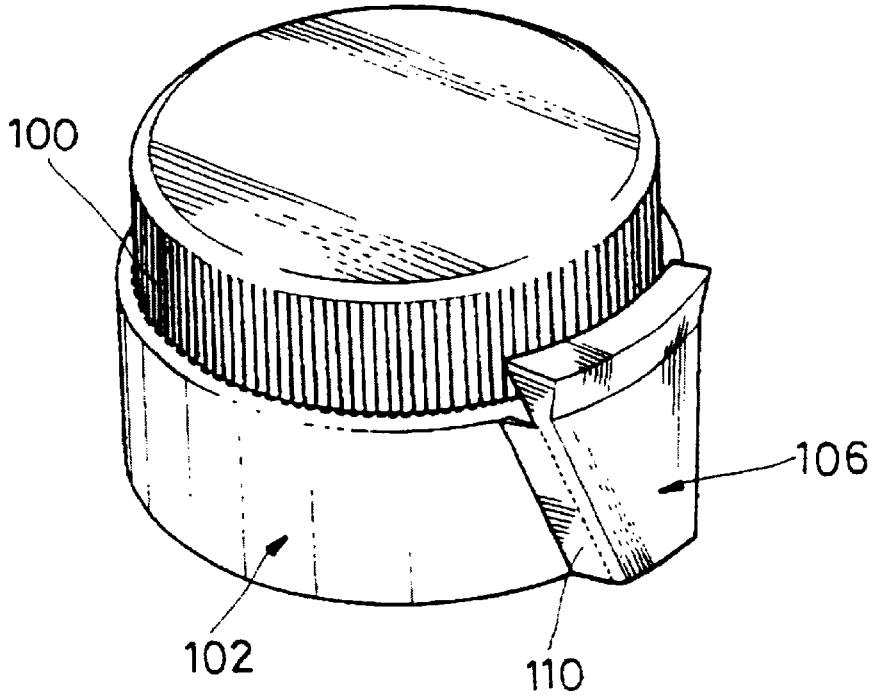
FIG. 4 is a perspective view of a modified example of the first embodiment of the present invention as shown in FIG. 1A.
Figure 5:
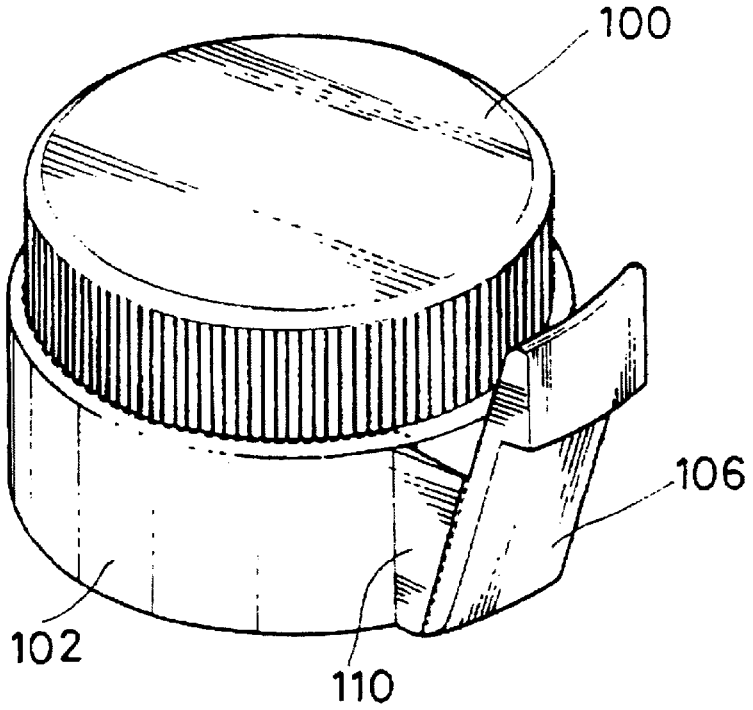
FIG. 5 is a perspective view of a modified example of the first embodiment of the present invention as shown in FIG. 1A.

There is shown yet another modified example of the first embodiment of the present invention in FIG. 4. As shown in the drawing, the pull-tab 106 is V-shaped. The supports 110 in this embodiment follow along the decreasing width of the pull-tab 106. Referring to FIG. 5, there is shown still yet another modified example of the first embodiment. As can be seen in the drawing, the supports 110 are narrow at a bottom portion and are widest toward an upper portion thereof such that the user can easily insert his or finger between the pull-tab 106 and upper body 100. The pull-tab 106 here is shaped similarly to that shown in FIG. 3.

Figure 6:
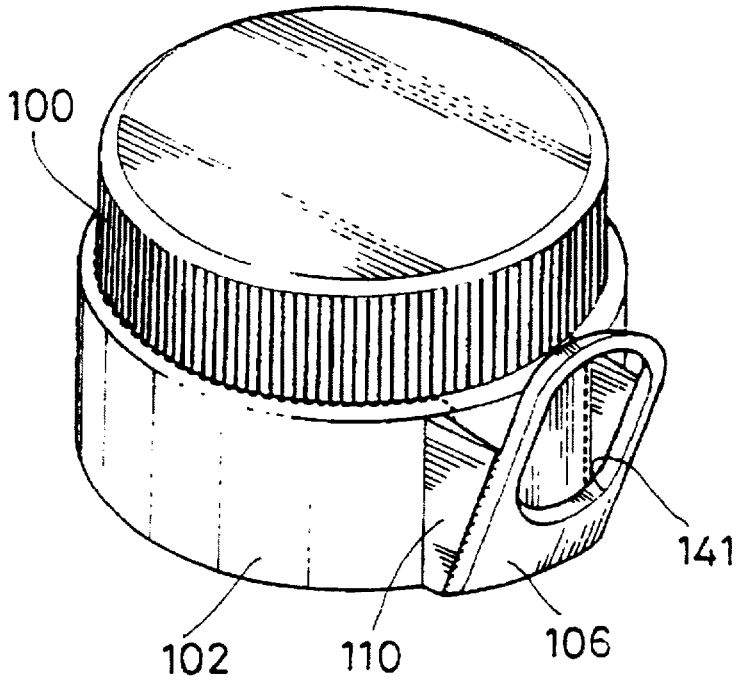
FIG. 6 is a perspective view of a modified example of the first embodiment of the present invention as shown in FIG. 1A.

Another modified example of the first embodiment is illustrated in FIG. 6. Here, a finger hole 141 is provided in the pull-tab 106. This allows the user to firmly grip the pull-tab 106 by the placing of a finger in the finger hole 141. The remainder of this modified example is identical to the above modified example appearing in FIG. S.

Figure 7:
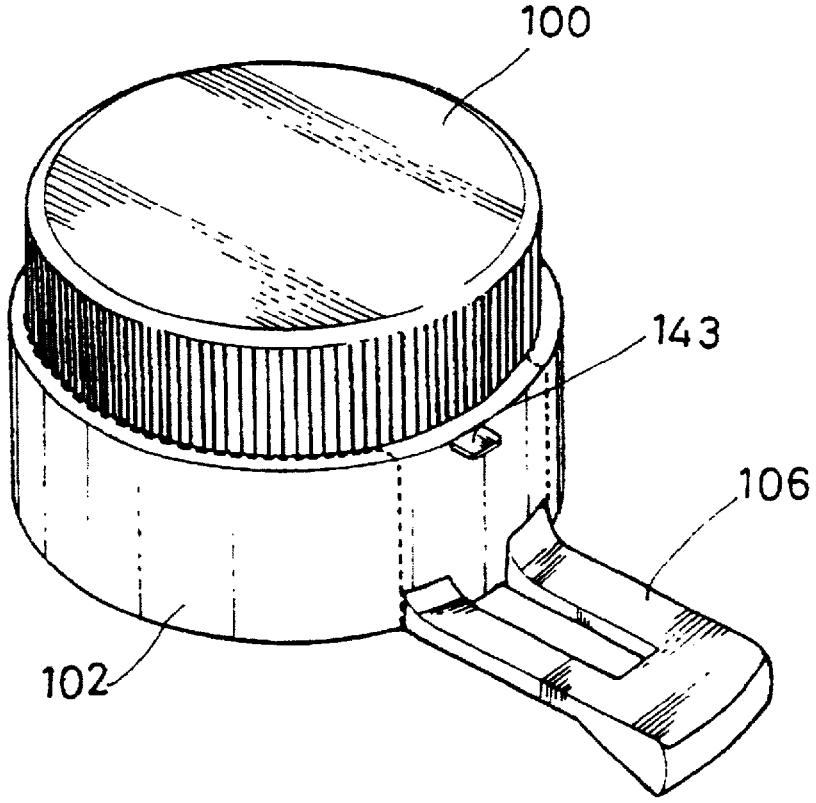
FIG. 7 is a perspective view of a modified example of the first embodiment of the present invention as shown in FIG. 1A.

Referring to FIG. 7, there is shown yet another modified example of the first embodiment. As can be seen in the drawing, no supports are provided in this modified example. Instead, a protrusion 143 is formed on an upper portion of the lower body 102 which is connected to the pull-tab 106. The protrusion 143 can be separated from the pull-tab 106 when the user pulls on the same. This design reduces the amount of material needed to produce the bottle cap 10.

Figure 8:
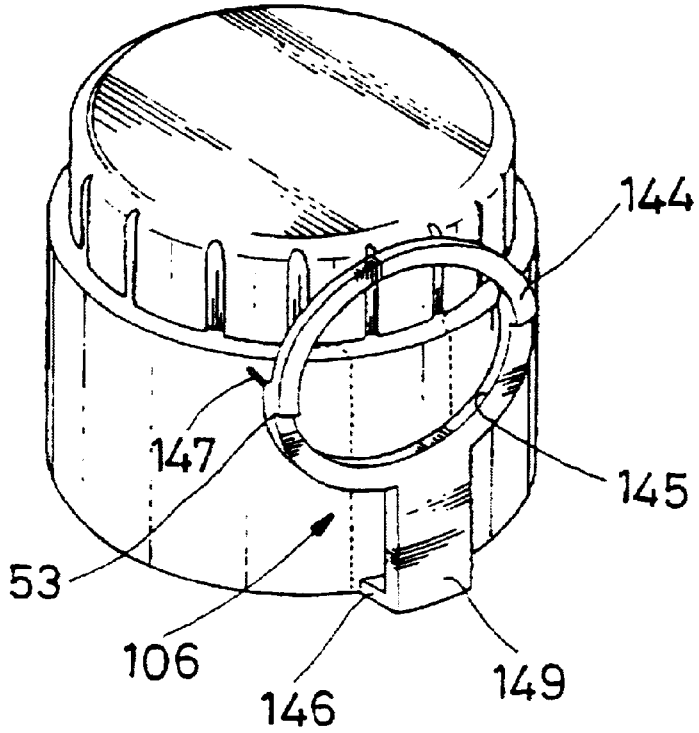
FIG. 8 is a perspective view of a modified example of the first embodiment of the present invention as shown in FIG. 1A.

There is illustrated still yet another modified example of the present invention in FIG. 8. As is shown, the pull-tab 106 in this modified example is ring-shaped having a finger hole 145. Starting from a center portion 53, the finger hole 145 is carved inward on a lower-outside portion, and carved inward on an upper-inside portion. A connecting portion 146 is formed on a bottom of the pull-tab 106 connecting the same to the lower body 102 of the bottle cap 10. Connectors 147 are formed on the center portion 53 which connect the pull-tab 106 with the lower body 102 and keep the pull-tab 106 fixed thereon until the user pulls on the pull-tab 106. This allows for the easy molding of the structure permitting separation of the upper body 100 of the pull-tab 106 from the lower body 102.

That is, if the above structure using the connectors 147 is not used, a slide-type method of molding must be used to form the finger hole 145. Slide molding increases molding time, production costs, and decreases the life-span of the mold itself.

Figure 9:
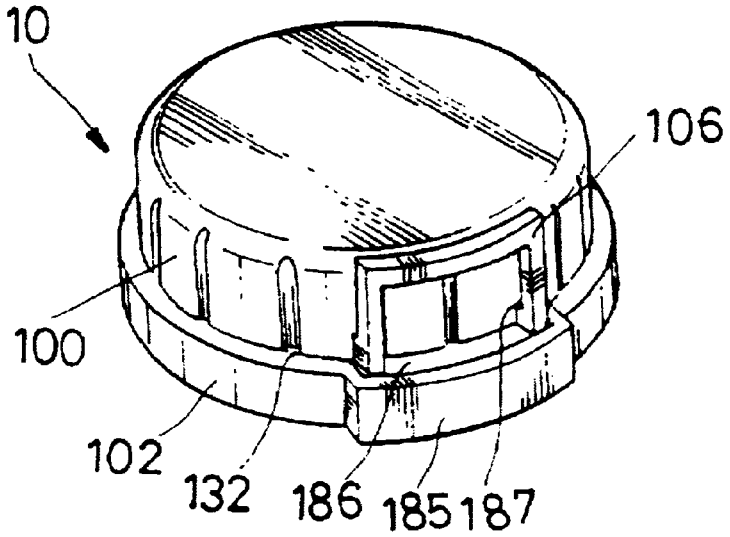
FIG. 9 is a perspective view of a modified example of the first embodiment of the present invention as shown in FIG. 1A.

Referring now to FIG. 9, there is shown another modified example of the first embodiment of the present invention. As shown in the drawing, a projecting portion 185 defining a slot 186 is formed on the lower body 102 of the bottle cap 10. The pull-tab 106 in this modified example is formed directly on the upper body 100 through connecting portions 187.

In this modified example, the user removes the bottle cap 10 from the bottle (not shown) by first pulling the projecting portion 185 in an up and outward direction which, as a result of the formation of the upper cutting line 132, removes the lower body 102 from the upper body 100. From this state, the user places his or her finger in the pull-tab 106 and pulls until the upper body 102 is removed from the bottle (not shown).

Figure 10:
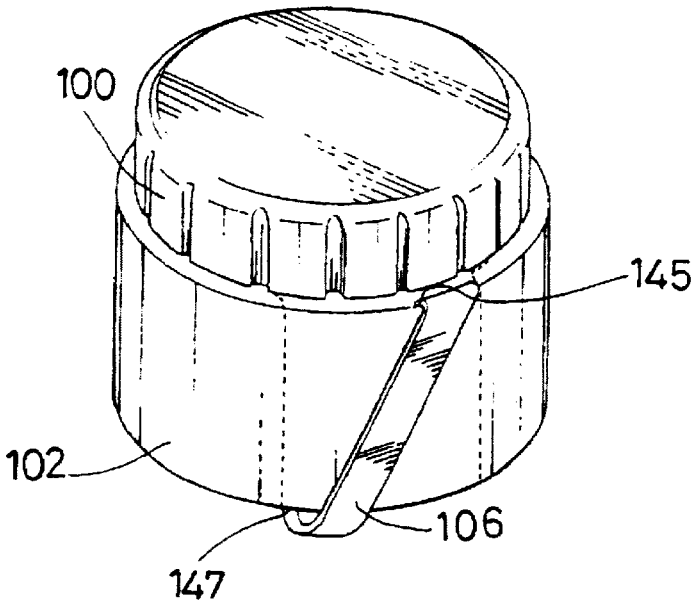
FIG. 10 is a perspective view of a modified example of the first embodiment of the present invention as shown in FIG. 1A.

Another modified example of the first embodiment of the present invention is shown in FIG. 10. As shown in the drawing, the pull-tab 106 is formed diagonally across the lower body 102 of the bottle cap 10. The pull-tab 106 includes connecting portions 147 formed on upper and lower ends thereof. The diagonal formation of the pull-tab 106 is done for ease-of-molding purposes. Namely, with this formation, as no side molding operation is needed, the bottle cap 10 can be injected without needing to perform side molding operations.

Figure 11:
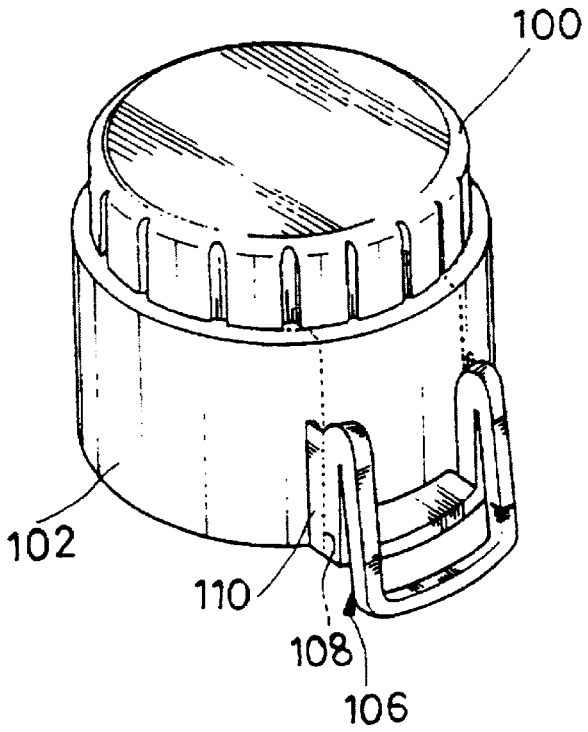
FIG. 11 is a perspective view of a modified example of the first embodiment of the present invention as shown in FIG. 1A.

Another modified example of the first embodiment of the present invention is illustrated in FIG. 11. Here, the pull-tab 106 is formed folded over once in a downward direction. The remaining part of the pull-tab 106 not folded over is connected to the supports 110 and the tab cutting lines 108 are formed therebetween. In this modified example, the user first tugs the pull-tab 106 in a downward direction to cut the tab cutting lines 108 for the detachment of the pull-tab 106 from the supports 110, and the rest of the operation to remove the bottle cap 10 is identical to that in the first embodiment.

Figure 12A:
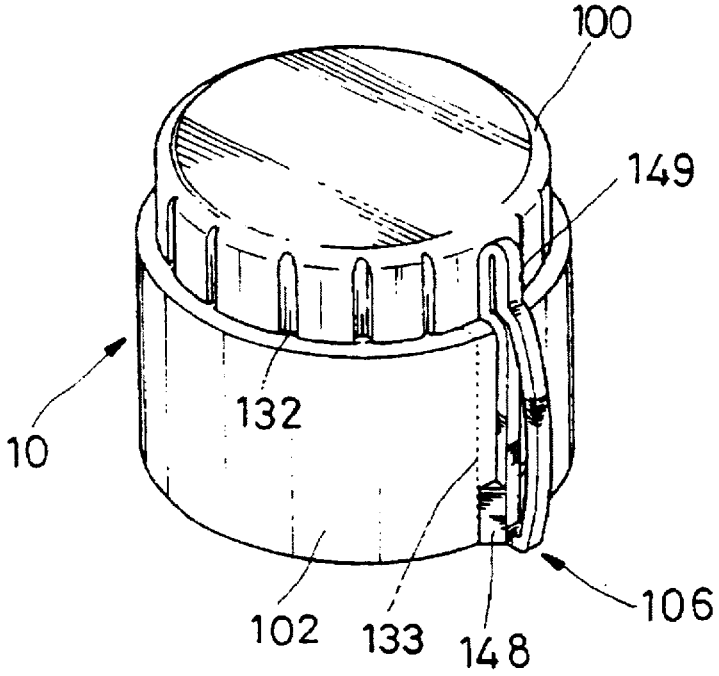
FIGS. 12A and 12B are perspective views of a modified example of the first embodiment of the present invention as shown in FIG. 1A.
Figure 12B:
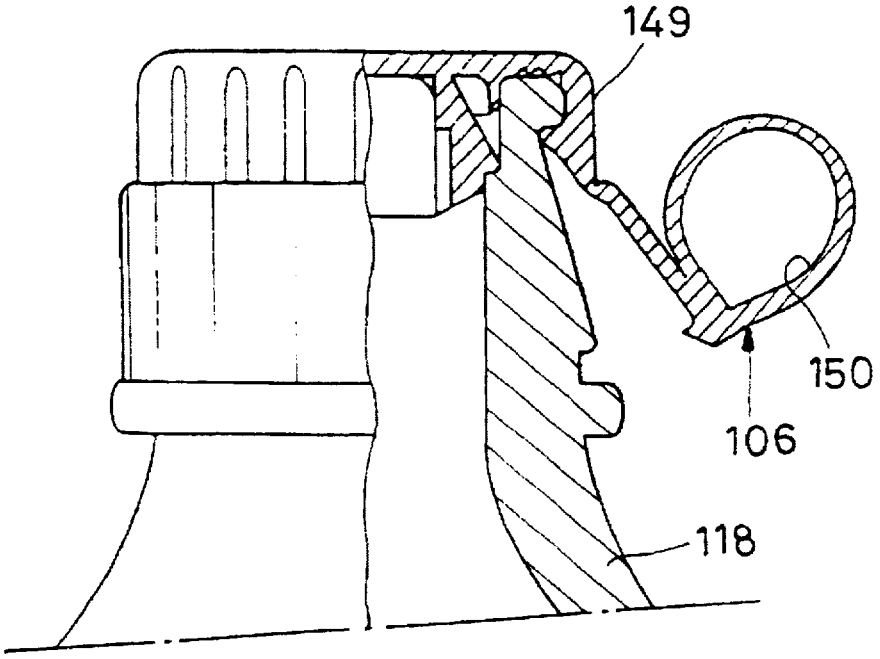

Referring to FIGS. 12A and 12B, there is shown another modified example of the first embodiment. Here, the pull-tab 106 is ring-shaped but is maintained in a compressed state (until pulled by the user) by the securing of part of the pull-tab 106 on the upper body 100 through a joining portion 149. A connecting portion 148 is formed on the bottom of the lower body 102 to which the pull-tab 106 is integrally connected.

To remove the bottle cap 10 from the bottle 118 in this modified example, the user first pulls on the pull-tab 106 in an outward direction which disconnects the pull-tab 106 from the upper body 100 by severing the connection made by the joining portion 149. As a result, the pull-tab 106 is expanded to where a ring-shaped finger hole 150 is formed. The user then places a finger in the finger hole 150 and pulls upward, the action of which cuts the vertical cutting lines 133 such that the bottle cap 10 is in a state as shown in FIG. 12B. With continued upward force exerted on the pull-tab 106 by the user, the upper cutting line 132 is cut while the upper body 100 is being removed from the bottle 118.

Figure 13:
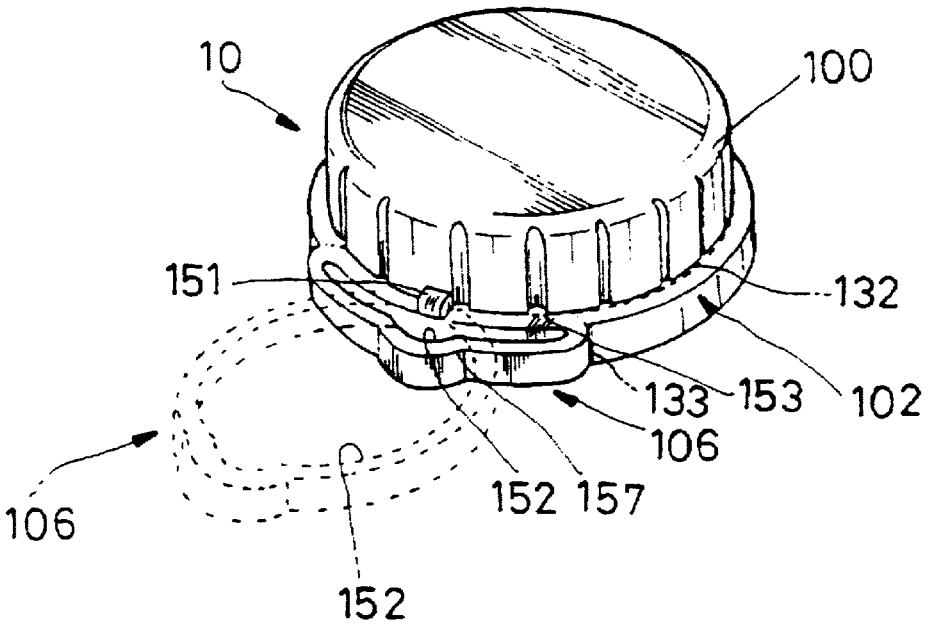
FIG. 13 is a perspective view of a modified example of the first embodiment of the present invention as shown in FIG. 1A.

Referring to FIG. 13, there is shown another modified example of the first embodiment of the present invention. As shown in the drawing, a connecting portion 151 is integrally formed to the upper body 100 and the pull-tab 106. The pull-tab 106 in this modified example has an arch 157 for easy grasping and is compressed into an oval shape such that a finger hole 152 is formed therein. Tab cutting lines 153 are formed on both sides of the connecting portion 151 and vertical cutting lines 133 are formed between the lower body 102 and the pull-tab 106. The upper cutting line 132 is formed similarly to that in the first embodiment. All the cutting lines 153, 133, and 132 are interconnected.

The user removes the bottle cap 10 from the bottle (not shown) by pulling outward on the pull-tab 106. This action severs the vertical cutting lines 133 then the tab cutting lines 153 such that the pull-tab 106 changes to a state as shown by the dotted lines wherein the finger hole 152 is enlarged. The user then pulls upward on the pull-tab 106, and, as the pull-tab 106 and the upper body 100 are connected by the connecting portion 151, the upper body 100 is removed from the bottle (not shown) as the upper cutting line 132 is being cut.

Figure 14:
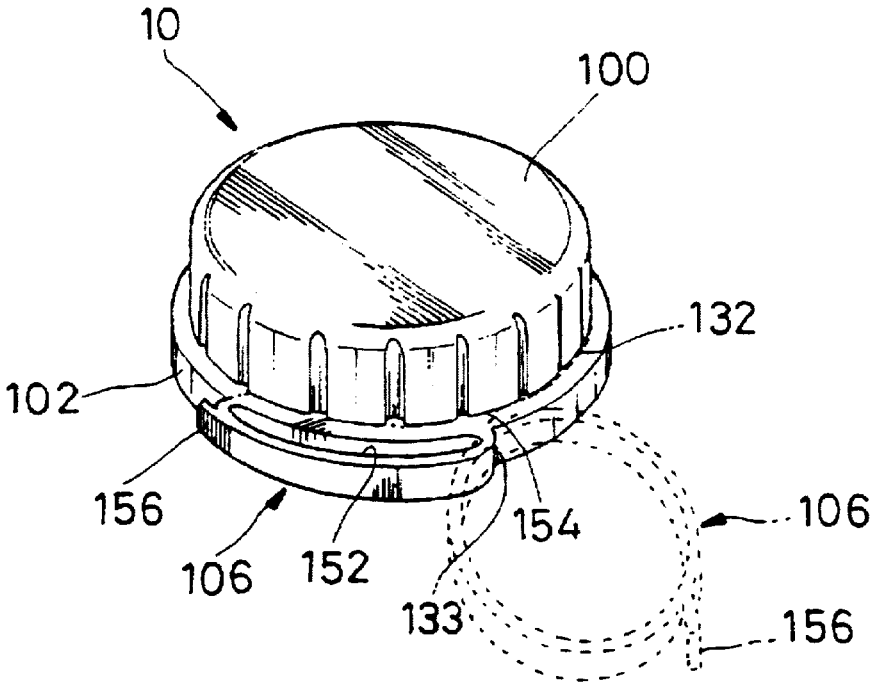
FIG. 14 is a perspective view of a modified example of the first embodiment of the present invention as shown in FIG. 1A.

Another modified example is shown in FIG. 14. Here, the upper cutting line extends around the entire circumference between the upper and lower bodies 100 and 102 except for a relatively small non-cutting portion 154 formed at one end of the pull-tab 106. The vertical cutting lines 133 are formed along both ends of the pull-tab 106 and the upper cutting line 132. The non-cutting portion 154 integrally connects the pull-tab 106 with the upper body 100. The pull-tab 106 in this modified example is formed similarly (i.e., in an oblong shape) to the above modified example shown in FIG. 13 such that a finger hole 152 is provided in the center of the pull-tab 106. A finger grip 156 is formed on an end of the pull-tab 106 opposite that to which the non-cutting portion 154 is formed.

To remove the bottle cap 10, the user first pulls on the pull-tab 106 in a rightward direction until it is in a state shown by the dotted lines. In this state, a finger can be placed in the pull-tab 106 to allow the upper body 100 to be easily removed from the bottle (not shown) by pulling upward on the bottle cap 106. In this modified example, it is preferable that the width of the lower body 102 is limited.

Figure 15:
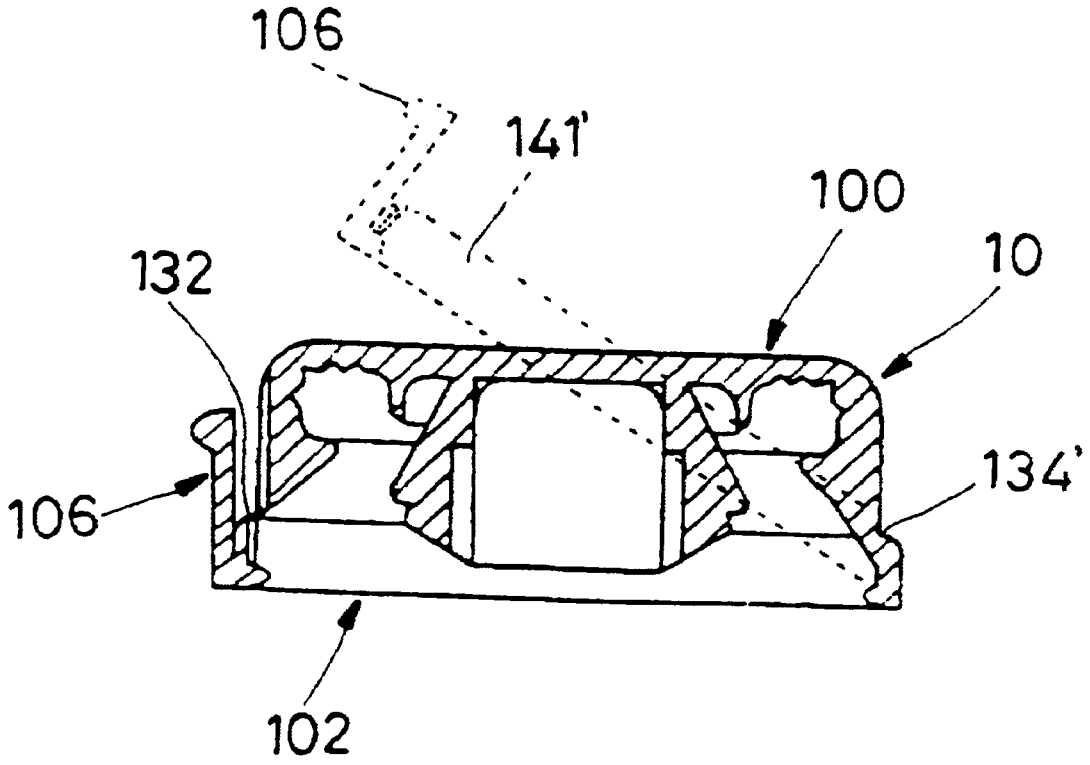
FIG. 15 is a perspective view of a modified example of the first embodiment of the present invention as shown in FIG. 1A.

There is shown another modified example of the first embodiment in FIG. 15. In this modified example, a non-cutting portion 134' is formed which integrally connects the upper body 100 and the pull-tab 106. The upper cutting line 132 here is formed around the entire circumference between the upper and lower bodies 100 and 102 except where the non-cutting portion 134' is formed. The pull-tab 106 is provided opposite that of the non-cutting portion 134'.

In this modified example, the bottle cap 10 is removed by pulling upward on the pull-tab 106, the action of which cuts the upper cutting line 132 to disconnect the upper body 100 from the lower body 102 such that the lower body 102 is positioned as shown by the dotted line. When this is done, a finger hole 141' is formed by the lower body 102. Only the non-cutting portion 134' then remains which allows the upper body 100 to be removed from the bottle (not shown) when the user pulls upward on the pull-tab 106 using the finger hole 141' in a direction opposite that used to cut the upper cutting line 132.

Figure 16A:
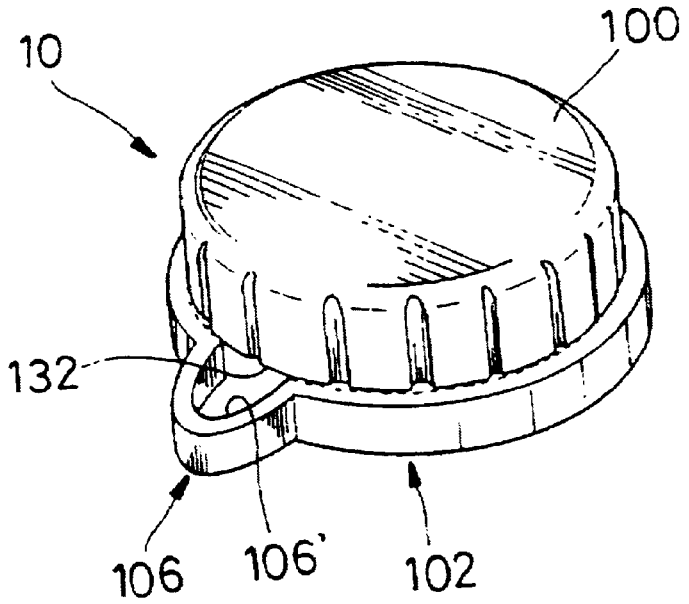
FIGS. 16A and 16B are perspective views of a modified example of the first embodiment of the present invention as shown in FIG. 1A.
Figure 16B:
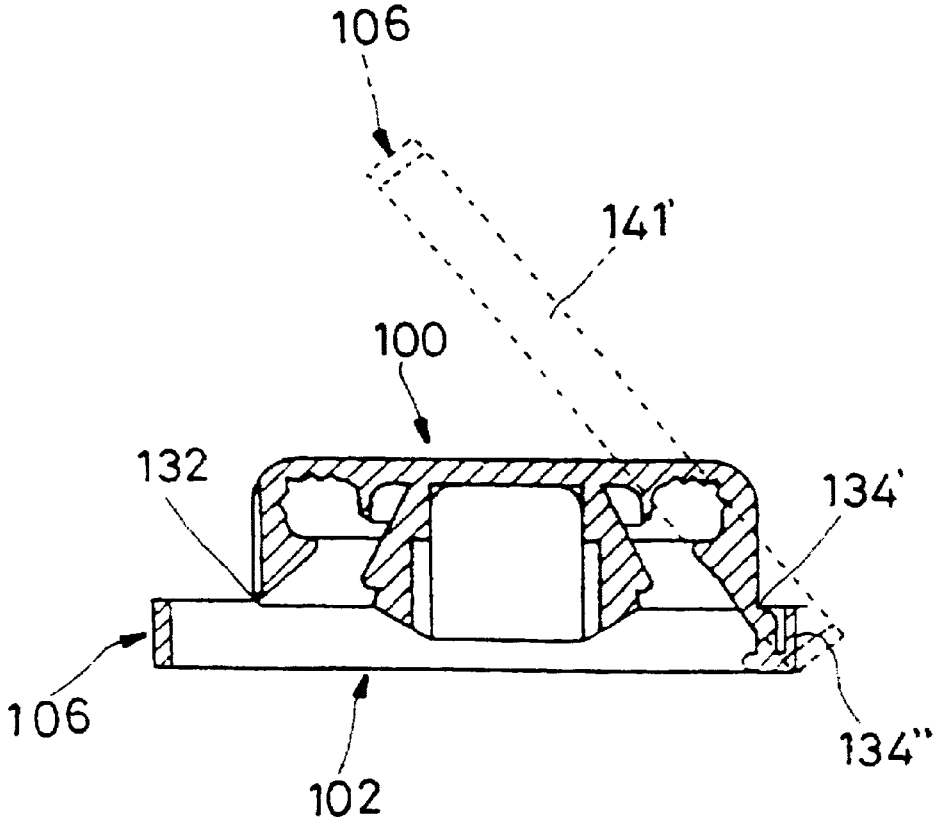

Referring to FIGS. 16A and 16B, there is shown yet another modified example of the first embodiment of the present invention. As shown in the drawing, the pull-tab 106 is formed protruding from the lower body 102 such that a finger hole 106' is formed. Also, a U-shaped connecting portion 134" is formed on a side of the lower body 102 opposite that of the pull-tab 106, and a non-cutting portion 134' is provided between the upper body 100 and the connecting portion 134" and connected therebetween.

The user removes the bottle cap 10 by pulling upward on the pull-tab 106 which cuts the upper cutting line 132 completely around the lower body 102 except where the non-cutting portion 134' is located such that the bottle cap 10 is in a state as shown by the dotted line in FIG. 16B. This action creates a large finger hole 141' which can then be used to pull the upper body 100 from the bottle (not shown).

Figure 17:
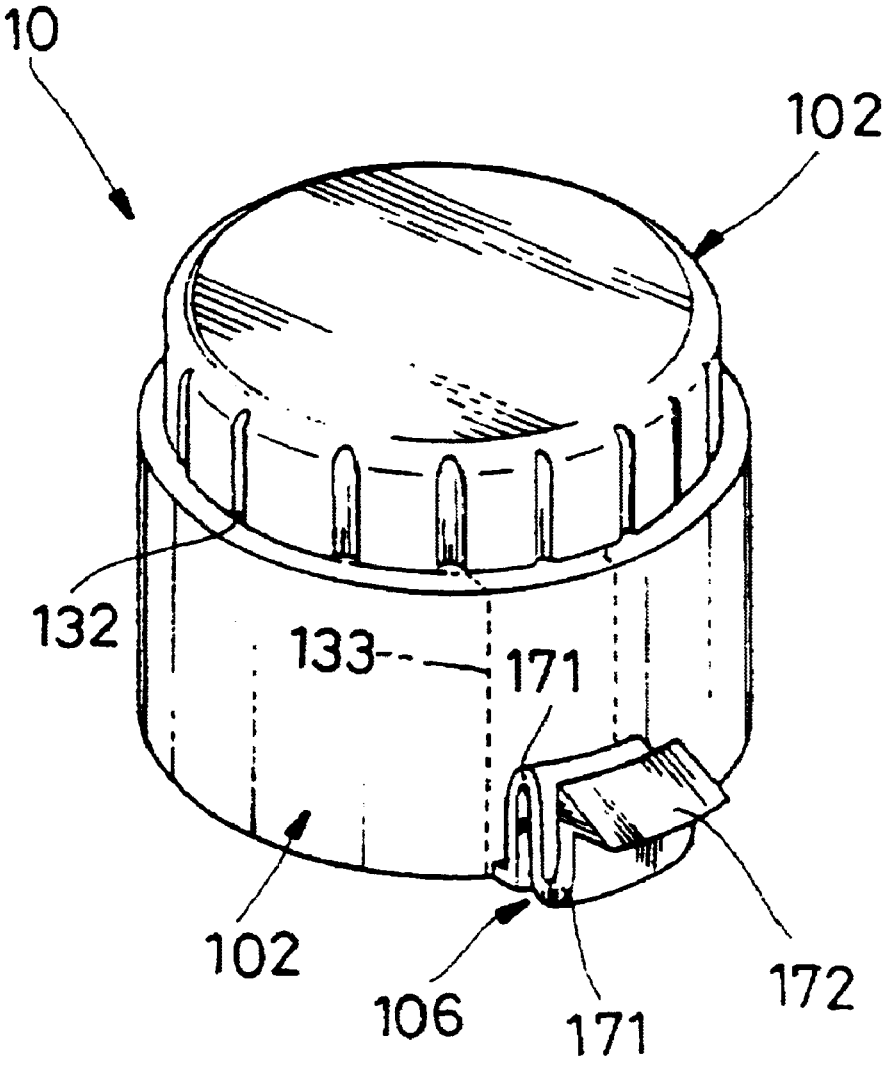
FIG. 17 is a perspective view of a modified example of the first embodiment of the present invention as shown in FIG. 1A.

Another modified example is illustrated in FIG. 17. Here, the pull-tab 106 is formed having a plurality of bends 171 and a grip 172. An end of the pull-tab 106 opposite that of the grip 172 is connected to the lower body 102. When the user pulls on the grip 172 of the pull-tab 106 the bends 171 straighten, and if pulling force is further exerted, the vertical cutting lines 133 severed. The bottle cap 10 can then be removed by the continued application of upward pulling force by the user which cuts the upper cutting line 132 as the bottle cap 10 is being removed.

Figure 18A:
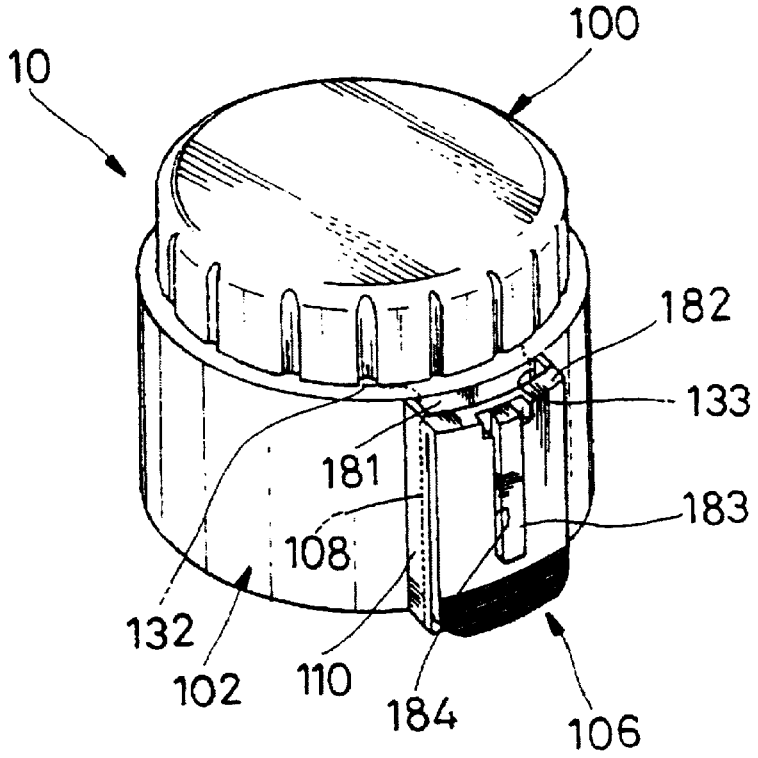
FIGS. 18A and 18B are perspective views of a modified example of the first embodiment of the present invention as shown in FIG. 1A.
Figure 18B:
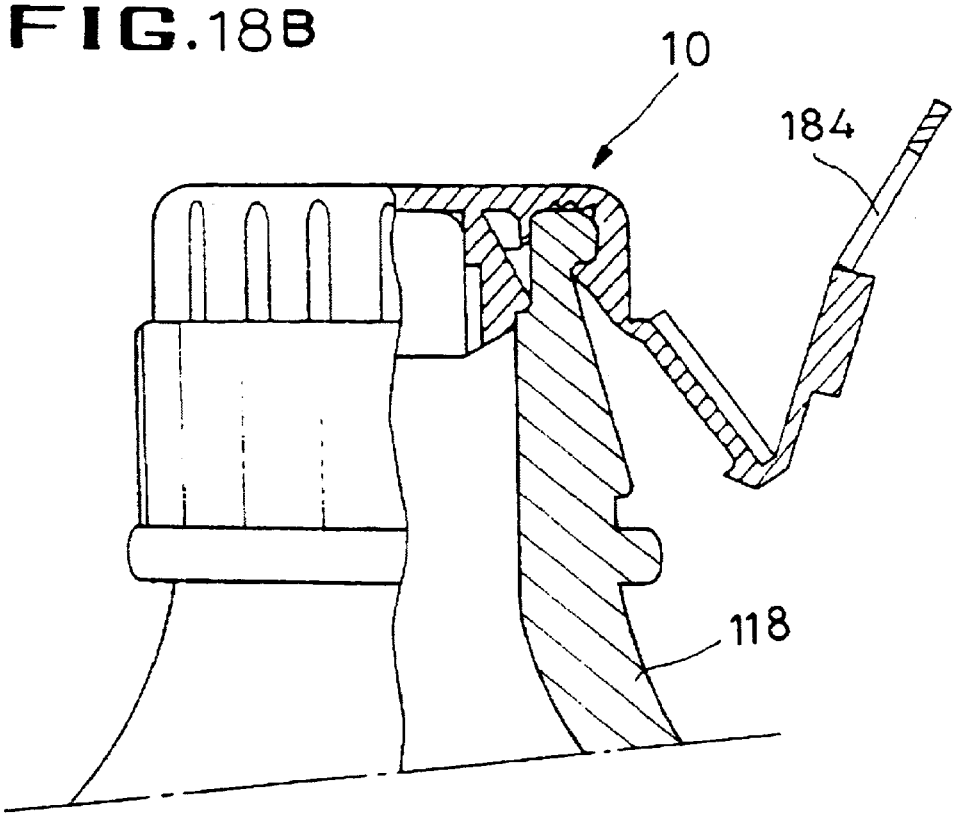

Referring to FIGS. 18A and 18B, there is shown another modified example of the first embodiment. As shown in the drawing, the upper cutting line 132 is formed as in the first embodiment between the upper and lower bodies 100 and 102. The upper cutting line 132 extends down to meet the vertical cutting lines 133 formed in a slot 181 made by the pull-tab 106 along the inside of the supports 110. The pull-tab 106 is formed having a bend 182, a catch groove 184 provided longitudinally in the pull-tab 106, and a catch protrusion 183 on which the catch groove 184 is detachably fixed. Tab cutting lines 108 are provided on both sides of the pull-tab 106 to allow the same to be detached from the supports 110.

The user removes the bottle cap 10 from the bottle 118 by pulling on the pull-tab 106 in first an outward direction to remove the catch groove 184 from the catch protrusion 183, a downward direction to cut the tab cutting lines 108, then in an upward direction to cut the vertical cutting lines 133 such that the bottle cap 10 is in a state as shown in FIG. 18B. Next if the user continues to pull upward on the pull-tab 106, the upper cutting line 132 is cut and, at the same time, the upper body 100 is removed from the bottle 118.

Figure 19A:
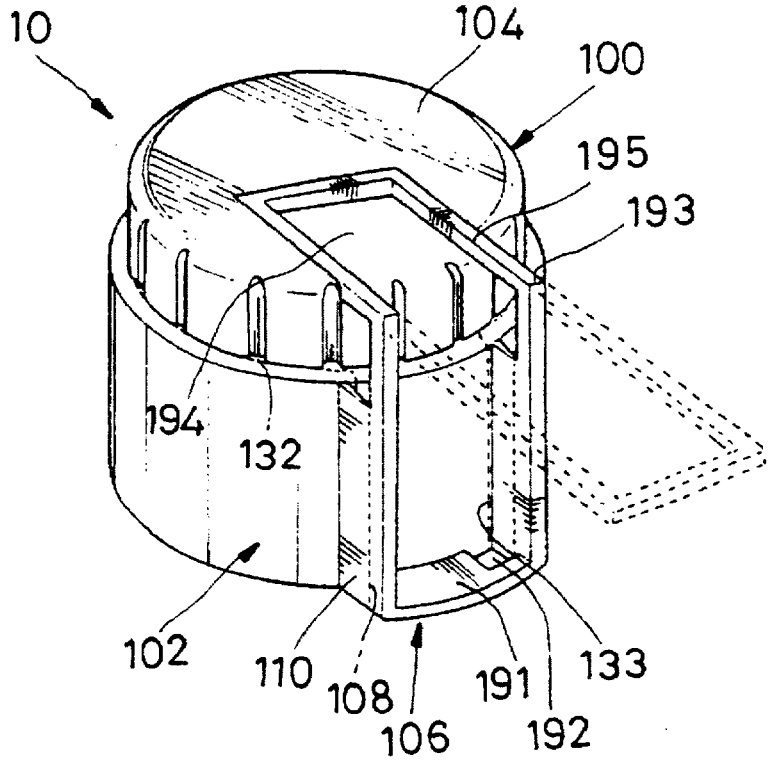
FIGS. 19A and 19B are perspective views of a modified example of the first embodiment of the present invention as shown in FIG. 1A.
Figure 19B:
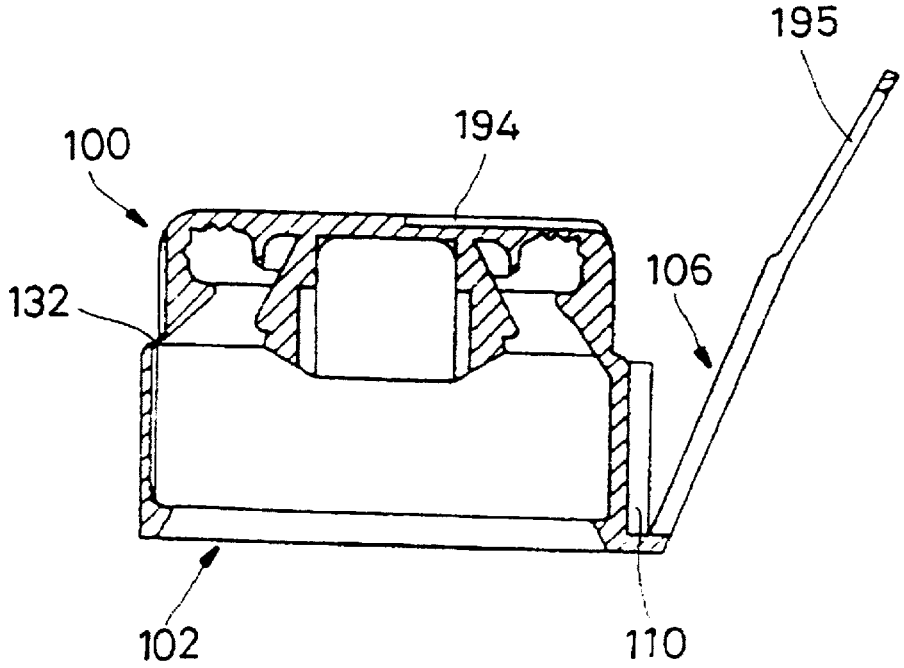

Referring to FIGS. 19A and 19B, there is shown still yet another modified example of the first embodiment. As is illustrated, the pull-tab 106 is formed having a connecting portion 191 connected to the lower body 102. The tab cutting lines 108 are formed where the pull-tab 106 meets the supports 110. The connecting portion 191 is formed covering only part of the width of the pull-tab 106 such that holes 192 are formed on both sides of the connecting portion 191 between the supports 110. The pull-tab 106 extends upward past the supports 110 where it forms a bend 193. From the bend 193, the pull-tab 106 extends over the top surface 104 of the upper body 102 to form a bent portion 195. The bent portion 195 is located in an indent portion 194 provided on the top surface 104 to hold the bent portion 195. To remove the bottle cap 10, the user first pulls on the bent portion 195 of the pull-tab 106 until it is in a state shown by the dotted line in FIG. 19A. Next, the pull-tab 106 is pulled downward which separates the same from the supports 110 by the cutting of the tab cutting lines 108 such that the pull-tab 106 is in a state as shown in FIG. 19B. The user then pulls upward on the pull-tab 106 which severs the vertical cutting lines 133, after which the upper body 100 can be removed from the bottle (not shown) by the, continuing pulling motion of the user in an upward direction.

Figure 20:
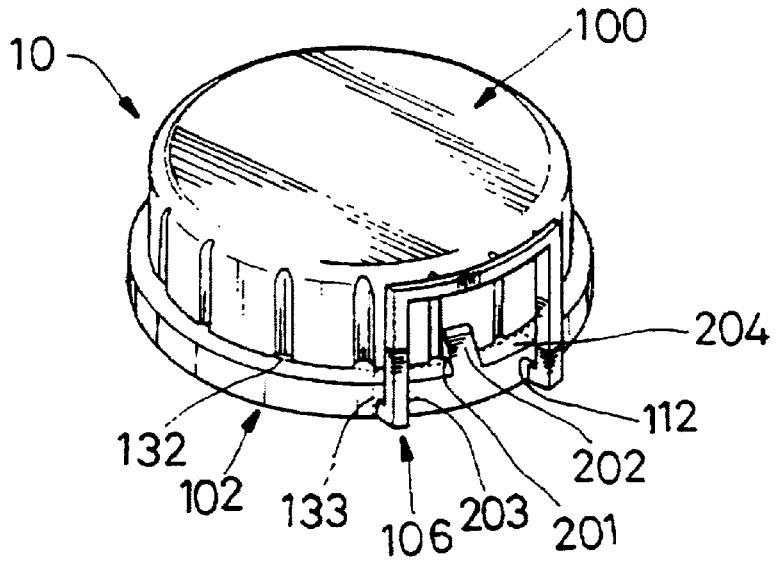
FIG. 20 is a perspective view of a modified example of the first embodiment of the present invention as shown in FIG. 1A.

Referring now to FIG. 20, there is shown another modified example of the first embodiment. Here, a reinforced connecting portion 202 is provided which is integrally connected to the upper body 100 and a non-cutting portion 201. The pull-tab 106 in this modified example forms a finger hole 203 and is connected to the lower body 102 through the connecting portions 112 formed inside the vertical cutting lines 133. Also, extra cutting lines 204 are formed on both sides of the reinforced connecting portion 202, the extra cutting lines 204 extending to be connected to the vertical cutting lines 133 and the upper cutting line 132. In this modified example, it is preferable that the width of the lower body 102 is kept at a minimal level.

The bottle cap 10 is removed from the bottle (not shown) in this modified example by placing a finger in the finger hole 203 and pulling up on the pull-tab 106. This action first cuts the vertical cutting lines 133 then the extra cutting lines 204. With continued pulling force, the upper cutting line 132 is severed while the upper body 100 is removed from the bottle (not shown).

Figure 21:
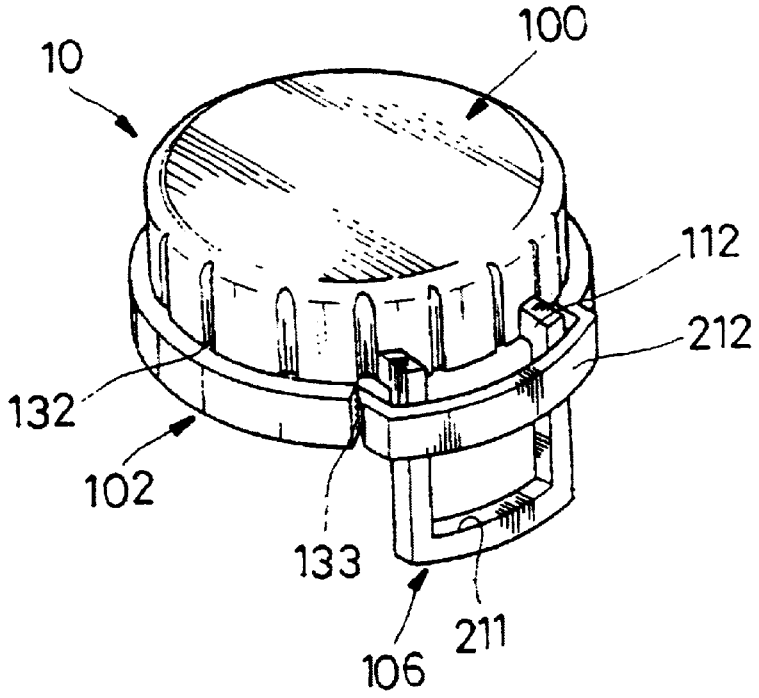
FIG. 21 is a perspective view of a modified example of the first embodiment of the present invention as shown in FIG. 1A.

Another modified example of the first embodiment is shown in FIG. 21. Here, the pull-tab 106 is formed in a downward direction such that a finger hole 211 is defined therein. The pull-tab 106 in this modified example is formed directly on the upper body 100 through the connecting portions 112. The lower body 102 has a protruding portion 212 which juts outward to cover the pull-tab 106. A single vertical cutting line 133 is formed on the lower body 102 to one side of the pull-tab 106.

The user removes the bottle cap 10 in this modified example by first pulling on the pull-tab 106 by placing his or her finger in the finger hole 211 formed therein. By this action, the vertical cutting line 133 is cut to remove the protruding portion 212 from the pull-tab 106, and if the user continues to pull, the upper cutting line 132 is cut while the upper body 100 is dislodged from the bottle (not shown).

Figure 22A:
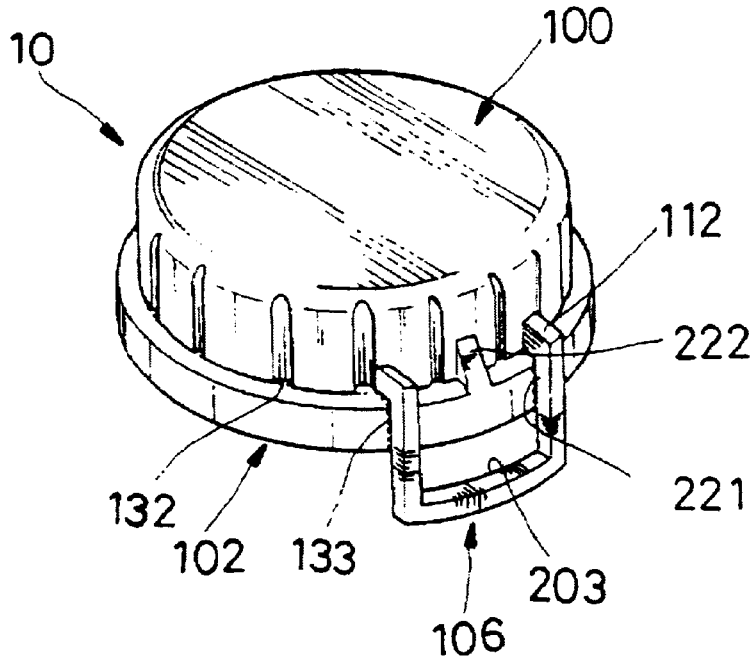
FIGS. 22A and 22B are perspective views of a modified example of the first embodiment of the present invention as shown in FIG. 1A.
Figure 22B:
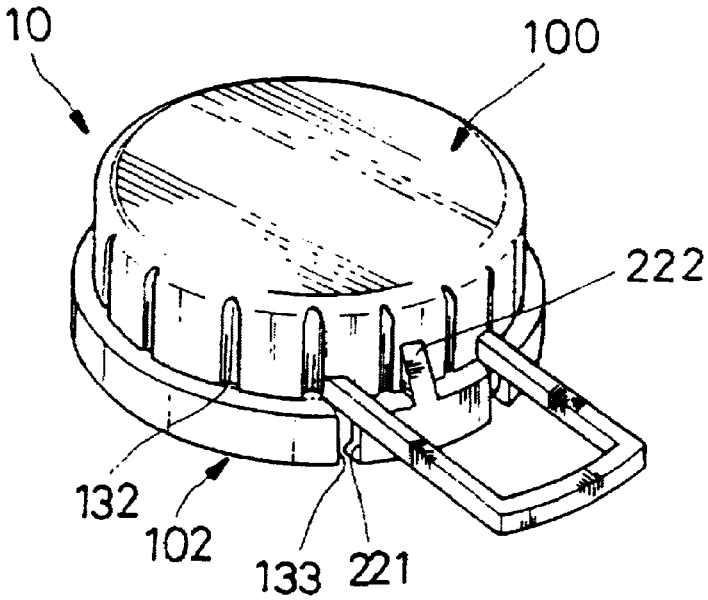

FIGS. 22A and 22B illustrate another modified example of the first embodiment. As shown in the drawings, a reinforced connecting portion 222 is formed between the upper and lower bodies 100 and 102. The connecting portions 112 of the pull-tab 106 are connected directly to the upper body 102. The pull-tab 106 is formed downward as in the above modified example shown in FIG. 21 and has provided a finger hole 203 defined by the U-shape of the pull-tab 106. The vertical cutting lines 133, which connect with the upper cutting line 132, are formed on the outside of the pull-tab 106, and inner cutting lines 221, which stop at the connecting portions 112, are formed on the inside of the pull-tab 106.

The user removes the bottle cap 10 in this modified example by placing his or finger in the finger hole 203 and pulling upward on the pull-tab 106. When this is done, the pull tab 106 comes to a state as shown in FIG. 22B where the vertical cutting lines 133 and the inner cutting lines 221 are cut. Next, the user continues pull upward on the pull-tab 106 which removes the bottle cap 106 while the upper cutting line 132 is cut.

Figure 23:
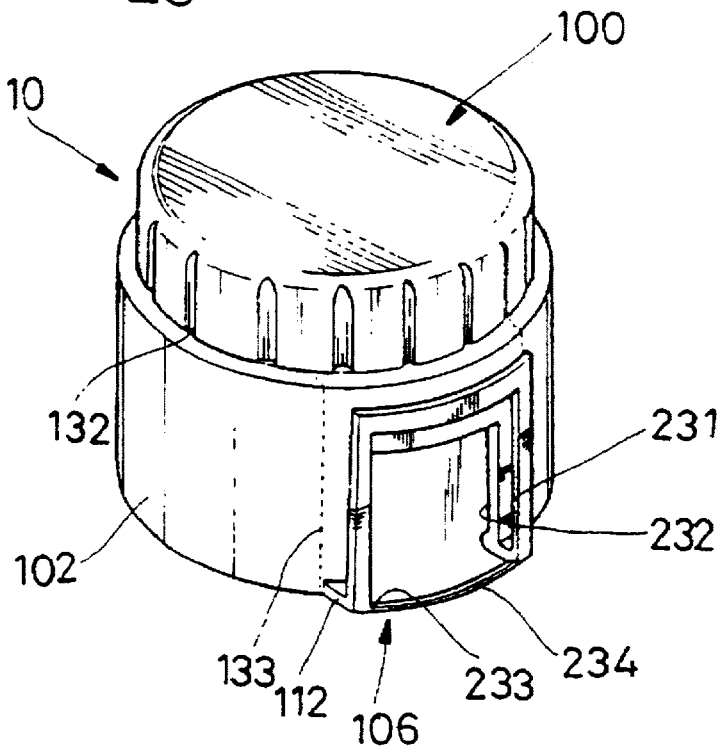
FIG. 23 is a perspective view of a modified example of the first embodiment of the present invention as shown in FIG. 1A.

FIG. 23 illustrates another modified example of the first embodiment. As shown in the drawing, the pull-tab 106 is connected to the lower body 102 through the connecting portions 112. A finger hole 231 is formed by the pull-tab 106, and to increase the space provided by the finger hole 231, a slot 232 is formed in the lower body 102. To prevent the spreading apart of the connecting portions 112, a tie-line 233 is formed therebetween.

To remove the bottle cap 10, the tie-line 233 is first detached by being pulled downward, then the pull-tab 106 is pulled upward by the user such that the vertical cutting lines 133 are cut. This acts to increase the size of the finger hole 231 as the slot 232 forms together with the finger hole 231 as the pull-tab 106 is pulled upward. The user continues to pull on the pull-tab 106 which removes the upper body 100 from the bottle (not shown) as the upper cutting line 132 is being cut.

Figure 24:
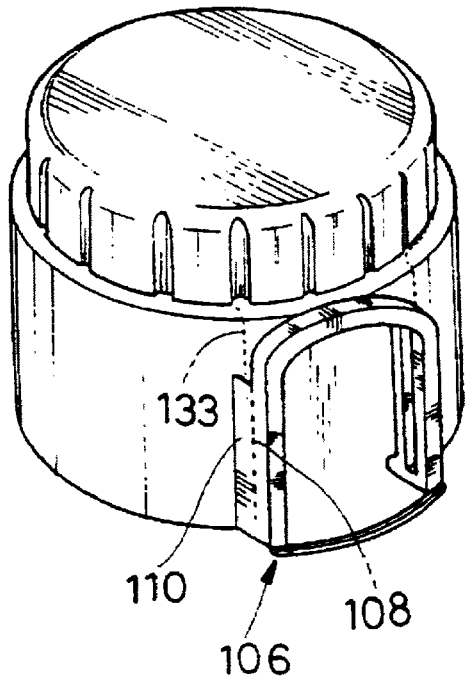
FIG. 24 is a perspective view of a modified example of the first embodiment of the present invention as shown in FIG. 1A.

Referring to FIG. 24, the modified example illustrated here is identical to that shown in FIG. 23 except that supports 110 are formed outside the vertical cutting lines 133, and tab cutting lines 132 are formed between the pull-tab 106 and the supports 110. After the pull-tab 106 is separated from the supports 110 by pulling in a downward direction, the rest of the removal process is the same as in the above modified example.

Figure 25:
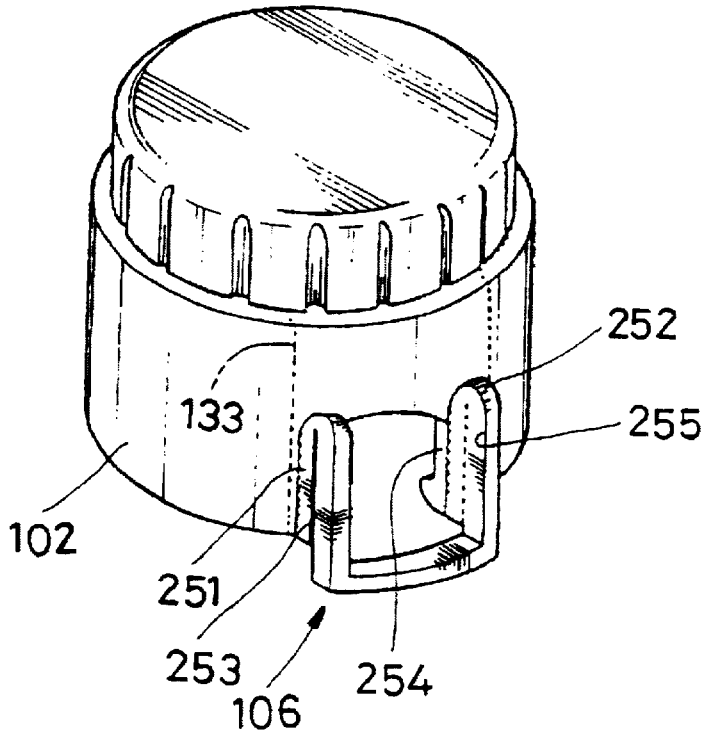
FIG. 25 is a perspective view of a modified example of the first embodiment of the present invention as shown in FIG. 1A.

Another modified example is shown in FIG. 25. As illustrated, the pull-tab 106 is folded over on itself through bends 252 and there are formed cutting lines 253 between upper and lower parts of the pull-tab. Also, cutting lines 251 are formed between the pull-tab 106 and the lower body 102. A finger hole 255 is provided by the pull-tab 106, and to supply additional space needed to firmly grasp the pull-tab 106 as the same is being pulled, a slot 254 is formed in the lower body 102 as shown in the drawing.

Figure 26:
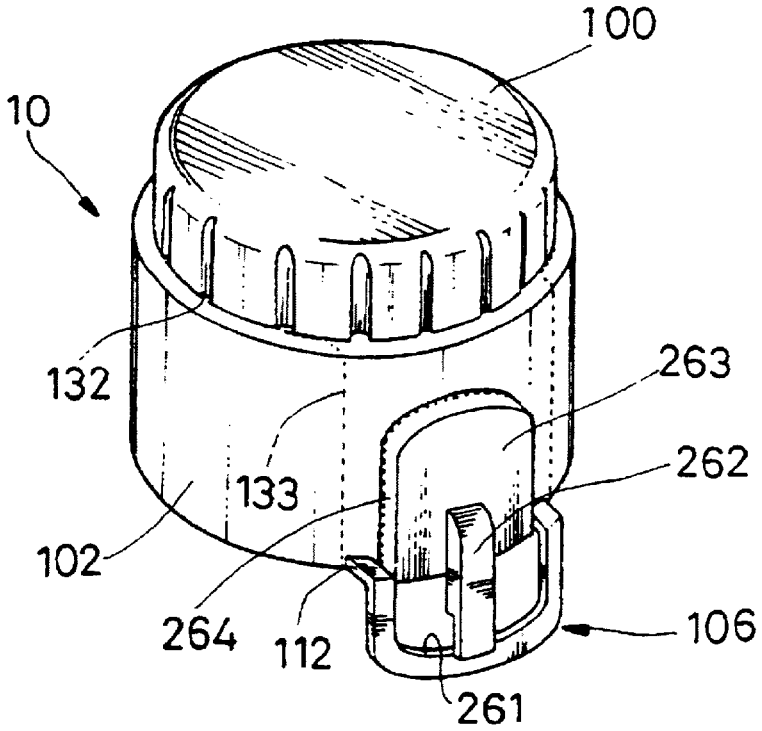
FIG. 26 is a perspective view of a modified example of the first embodiment of the present invention as shown in FIG. 1A.

Referring to FIG. 26, there is shown yet another modified example of the first embodiment. Here, the pull-tab 106 is formed downward connected directly to the lower body 102 through the connecting portions 112. The vertical cutting lines 133 are formed outside the connecting portions 112 of the pull-tab 106, the vertical cutting lines 133 extending along the width of the lower body 102 to meet the upper cutting line 132. A finger hole 261 is formed by the downward structure of the pull-tab 106. A guard portion 263 having a catch protrusion 262, which maintains the pull-tab 106 in a downward direction, is formed elevated slightly on the lower body 102 between the connecting portions 112 of the pull-tab 106. A guard cutting line 264 is formed around the circumference of the guard portion 263.

With regard to the assembly process in the above modified example, through a series of mechanical devices, the catch protrusion 262 is placed on the bottle cap 10 securing the pull-tab 106 after the same is pushed in a downward direction.

When removing the bottle cap 10 in this modified example, the catch protrusion 262 is first grabbed and pulled in an outward direction. This action cuts the guard cutting line 264 such that the guard portion 263 and the catch protrusion 262 are removed from the lower body 102. From this state, the user pulls the pull-tab 106 in an upward direction cutting the vertical cutting lines 133. As a result, the finger hole 261 is increasingly enlarged by a hole created by the removal of the guard portion 263. The user continues to pull on the pull-tab 106, removing the upper body 100 from the bottle (not shown) while the upper cutting line 132 is being cut.

Figure 27:
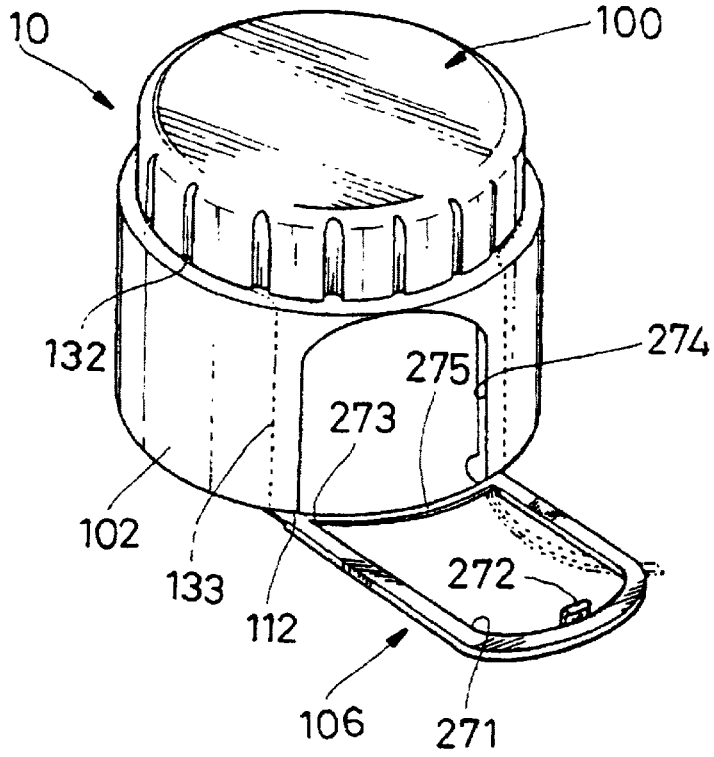
FIG. 27 is a perspective view of a modified example of the first embodiment of the present invention as shown in FIG. 1A.

Another modified example is shown in FIG. 27. Here, the pull-tab 106 is connected to the lower body 102 through the connecting portions 112. A finger hole 271 is formed by the pull-tab 106 and a hook 272 is provided on a top end of the pull-tab 106. A tie line 275 is formed between the connecting portions 112. The tie line 275 can be detached on one side through a tie cutting line 273. A slot 274 is formed in the lower body 102 between the vertical cutting lines 133 at a predetermined height. The hook 272 of the pull-tab 106 is able to be inserted in a top of the slot 274 such that the pull-tab 106 is secured against the bottle cap 10.

The bottle cap 10 is removed from the bottle (not shown) by first un-latching the hook 272 from the slot 274 by pulling on the pull-tab 106 in an outward direction. This acts to position the pull-tab 106 as shown in the drawing. Next, the pull-tab 106 is slightly pulled to cut the vertical cutting lines 133 partway after which the tie line 275 is pulled to cut the tie cutting line 273. This results in the finger hole 271 being enlarged as much as the pull-tab 106 is pulled upward by the joint space made by the finger hole 271 and the slot 274. The user continues to pull upward on the pull-tab 106 which cuts the vertical cutting lines 133. The upper cutting line 132 is then cut as the upper body 100 is being removed.

Figure 28:
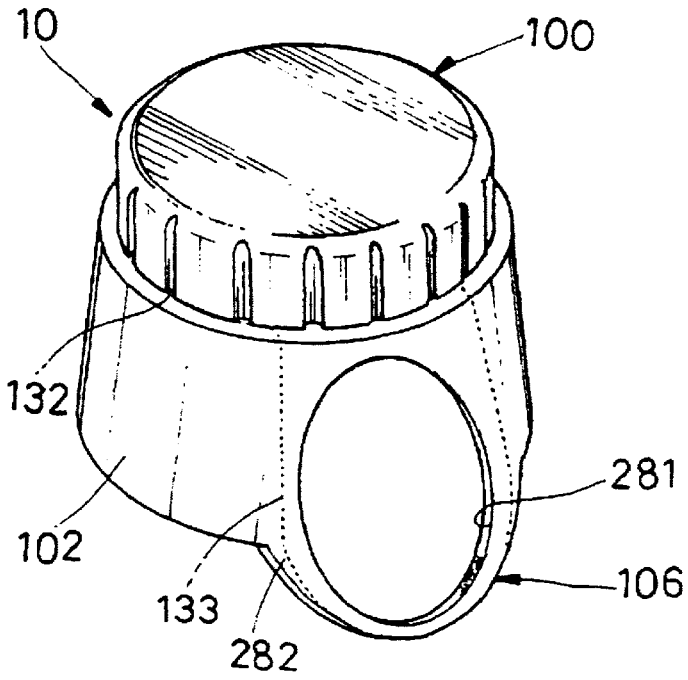
FIG. 28 is a perspective view of a modified example of the first embodiment of the present invention as shown in FIG. 1A.

Referring to FIG. 28, there is shown another modified example of the first embodiment of the present invention. As shown in the drawing, the pull-tab 106 having a finger hole 281 is formed directly in the area between the vertical cutting lines 133. The pull-tab 106 extends downward past the lower body 102 and includes supports 282 provided between the vertical cutting lines 133 and the lower body 102.

The bottle cap 10 of this modified example is removed from the bottle (not shown) by the user pulling on the lower part of the pull-tab 106. This initially cuts the bottom of the vertical cutting lines 133 disconnecting the pull-tab 106 from the supports 282. From this state, the user inserts his or her finger in the finger hole 281 and continues the upward pulling motion. As a result, the vertical lines 133 are cut and the upper body 100 is removed while the upper cutting line 132 is cut.

Figure 29:
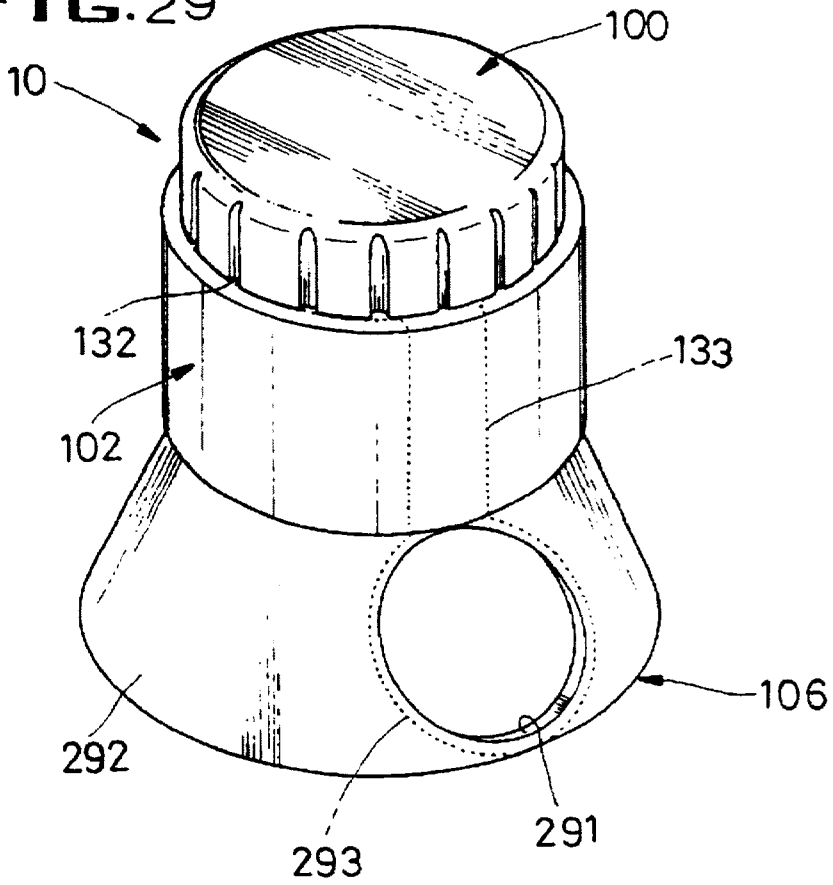
FIG. 29 is a perspective view of a modified example of the first embodiment of the present invention as shown in FIG. 1A.

FIG. 29 illustrates another modified example of the first embodiment. As shown in the drawing, a skirt portion 292 is formed extending downward from the lower body 102. The pull-tab 106 is formed in the skirt portion 292 having a finger hole 291. Hole cutting lines 293 are formed around the finger hole 291 and meet the vertical cutting lines 133 at a top of the skirt portion 292.

The user removes the bottle cap 10 from the bottle (not shown) by placing a finger in the finger hole 291 of the pull-tab 106 and pulling upward. This acts to first cut the hole cutting lines 293 then the vertical cutting lines 133 of the lower body 102. With continued upward force exerted by the user, the upper cutting line 132 is cut while the upper body 100 is removed from the bottle (not shown).

Figure 30:
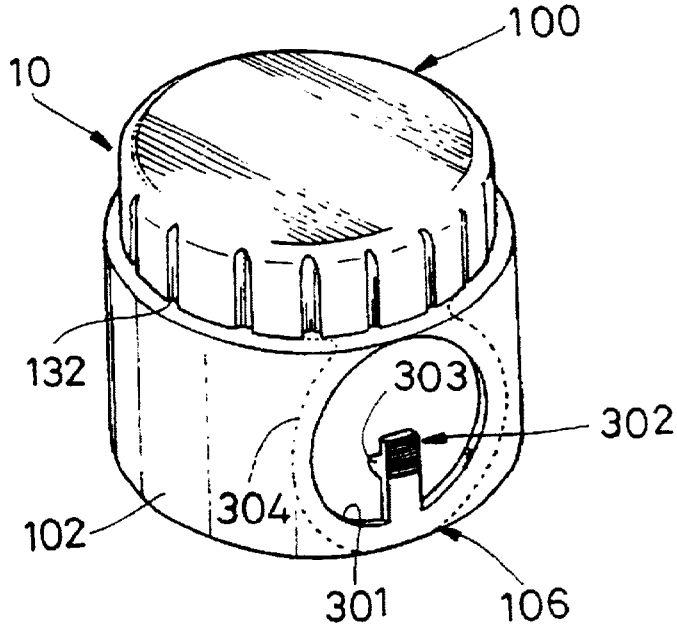
FIG. 30 is a perspective view of a modified example of the first embodiment of the present invention as shown in FIG. 1A.

Referring to FIG. 30, there is shown another modified example of the first embodiment. Here, the pull-tab 106 is formed including a finger hole 301 formed in the lower body 102. A hole cutting line 304 is provided around the finger hole 301 which extends upward and connects to the upper cutting line 132. A tab grip 302 is formed on a bottom portion inside the finger hole 301 and projects upward toward a center of the finger hole 301. There is provided a protrusion 303 extending inward on an upper portion of the tab grip 302.

The user removes the bottle cap 10 in this modified example by first pulling the tab grip 302 in an outward direction, the action of which cuts part of the hole cutting line 304. In this state, the user pulls the tab grip 302 in an upward direction to cut the rest of the hole cutting line 304 and when continued upward force is given to the tab grip 302, the upper cutting line 132 is cut as the upper body 100 is removed from the bottle (not shown).

Figure 31A:
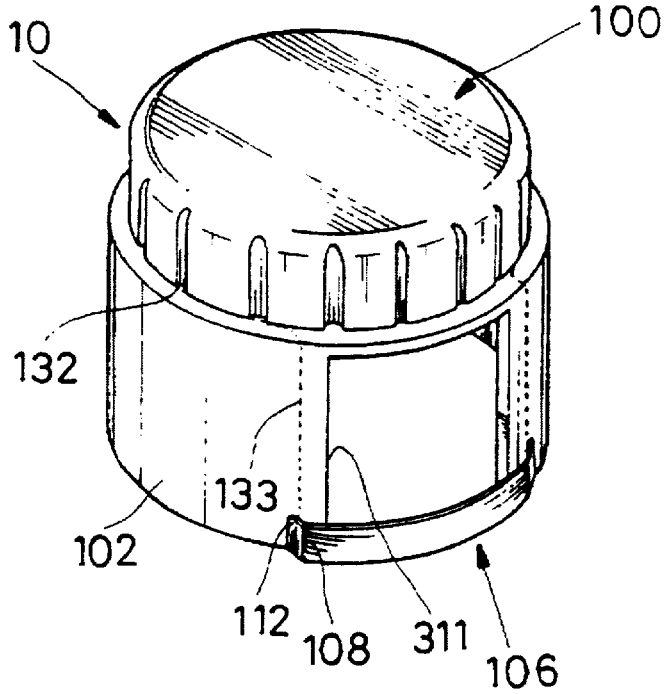
FIGS. 31A and 31B are perspective views of a modified example of the first embodiment of the present invention as shown in FIG. 1A.
Figure 31B:
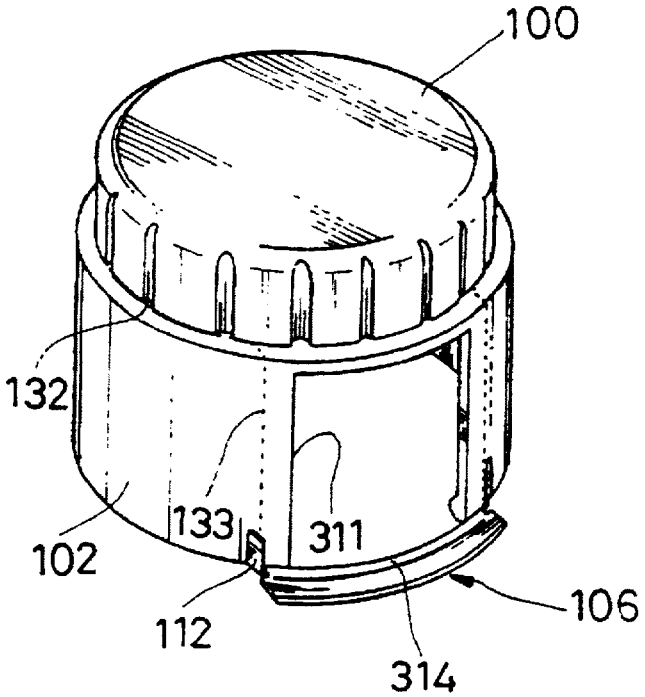

Another modified example of the first embodiment is illustrated in FIGS. 31A and 31B. As shown in the drawings, a slot 311 is formed in the lower body 102 between the vertical cutting lines 133 at a predetermined height and length. The pull-tab 106 in this modified example is formed having a connector 314 fixed to the lower body 106 inside the vertical cutting lines 133. The remaining part of the pull-tab 106 is formed folded over the connector 314 and, through the tab cutting lines 108, is connected to the supports 112 connected to the lower body 102 outside the vertical cutting lines 133.

The user removes the bottle cap 10 in this modified example by first pulling downward on the pull-tab 106. This severs the tab cutting lines 108 resulting in the pull-tab 106 being positioned as shown in FIG. 31B. In this state, the connector 314 remains fixed to lower body 102. As a result, the user cuts the vertical cutting lines 133 by pulling up on the pull-tab 106, and with continued pulling, the upper body 100 can be removed from the bottle (not shown) with the cutting of the upper cutting line 132.

Figure 32A:
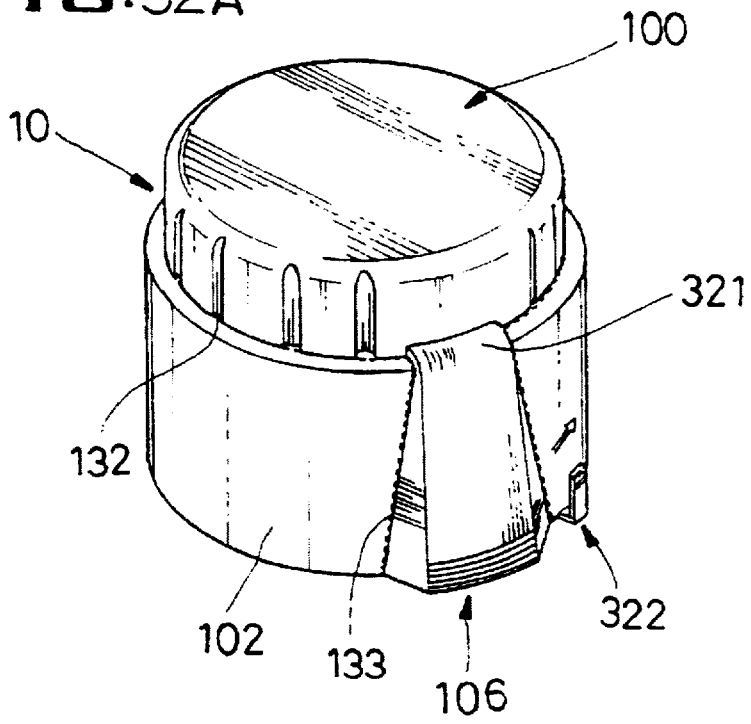
FIGS. 32A and 32B are perspective views of a modified example of the first embodiment of the present invention as shown in FIG. 1A.
Figure 32B:
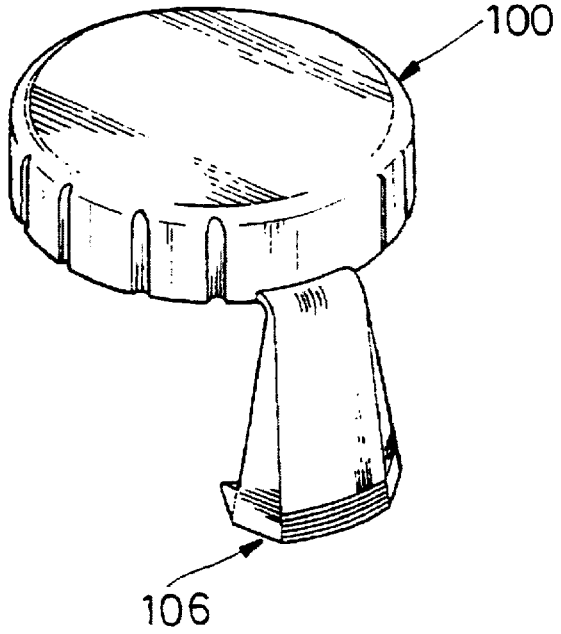

Another modified example is illustrated in FIGS. 32A and 32B. Here, the pull-tab 106 is wedge-shaped and formed protruding from the lower body 102. The left and right sides of the pull-tab 106 are bordered by the vertical cutting lines 133, and there is formed a connecting portion 321 attached to the upper body 100. Also, a lower body tab 322 is formed to one side of the pull-tab 106 outside the vertical cutting line 133.

To remove the bottle cap 10, the user first pulls the lower body tab 322 in a direction away from the pull-tab 106 and around the upper body 100 such that vertical cutting lines 133 and the upper cutting line 132 are cut. This results in the lower body 102 being removed from the bottle cap 10 as shown in FIG. 32B. Next, the user pulls upward on the pull-tab 106 which removes the upper body 100 from the bottle (not shown).

Figure 33A:
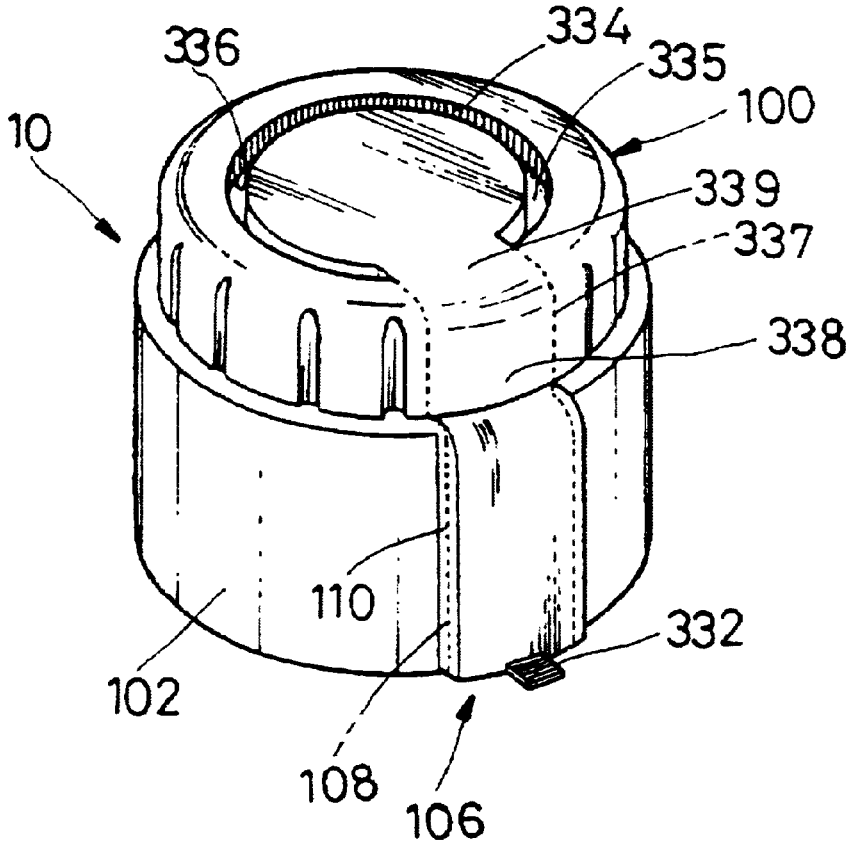
FIGS. 33A and 33B are perspective views of a modified example of the first embodiment of the present invention as shown in FIG. 1A.
Figure 33B:
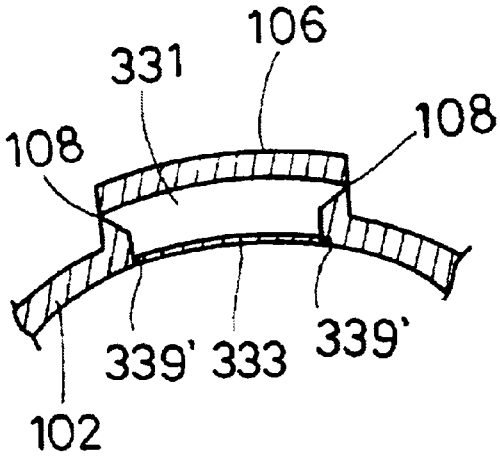

Referring to FIGS. 33A and 33B, there is shown another modified example of the first embodiment. As shown in the drawings, the pull-tab 106 is formed elevated on the lower body 102 connected to supports 110 through tab cutting lines 108. A grip 332 is formed protruding outward on a lower portion of the pull-tab 106. The tab cutting lines 108 extend upward on the lower body 106 on both sides of the pull-tab 106 to meet cap cutting lines 337, inside of which is formed a thin cut-away segment 338. The cut-away segment 338 extends to the top of the upper body 100 to connect to a non-cutting portion 339. Around the circumference of the non-cutting portion 339 is formed a cavity 335, and a cavity cutting line 336 is formed on an outer circumference of the cavity 335. Grooves 334 are vertically formed on the inside of the upper body 100 directly above the cavity cutting line 336. Further, a connecting membrane 333 is formed between the supports 110 inside the pull-tab 106 as shown in FIG.

33B, and there are formed membrane cutting lines 339' on both sides of the connecting membrane 333.

The user removes the bottle cap 10 in this modified example by pulling upward on the pull-tab 106 by grasping and pulling on the grip 332. This action first cuts the tab cutting lines 108 then the cap cutting lines 337 of the upper body 100 such that the pull-tab 106 and the cut-away segment 338 are separated from the lower body 102 and the upper body 100, respectively. Next, if the user continues to pull on the pull-tab 106, the cavity cutting line 336 is cut which allows for the removal of the non-cutting portion 339. In this state, the user removes the connecting membrane 333 by pulling on the same in a direction away from the bottle (not shown) which cuts the membrane cutting lines 339'. The lower body 102 and the upper body 100 is then removed from the bottle (not shown).

Figure 34A:
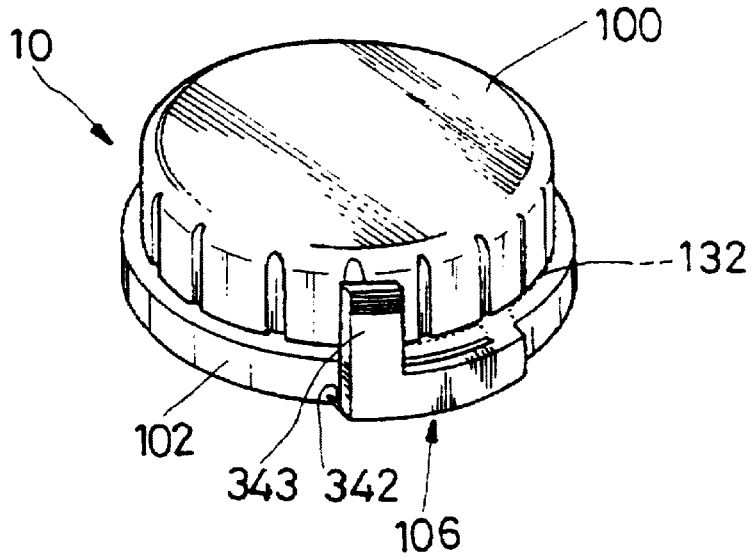
FIGS. 34A and 34B are perspective views of a modified example of the first embodiment of the present invention as shown in FIG. 1A.
Figure 34B:
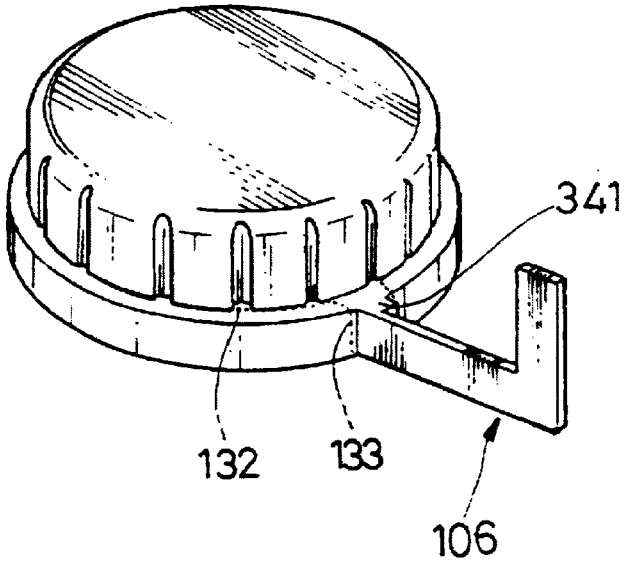

Referring to FIGS. 34A and 34B, there is shown another modified example of the first embodiment. As shown in the drawings, the pull-tab 106 is formed integrally formed to the lower body 102 through a connecting portion 341 from where the pull-tab 106 runs parallel along the lower body 102 and extends upward to form a grip 343. A tie line 342 connects the pull-tab 106 to the lower body 102, the tie line 342 provided at an end of the pull-tab 106 opposite where the connecting portion 341 is formed.

The bottle cap 10 is removed by the user first pulling the pull-tab 106 in an outward direction which cuts the tie line 342. The user then pulls upward on the pull-tab 106 which cuts the vertical cutting lines 133 and removes the upper body 100 from the bottle (not shown) as the upper cutting line 132 is being cut.

Figure 35A:
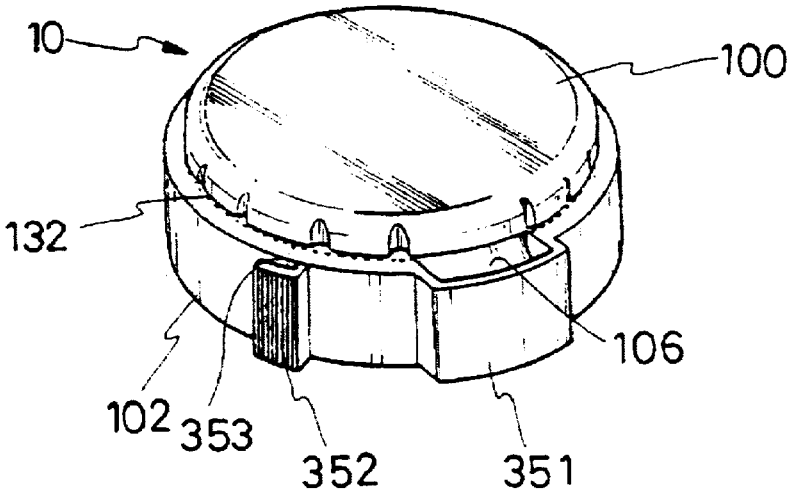
FIGS. 35A and 35B are perspective views of a modified example of the first embodiment of the present invention as shown in FIG. 1A.
Figure 35B:
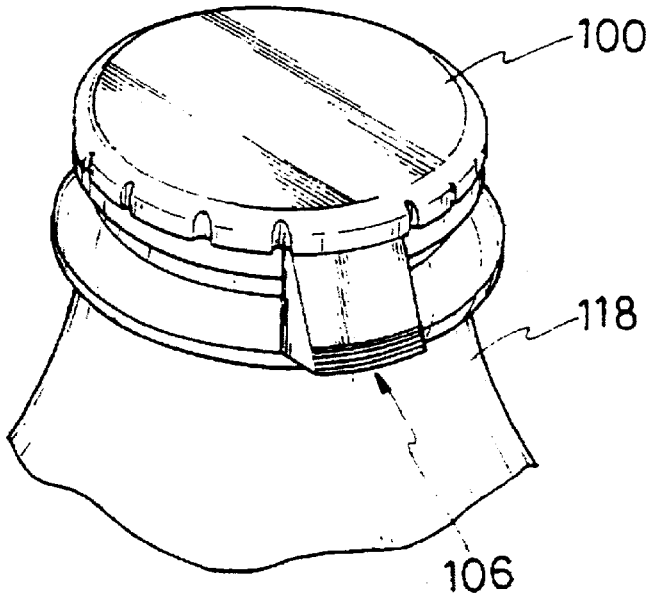

Another modified example is illustrated in FIGS. 35A and 35B. Here, the lower body is formed having a lower body grip 352 protruding from the lower body 102, and a tab cover 351 which extends outward to surround the pull-tab 106. A grip cutting line 353 is formed along the width of the lower body 102 next to where the lower body grip 352 is fixed to the lower body 102. The grip cutting line 353 connects with the upper body cutting line 132.

To remove the bottle cap 10, the user pulls the lower body grip 352 in a direction toward the pull-tab 106. By continuing the pulling action around the circumference of the upper body 100, the lower body 102 is removed from the upper body 100 such that the bottle cap 10 is in a state as shown in FIG. 35B. The user then pulls upward on the pull-tab 106 which removes the upper body 100 from the bottle 118.

Figure 36:
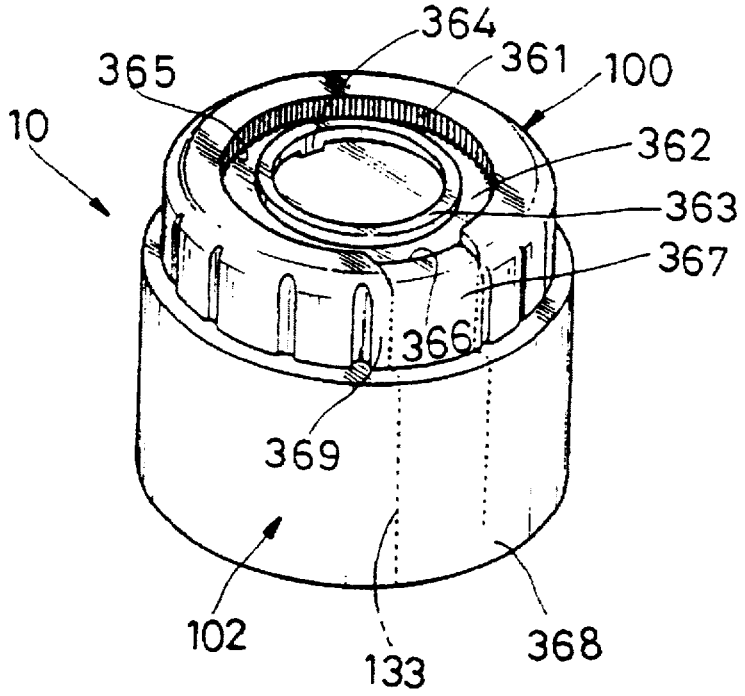
FIG. 36 is a perspective view of a modified example of the first embodiment of the present invention as shown in FIG. 1A.

There is shown another modified example of the first embodiment in FIG. 36. As illustrated, there is formed a pull-tab 363 in the center of the upper body 100. A cavity 363 is formed around the circumference of the pull-tab 363, and a cavity cutting line 365 is provided around the circumference of a bottom of the cavity 363. The pull-tab 363 is connected to a bottom surface of the cavity 363 by a ring connector 364. Grooves 361 are vertically formed around an inside wall of the upper body 100. The vertical cutting lines 133 in this modified example are formed along the length of the lower body 102 except for a small area to form a non-cutting segment 368. The vertical cutting lines 133 are connected to upper body cutting lines 369, which extend over along the inside wall of the upper body 100 to connect to the cavity cutting line 365, and a cut-away segment 367 is formed between the upper body cutting lines 369. Further, a non-cutting portion 366 is formed along the wall of the upper body 100 between the cutaway segment 367 and the bottom of the cavity 362.

The user removes the bottle cap 10 in this modified example by first pulling upward on the pull-tab 363. As a result, the cavity cutting line 365 is cut around the circumference of the cavity 362 until they meet the upper body cutting lines 369. With continued upward force applied by the user, the upper body cutting lines 369 are cut and then the vertical cutting lines 133 are cut, leaving only the non-cutting segment 368. In this state with all the cutting lines cut, the user can easily remove the upper and lower bodies 100 and 102 from the bottle (not shown), and when wanting to re-seal the bottle (not shown) the user first cuts through the non-cutting segment 368 and re-seals the bottle (not shown).

Figure 37:
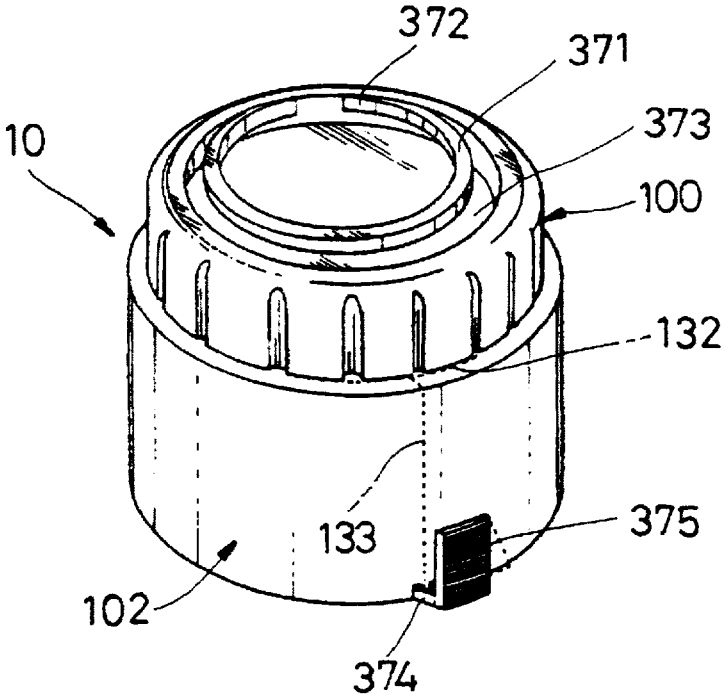
FIG. 37 is a perspective view of a modified example of the first embodiment of the present invention as is shown in FIG. 1A.

Another modified example of the first embodiment is illustrated in FIG. 37. Here, a pull-tab 371 is formed in a center of the upper body 100 and connected therein at connecting portions 372. A cavity 373 is formed between the pull-tab 371 and the upper body 100. A grip 375 is connected to the lower body 102 at a bottom portion thereof next to the vertical cutting line 133. The grip 375 has a support connection 133 which is separated slightly from the grip 375 and connected to the lower body 102 on a side of the vertical cutting line 133 opposite that to which the grip 375 is formed.

The user removes the bottle cap 10 from the bottle (not shown) by pulling upward on the grip 375 which first cuts the connection made by the support connection 374 then cuts the vertical cutting line 133. The grip 375 is further pulled upward and around the upper body 100 by the user to cut the upper cutting line 132. As a result, the entire lower body 102 is removed from the upper body 100 and the bottle (not shown). Next, the user pulls upward on the pull-tab 371 to remove the upper body 100 from the bottle (not shown).

Figure 38A:
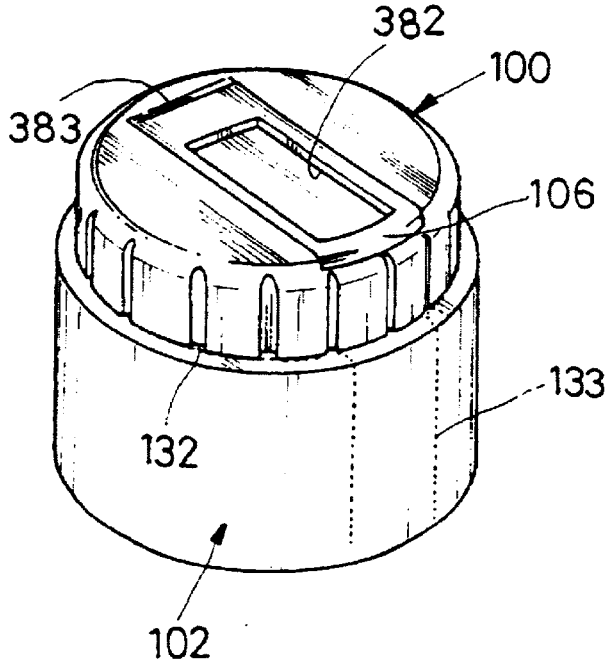
FIGS. 38A and 38B are perspective views of a modified example of the first embodiment of the present invention as shown in FIG. 1A.
Figure 38B:
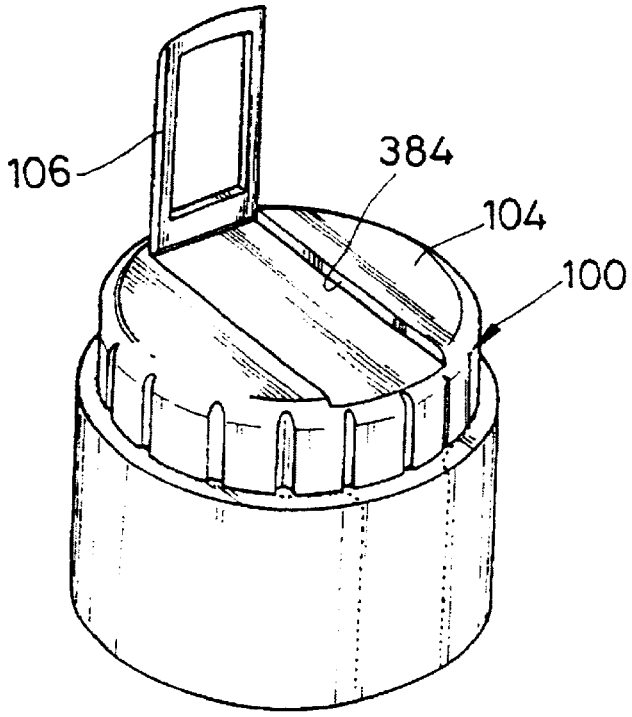

Another modified example of the first embodiment is shown in FIGS. 38A and 38B. As shown in the drawings, an indent portion 384 is formed on the top surface 104 of the upper body 100 (FIG. 38B), inside of which the pull-tab 106 is placed. The pull-tab 106 forms a finger hole 382 and is connected to the upper body 100 by a pivoting connecting portion 383. The connecting portion 383 allows the pull-tab 106 to be pivoted upward (as shown in FIG. 38B) and placed in the indent portion 384.

In this modified example, the upper body 100 is removed from the bottle (not shown) by the user first flipping the pull-tab 106 upward such that the same is in a position shown in FIG. 383. Next, the user inserts a finger in the finger hole 382 of the pull-tab 106 and pulls upward which cuts the upper cutting line 132 then cuts the vertical cutting lines 133.

Figure 39A:
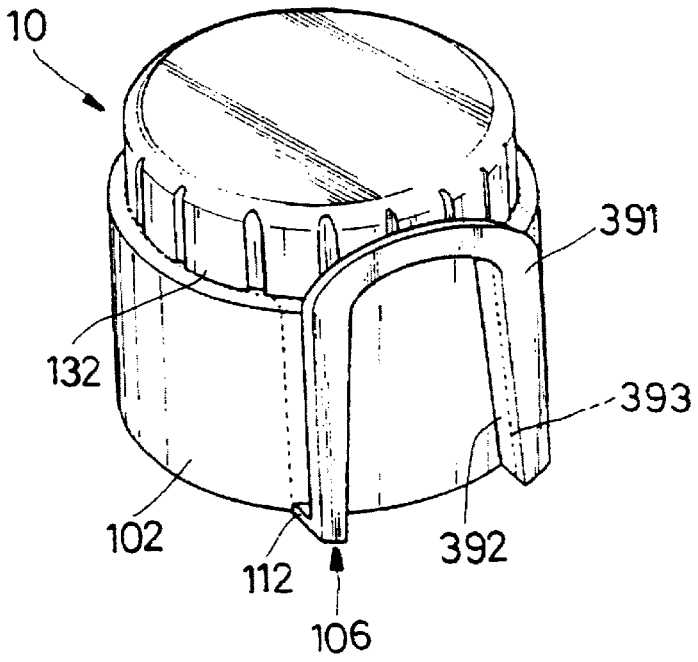
FIGS. 39A and 39B are perspective views of a modified example of the first embodiment of the present invention as shown in FIG. 1A.
Figure 39B:
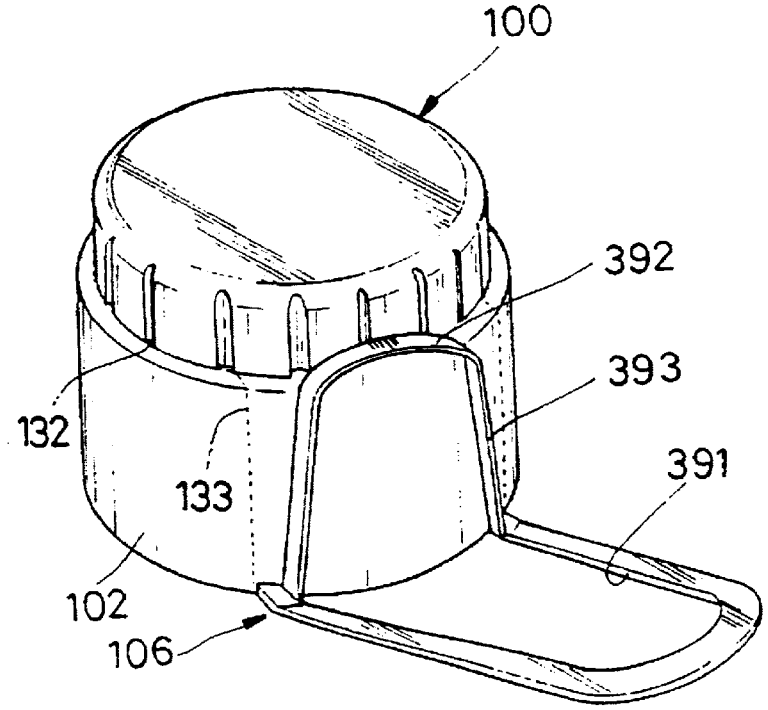

The final modified example of the first embodiment is shown in FIGS. 39A and 39B. As shown in the drawings, the pull-tab 106 is formed in an upside-down U-shape connected to the lower body 102 by the connecting portions 112 and to a protruding portion 392 through a tab cutting line 393. The vertical cutting lines 133 are positioned on the outside of the connecting portions 112 and extend upward at this width to connect with the upper cutting line 132.

The bottle cap 10 in this modified example is removed from the bottle (not shown) by the user first pulling the pull-tab 106 in a downward direction which cuts the tab cutting line 393 such that the pull-tab 106 is in a state shown in FIG. 39B. From this state, the user pulls upward on the pull-tab 106 to cut the vertical cutting lines 133. The user continues the upward pulling action to cut the upper cutting line 132 as the upper body 100 is removed.

Figure 40:
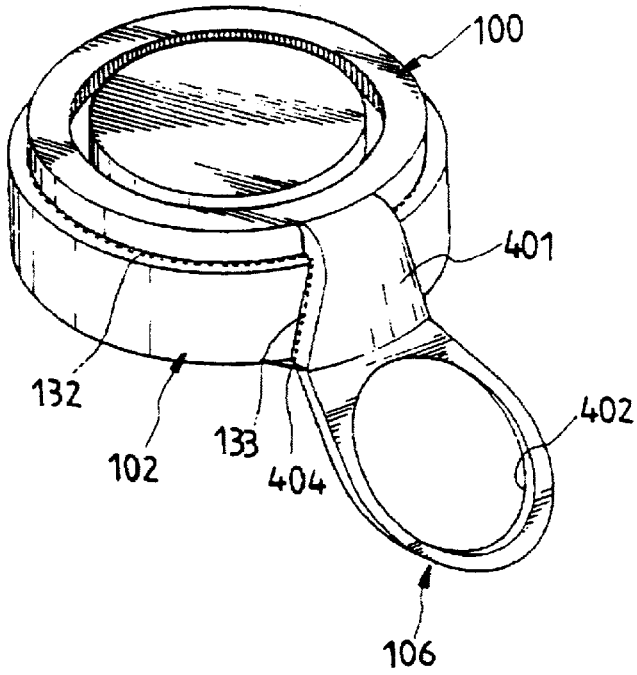
FIG. 40 is a perspective view of a bottle cap according to a second embodiment of the present invention.

Referring to FIG. 40, there is shown a second embodiment of the present invention. As shown in the drawing, the pull-tab 106 is ring-shaped and formed extending downward from the lower body 102. Integrally connected to the top of the pull-tab 106 is an cut-away portion 401, formed elevated from the lower body 102 and extending across the length of the same to connect with the upper body 100. The cut-away portion 401 is shaped having a width that decreases toward a top. The vertical cutting lines 133 are formed on both sides of the cutaway portion 401 and are connected to the upper cutting line 132. Further, tie-lines 404 are provided which connect a bottom of the cut-away portion 401 with the lower body 102 outside the vertical cutting lines 133.

Figure 41:
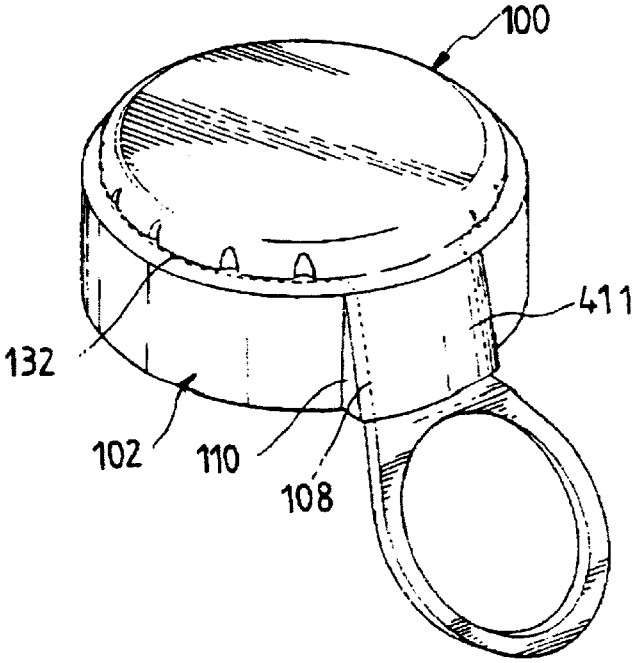
FIG. 41 is a perspective view of a modified example of the second embodiment of the present as shown in FIG. 40.

A modified example of the second embodiment is shown in FIG. 41. As shown in the drawing, this modified example is similar to the second embodiment except that supports 110 are formed on the lower body 102 to which the pull-tab 106 is connected. Tab cutting lines 108 which connect to the upper cutting line 132 are formed between the pull-tab 106 and the supports 110 and a non-cutting portion 411, integrally formed to the upper body 130, is provided between the tab cutting lines 108.

Figure 42:
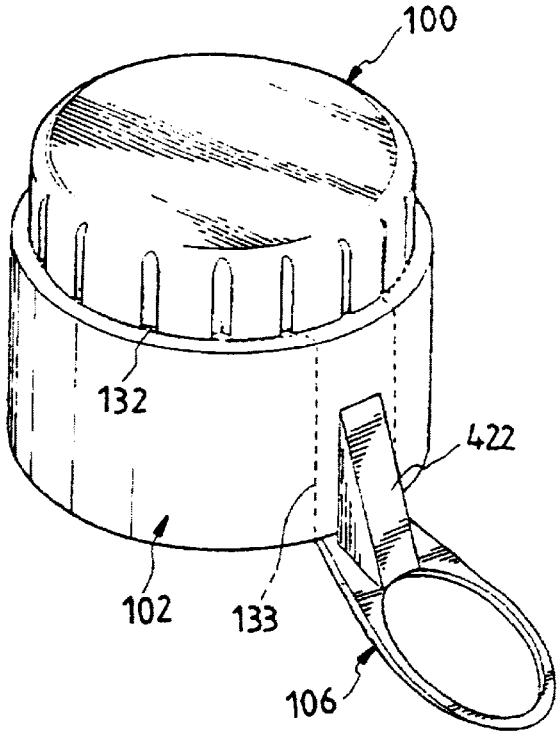
FIG. 42 is a perspective view of a modified example of the second embodiment of the present as shown in FIG. 40.

Another modified example of the second embodiment is shown in FIG. 42. Here, the pull-tab 106 is formed directly on a lower end of the lower body 102 between the vertical cutting lines. A reinforcing member 422 is integrally formed between the pull-tab 106 and the bottom of the lower body 102.

Figure 43:
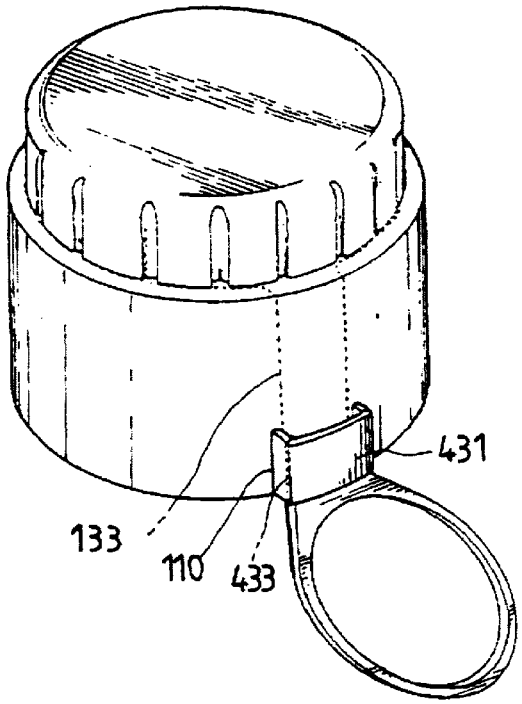
FIG. 43 is a perspective view of a modified example of the second embodiment of the present as shown in FIG. 40.

There is shown yet another modified example of the second embodiment in FIG. 43. As shown in the drawing, this modified example is similar to that shown in FIG. 42. Here, however, the reinforcing member 422 of FIG. 42 is omitted and supports 110 and a holding member 431, including cutting lines 433 formed therebetween, are formed on the bottom part of the lower body 102, the supports 110 being fixed at points outside the vertical cutting lines 133. This addition prevents the vertical cutting lines 133 from being cut during the bottle capping process.

Figure 44:
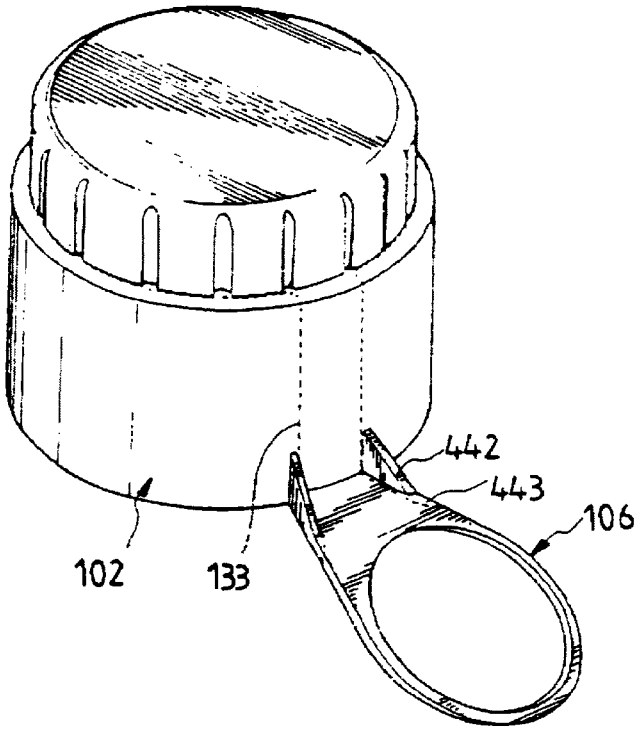
FIG. 44 is a perspective view of a modified example of the second embodiment of the present as shown in FIG. 40.

Referring to FIG. 44, there is shown another modified example of the second embodiment. As shown in the drawing, the pull-tab 106 is formed having reinforcements 442 formed integrally on both sides thereon and to the lower body 102. Tab release lines 443 are formed on the pull-tab 106 inside the reinforcements 442 and which connect to the vertical cutting lines 133.

Figure 45:
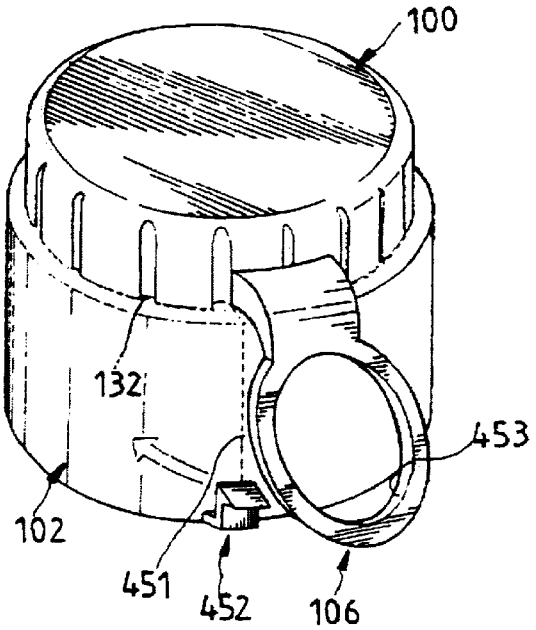
FIG. 45 is a perspective view of a modified example of the second embodiment of the present as shown in FIG. 40.

Another modified example is shown in FIG. 45. Here, the pull-tab 106 is formed integrally on the upper body 100 and extending downward therefrom having a finger hole 453. A lower body cutting line 451 is formed to one side of where the pull-tab 106 is fixed to the upper body 100, the lower body cutting line 451 connecting to the upper cutting line 132 and extending over the entire length of the lower body 102. A pull-grip 452 is formed to a side of the lower body cutting line 451 away from the pull-tab 106.

Figure 46:
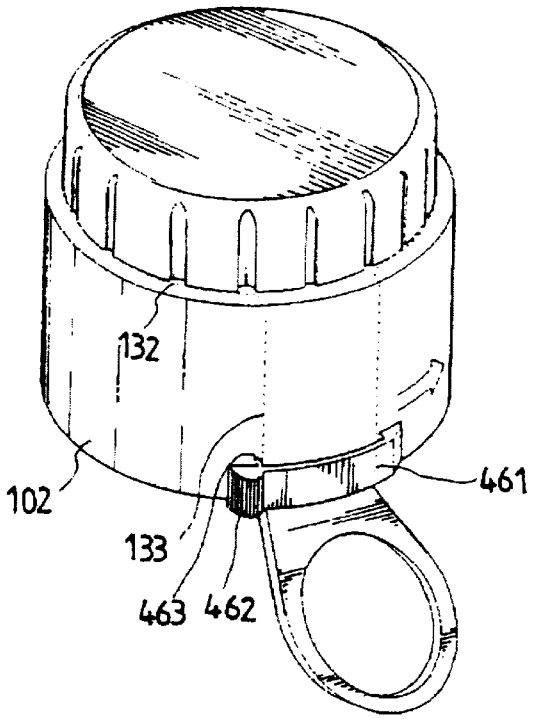
FIG. 46 is a perspective view of a modified example of the second embodiment of the present as shown in FIG. 40.

There is shown another modified example of the second embodiment in FIG. 46. The pull-tab 106 in this modified example is formed similarly to that in the modified example shown in FIG. 43. There is further provided a support band 461 at a bottom portion of the lower body 102. The support band 461 is integrally fixed to the lower body 102 on the outside of one of the vertical cutting lines 133, and connected to the lower body 102 through a detachable connecting portion 463 on the outside of the other vertical cutting line 133. A finger grip 462 is formed on the support band 461 on a side to which the connecting portion 463 is formed.

Figure 47:
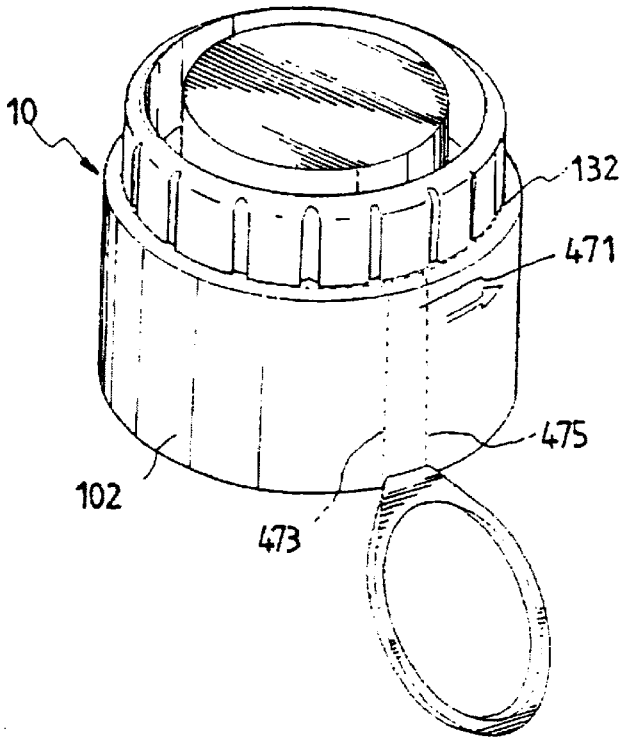
FIG. 47 is a perspective view of a modified example of the second embodiment of the present as shown in FIG. 40.

Referring to FIG. 47, there is shown another modified example of the second embodiment. As shown in the drawing, the pull-tab 106 here is formed similarly to that in FIG. 46. A vertical cutting line 473 is formed extending upward to connect with the upper cutting line 132 on one side pull-tab 106, and a partial cutting line 475 is formed on the other side of the pull-tab 106. The partial cutting line 475 is formed extending partially up the length of the lower body 102, and a non-cutting portion 471 is formed where the partial cutting line 475 ends.

To remove the bottle cap 10 in this modified example, the user pulls the pull-tab 106 in an upward direction, cutting the vertical cutting line 473 to the upper cutting line 132 and the partial cutting line 475 to the non-cutting portion 471. The pull-tab 106 is then pulled around the upper body 100 in a direction away from the vertical cutting line 473 such that the lower body 102 is removed. The user then lifts the upper body 100 off the bottle (not shown) using his or her fingers.

Figure 48A:
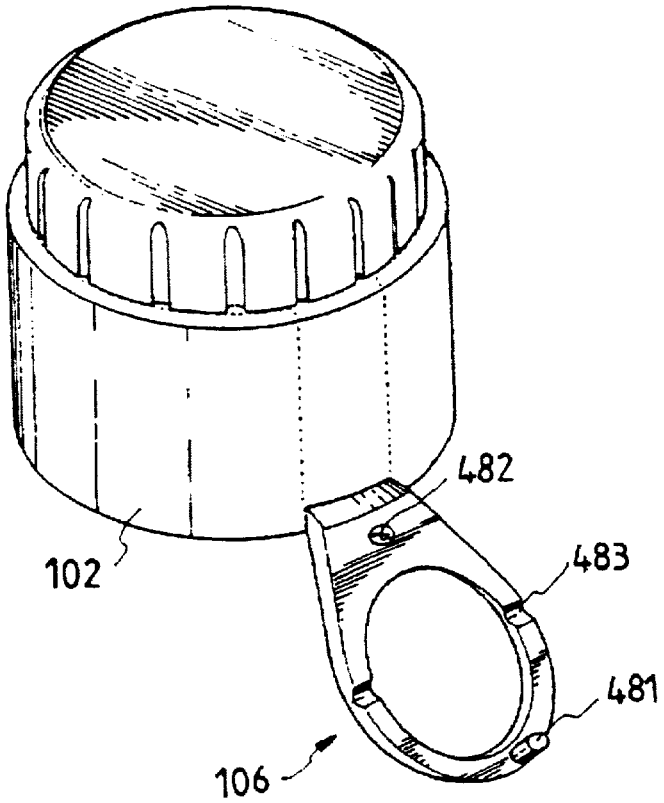
FIGS. 48A and 48B are perspective views of a modified example of the second embodiment of the present invention as shown in FIG. 40.
Figure 48B:
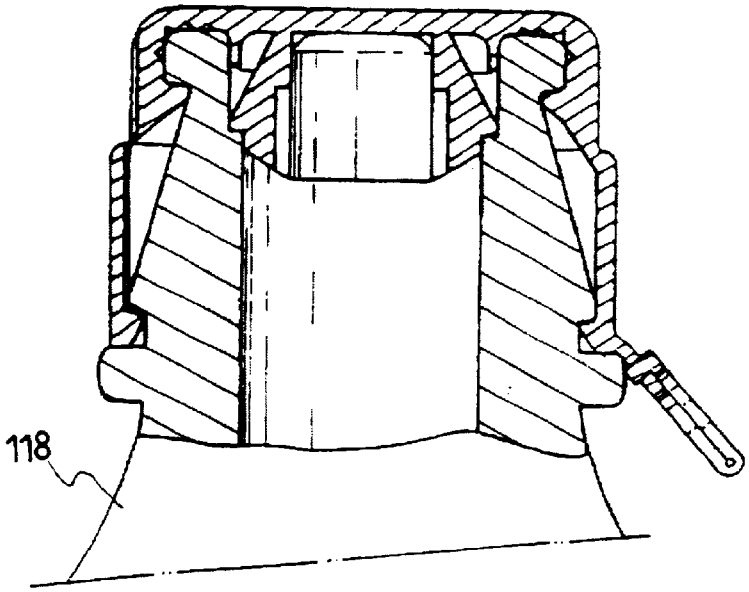

Another modified example of the second embodiment is illustrated in FIGS. 48A and 48B. This modified example is similar to that shown in FIG. 42 minus the reinforcing member. The pull-tab 106 here is structured to allow the same to be folded over and maintained in this state such that the length of the pull-tab 106 is reduced until the user wants to open the bottle 118. This is realized by the forming of a peg 481 on an extreme part of the free end of the pull-tab 106, fold creases 483 on a middle portion of the pull-tab 106, and an insertion hole 482 to which the peg 482 is inserted when the pull-tab 106 is folded. The pull-tab 106 is shown in a folded state in FIG. 483.

Figure 49:
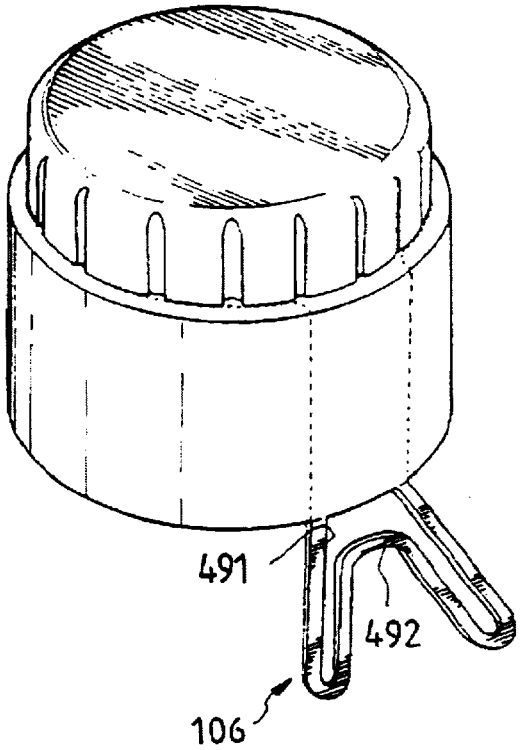
FIG. 49 is a perspective view of a modified example of the second embodiment of the present as shown in FIG. 40.

Referring to FIG. 49, there is shown another modified example of the present invention. Except for the shape of the pull-tab 106, this modified example is similar to that shown in FIG. 42 with the reinforcing member omitted. As shown in the drawing, the pull-tab 106 is formed in an upside-down V shape having a finger hole 491. A bend 492 is formed in the pull-tab 106 which when pulled, expands outward to increase the size of the finger hole 491. The structure of the pull-tab 106 in this modified example enables the length of the same to be decreased.

The third embodiment of the present invention will now be described hereinafter. In the third embodiment, including all the modified examples, there is provided a separate means for maintaining the pull-tab in a fixed state to prevent the same from loosely moving.

Figure 50:
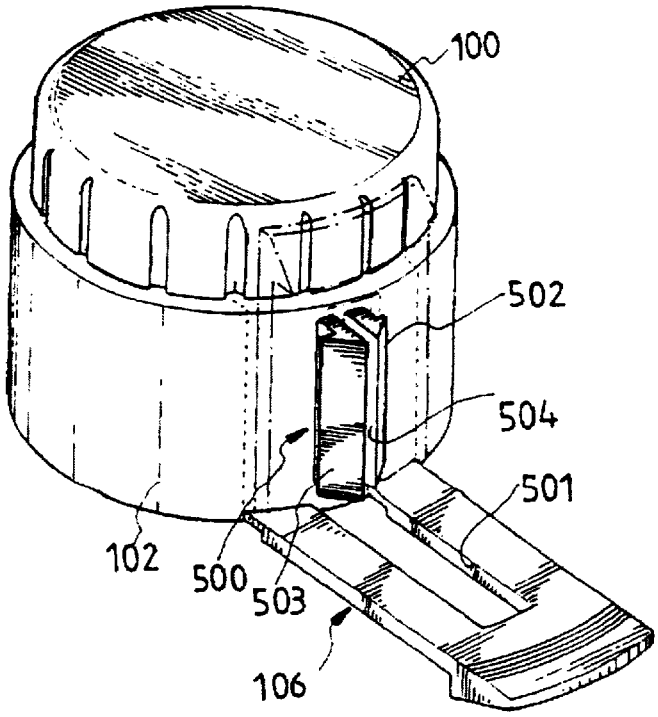
FIG. 50 is a perspective view of a bottle cap according to a third embodiment of the present invention.

Referring first to FIG. 50, the pull-tab 106 has a tab hole 501 formed longitudinally and is integrally connected to the lower body 102 at a bottom portion thereof. A fixing member 500 is formed on the lower body 102 at a location corresponding to the formation of the tab hole 501 of the pull-tab 106. The fixing member 500 is comprised of a pair of bendable fixing protrusions 502 and 503 having a gap 504 formed therebetween. The bendable fixing protrusions 502 and 503 of the fixing member bend inward toward the gap 504 when the pull-tab 106 is pressed against or pulled from the fixing member 500 to allow the fixing or releasing of the pull-tab to or from the lower body 102.

Figure 51:
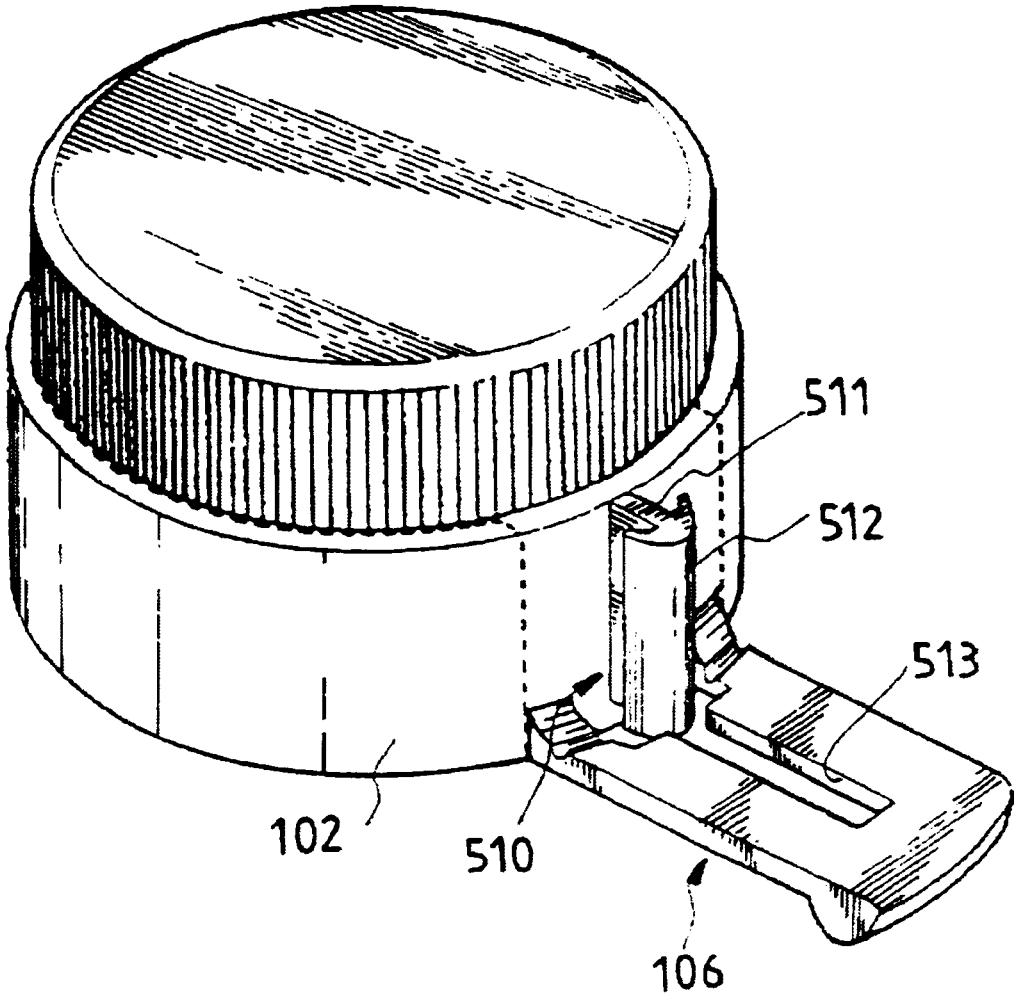
FIG. 51 is a perspective view of a modified example of the third embodiment of the present as shown in FIG. 50.

A modified example of the third embodiment is shown in FIG. 51. This modified example is formed similarly to the third embodiment except that a fixing member 510 is formed in a single piece. The fixing member 510 is realized through a protrusion 511 formed longitudinally on the lower body 102, and a bendable head portion 512 formed integrally with the protrusion 511. A tab hole 513 is formed in the pull-tab 106 corresponding to the fixing member 510. The pull-tab 106 is fixed to the lower body 106 by being pushed onto the fixing member 510, the action of which contracts outside edges of the bendable head portion 512 until the tab hole 513 is positioned next to the lower body 102.

Figure 52A:
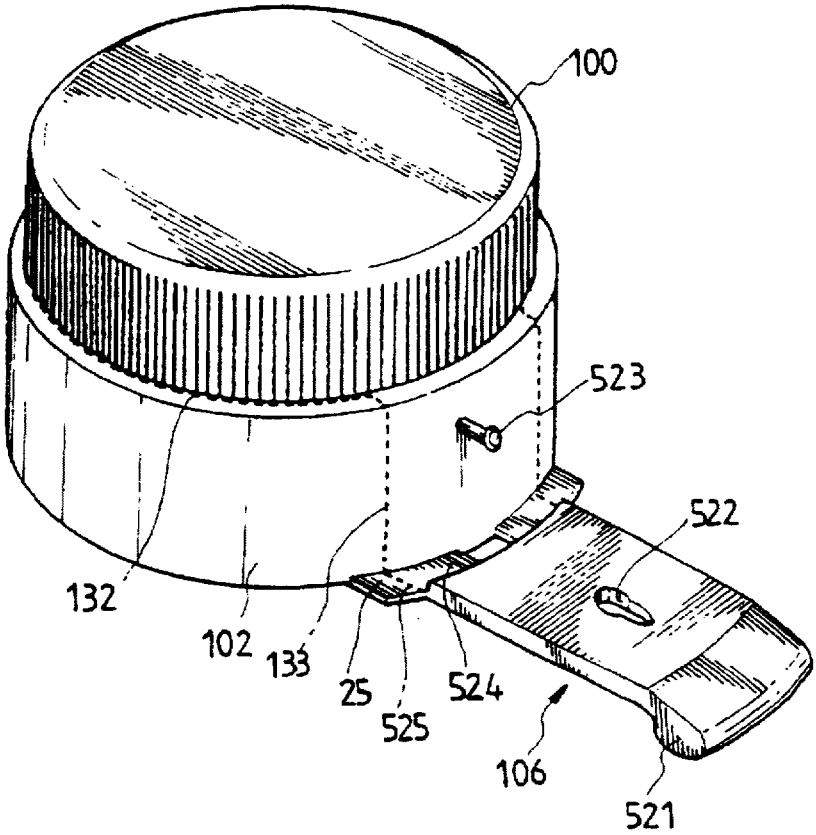
FIGS. 52A and 52B are perspective views of a modified example of the third embodiment of the present invention as shown in FIG. 50.
Figure 52B:
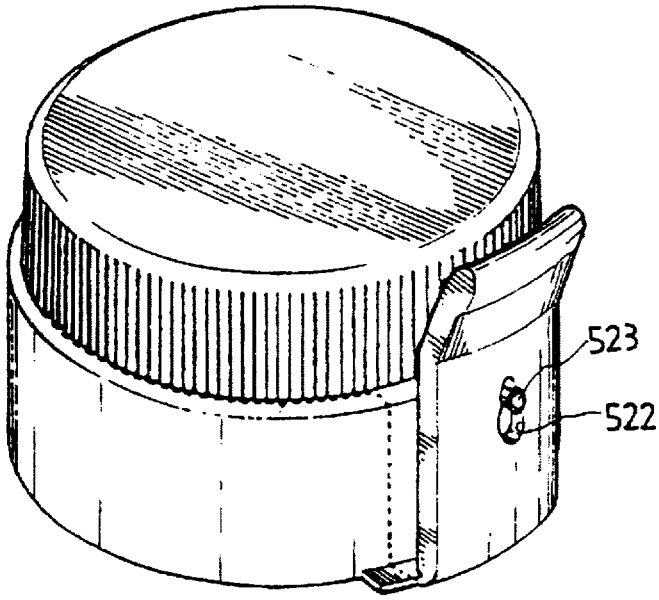
Figure 53:
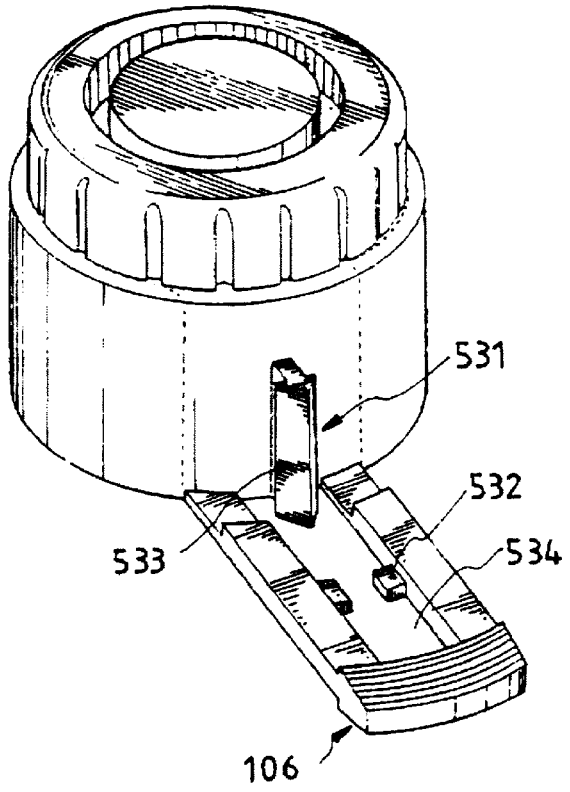
FIG. 53 is a perspective view of a modified example of the third embodiment of the present as shown in FIG. 50.

Another modified example of the third embodiment is shown in FIGS. 52A and 52B. As shown in FIG. 52A, the pull-tab 106 in this modified example is connected to the lower body 102 through a pair of connectors 524 which protrude outward from the lower body at a bottom portion thereof. Connector cutting lines 525 are formed on both the connectors 524 directly outside the edges of the pull-tab 106, the connector cutting lines 525 connect with the vertical cutting lines 133. A hook 523 is formed on an upper, portion of the lower body 102 between the vertical cutting lines 133, and a hook hole 522 is formed in the pull-tab 106 corresponding to the location of the hook 523 when the pull-tab 106 is folded toward the lower body 102. A handle 521 is formed on the free end of the pull-tab 106, the handle 521 jutting outward at a fixed angle. FIG. 52B illustrates the pull-tab 106 in a folded state, the hook 523 passed through the hook hole 522. There is shown another modified example of the third embodiment in FIG. 53. As shown in the drawing, this modified example is similar to the third embodiment and the modified example shown in FIGS. 50 and 51, respectively. Here, a fixing member 531 is provided that is smaller than the previous ones and includes a fixing protrusion 533 which is unbendable. A tab hole 534 is formed longitudinally in the pull-tab 106 and a pair of bendable catch hooks 532 are provided in the tab hole 534 extending inward facing each other.

Figure 54:
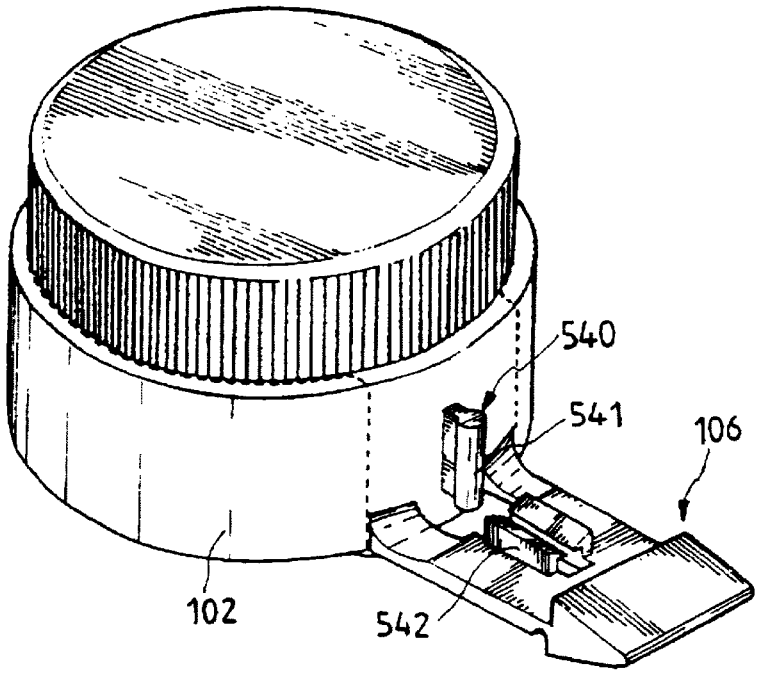
FIG. 54 is a perspective view of a modified example of the third embodiment of the present as shown in FIG. 50.

FIG. 54 illustrates another modified example of the third embodiment. As shown in the drawing, a fixing member 540 is positioned similarly to the above modified example of FIG. 53. A cylindrical fixing protrusion 541 is integrally formed along a length of the fixing member 540. Also, bendable catch hooks 542 are formed on the pull-tab 106. As a result, the upper portion of the pull-tab 106 can be fixed or detached from the lower body 102.

Figure 55A:
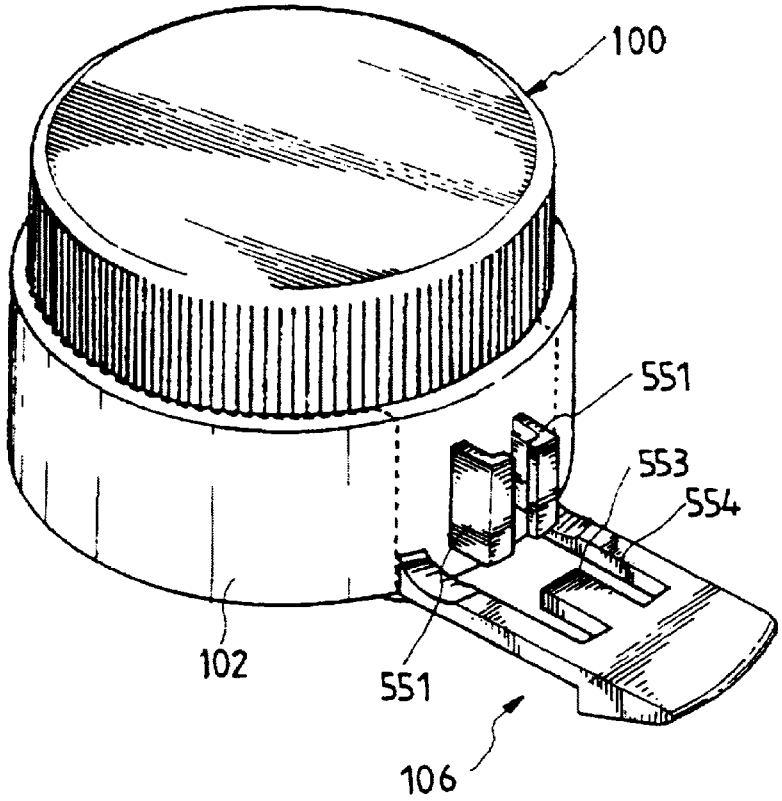
FIGS. 55A and 55B are perspective views of a modified example of the third embodiment of the present invention as shown in FIG. 50.
Figure 55B:
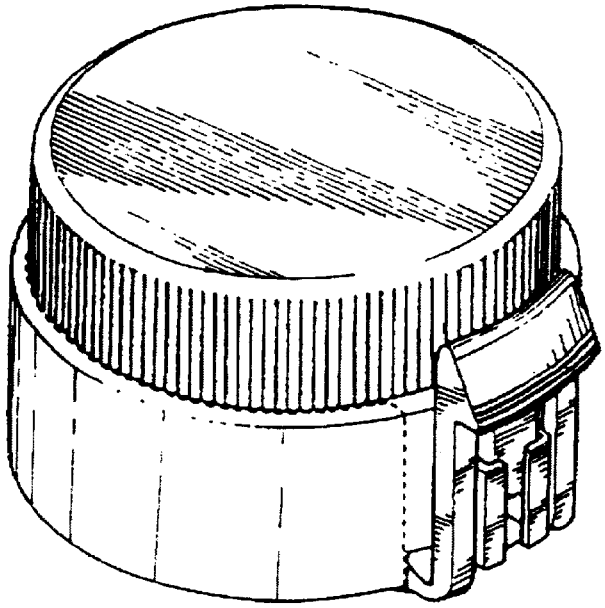

There is shown still yet another modified example of the third embodiment in FIGS. 55A and 55B. As shown in FIG. 55A, a catch flap 553 is formed extending down partway from a top of a tab hole 554 of the pull-tab 106. L-shaped flap hooks 551 are formed extending outward on the lower body 102 which, when the pull-tab 106 is pushed in a direction toward the lower body 102, grabs the catch flap 553 to maintain the pull-tab 106 in a state fixed against the lower body 102 as shown in FIG. 55B.

Figure 56:
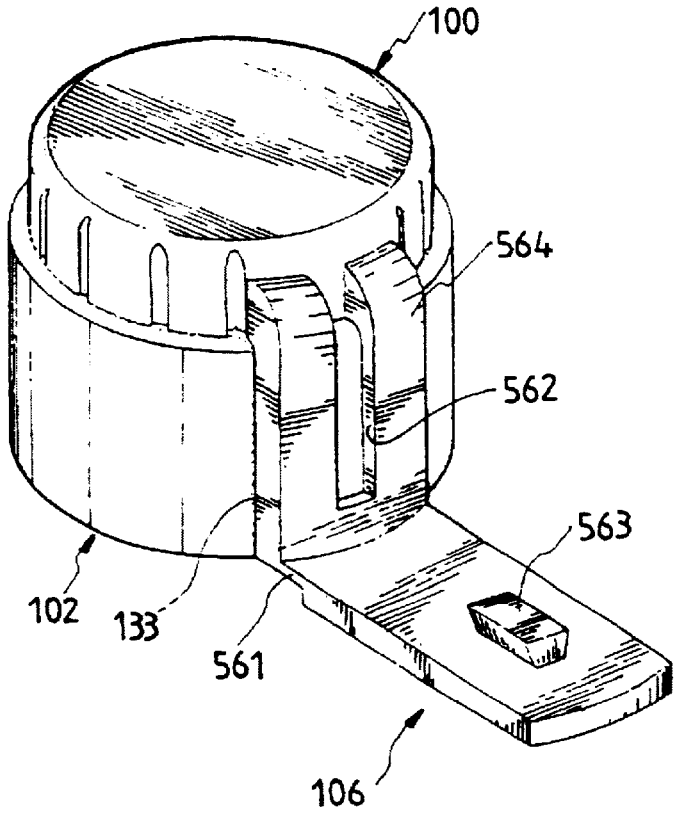
FIG. 56 is a perspective view of a modified example of the third embodiment of the present as shown in FIG. 50.

Another modified example is shown in FIG. 56. As shown in the drawing, a projection 564 is formed on the lower body 102 integrally connected to the upper body 100 on one end. The pull-tab 106 is connected to the projection 564 through a folding crease 561. A catch groove 562 is formed along most of the length of the projection 564 and a catch protrusion 563 is formed on the pull-tab 106. The catch protrusion 563 is inserted in the catch groove 562 when the user folds the pull-tab 106 over the projection 564.

Figure 57:
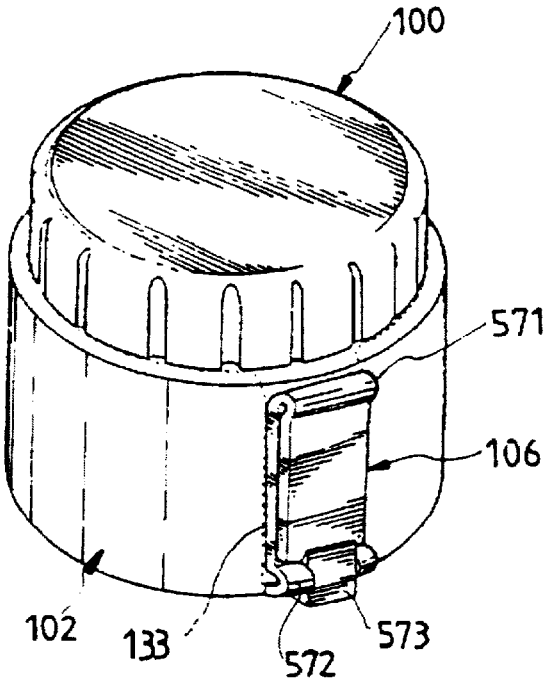
FIG. 57 is a perspective view of a modified example of the third embodiment of the present as shown in FIG. 50.

Another modified example of the third embodiment is shown in FIG. 57. As shown in the drawing, the pull-tab 106 is connected to the lower body 102 through connectors 572 provided between the vertical cutting lines 133. The pull-tab 106 extends upward from the connectors 572 and folds downward through a bend 571 before reaching the upper body 100. A catch protrusion 573 is integrally formed to the bottom of the lower body 102 between the connectors 572. The free end of the pull-tab 106 tucks behind the catch protrusion 573 to be temporarily fixed to the lower body 102 until the user desires to open the bottle (not shown).

Figure 58:
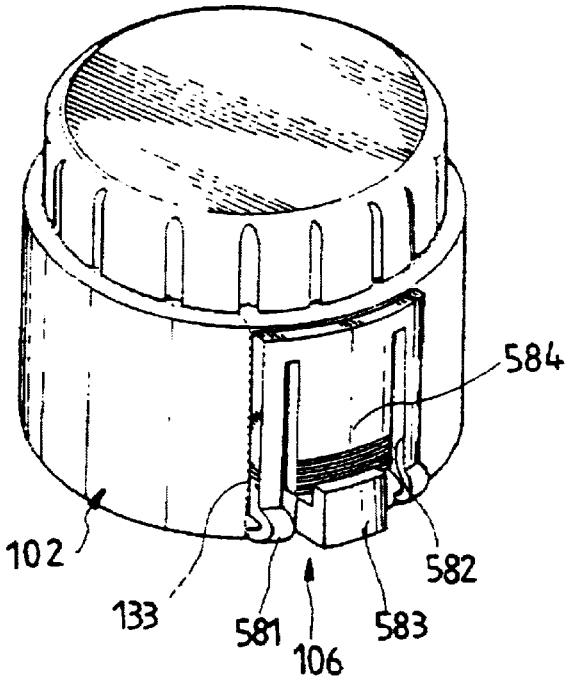
FIG. 58 is a perspective view of a modified example of the third embodiment of the present as shown in FIG. 50.

Referring to FIG. 58, there is shown another modified example of the third embodiment. Here, the pull-tab 106 is mounted to the lower body 102 through connectors 581 formed between the vertical cutting lines 133. The pull-tab 106 extends upward from the connectors 581 and has formed two slits 582 longitudinally formed directly inside the connectors 581. As a result of the formation of the slits 582, a grip 584 is formed extending downward in the center of the pull-tab 106. A catch protrusion 583 is formed on the bottom of the lower body 102, the grip 584 of the pull-tab 106 catching behind the catch protrusion 583 as shown in the drawing.

Figure 59:
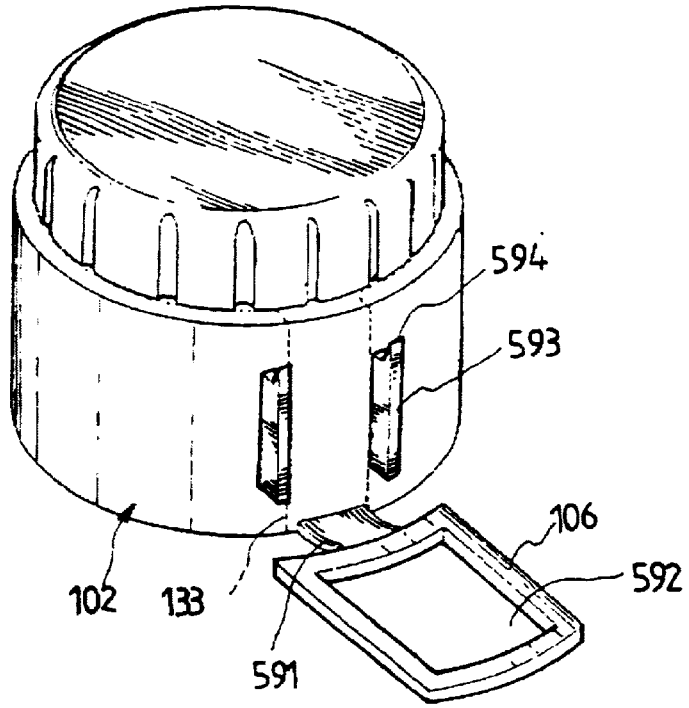
FIG. 59 is a perspective view of a modified example of the third embodiment of the present as shown in FIG. 50.

There is shown still yet another modified example of the third embodiment in FIG. 59. As shown in the drawing, the pull-tab 106 is rectangular and forms a finger hole 592. The pull-tab 106 is connected to the lower body 102 through a connector 591. Also, catch members 593 having catch hooks 594 formed on an upper portion thereof are formed longitudinally on the lower body 102 outside the vertical cutting lines 133. The upper part of the pull-tab 106 can be placed over and behind the catch hooks 594 of the catch members 593 such that the pull-tab 106 is maintained fixed to the lower body 102.

Figure 60:
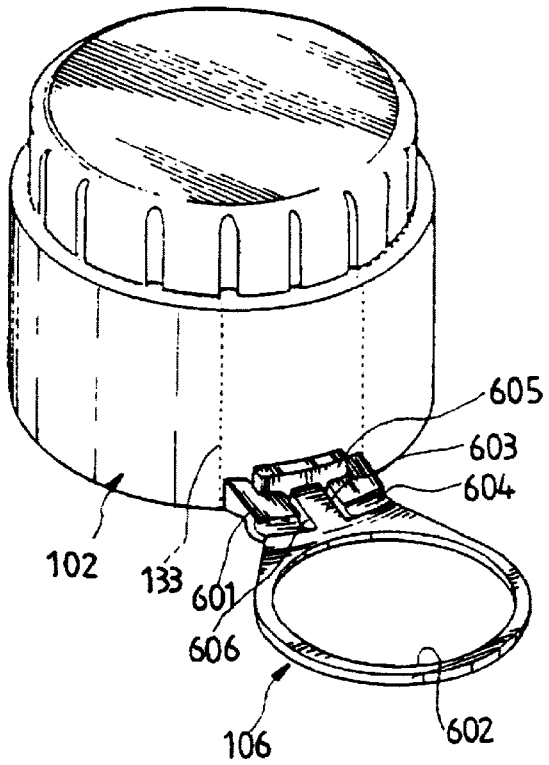
FIG. 60 is a perspective view of a modified example of the third embodiment of the present as shown in FIG. 50.

Referring to FIG. 60, there is shown another modified example of the third embodiment. As shown in the drawing, the pull-tab 106 is ring-shaped forming a finger hole 602, and fixed to the bottom of the lower body 102 through connectors 601 fixed between the vertical cutting lines 133, the connectors forming a gap 606 therebetween. A fold crease 604 is formed between the connectors 601 and the pull-tab 106, and a hold extension 603 is formed protruding from the pull-tab 106 to be positioned in the gap 606. A hold plate 605 is formed on the bottom of the lower body 102 between the connectors 601. Accordingly, when the pull-tab 106 is folded on the fold crease 604, the hold extension 603 is forced past the hold plate 605 such that the pull-tab 106 is maintained in an upright state.

Figure 61:
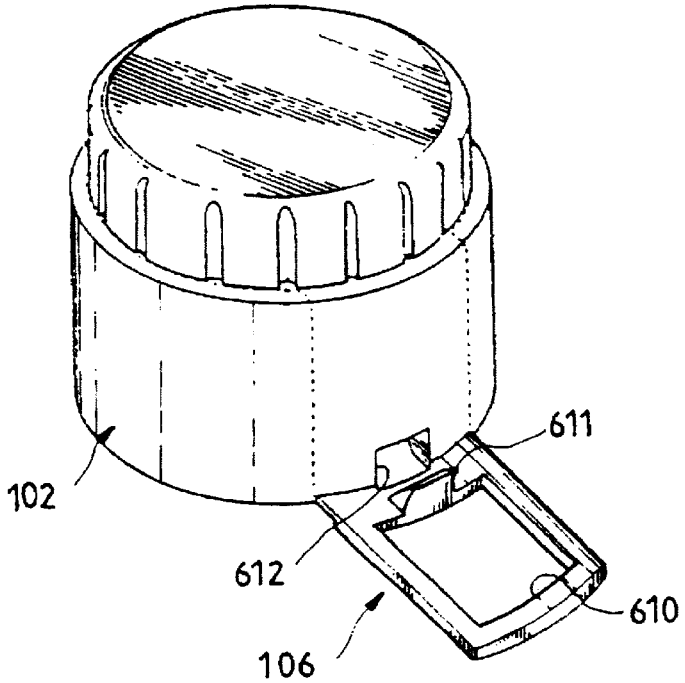
FIG. 61 is a perspective view of a modified example of the third embodiment of the present as shown in FIG. 50.

FIG. 61 illustrates another modified example of the third embodiment. As shown in the drawing, the pull-tab 106, having a finger hole 610, is formed directly on the lower body 102. A hook 611 is formed on the bottom of the pull-tab 106 and a hook hole 612 is formed on the bottom of the lower body 102 corresponding to the location of the hook 611 when the pull-tab 106 is folded toward the lower body 102.

Figure 62:
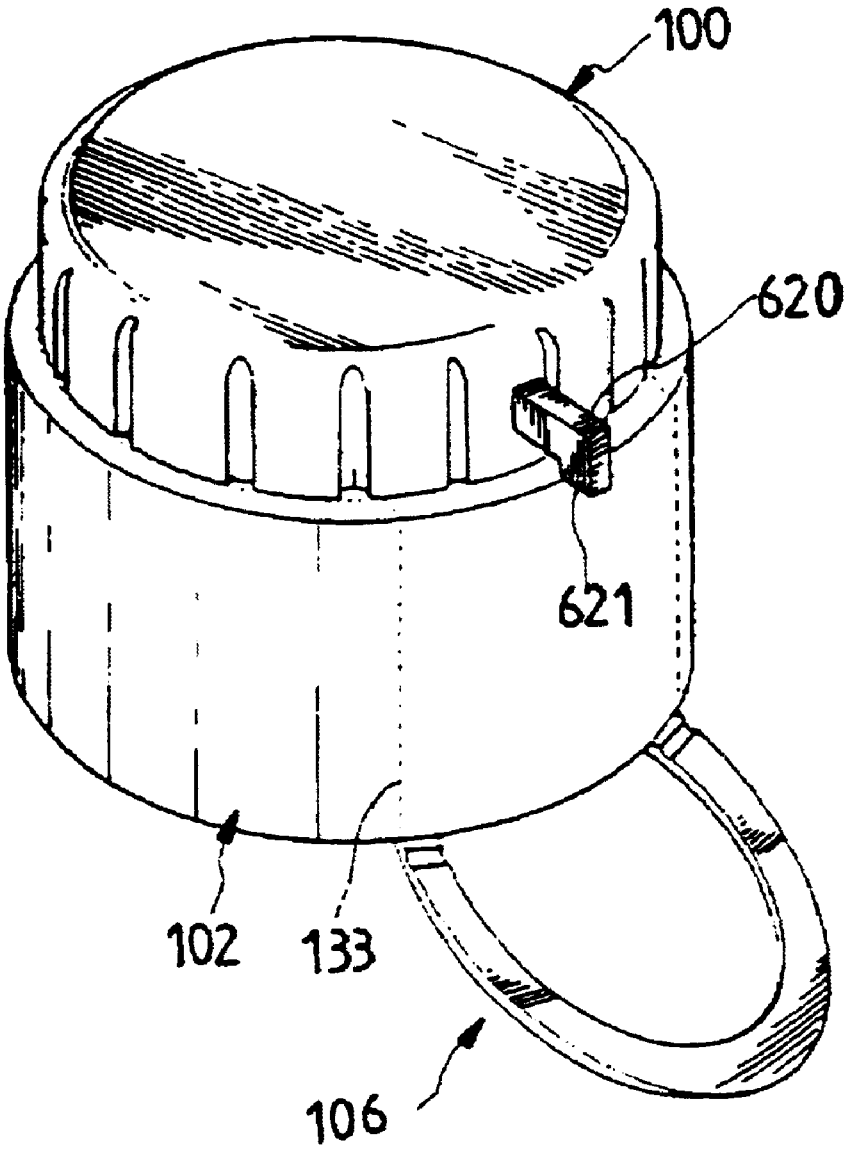
FIG. 62 is a perspective view of a modified example of the third embodiment of the present as shown in FIG. 50.

Another modified example of the third embodiment is shown in FIG. 62. Here, the pull-tab 106 is horseshoe-shaped and formed directly on the lower body 102 between the vertical cutting lines 133. Fold creases 623 are formed on the pull-tab 106 directly behind points where the pull-tab 106 is connected to the lower body 102. A fixing protrusion 620 having a hook 621 is formed on the upper body 100 such that the free end of the pull-tab 106 is held next to the upper body 100 by the hook 621 when folded upward.

Figure 63A:
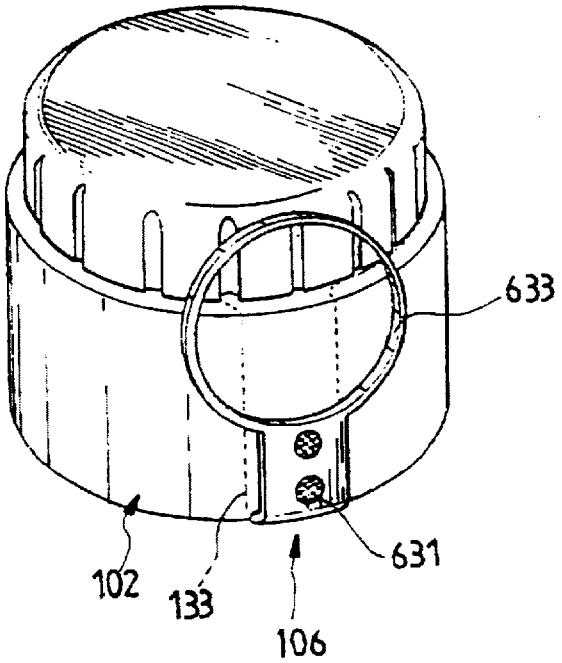
FIGS. 63A and 63B are perspective views of a modified example of the third embodiment of the present invention as shown in FIG. 50.
Figure 63B:
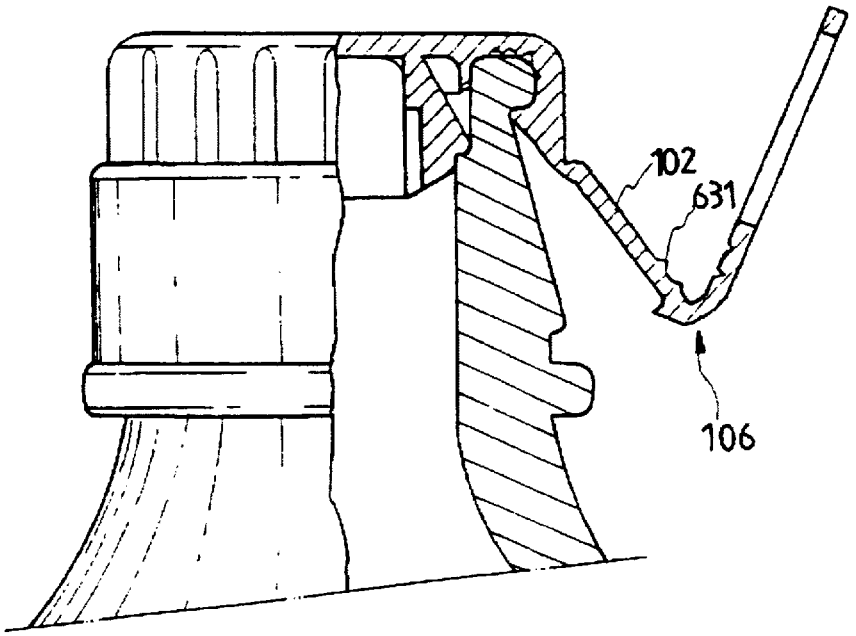

FIGS. 63A and 63B illustrate another modified example of the third embodiment. As shown in the drawings, the pull-tab 106 is integrally formed to the bottom of the lower body 102 and extends upward to form a finger hole 633. In a portion between the finger hole 633 and the connection of the pull-tab 106 to the lower body 102 is formed two connecting portions 631. In the manufacturing process, the connecting portions 631 are fused with the lower body 102 by applying ultra-sonic waves thereon. The connecting portions 631 are easily released from the lower body 102 by the user pulling outward on the pull-tab 106.

Figure 64:
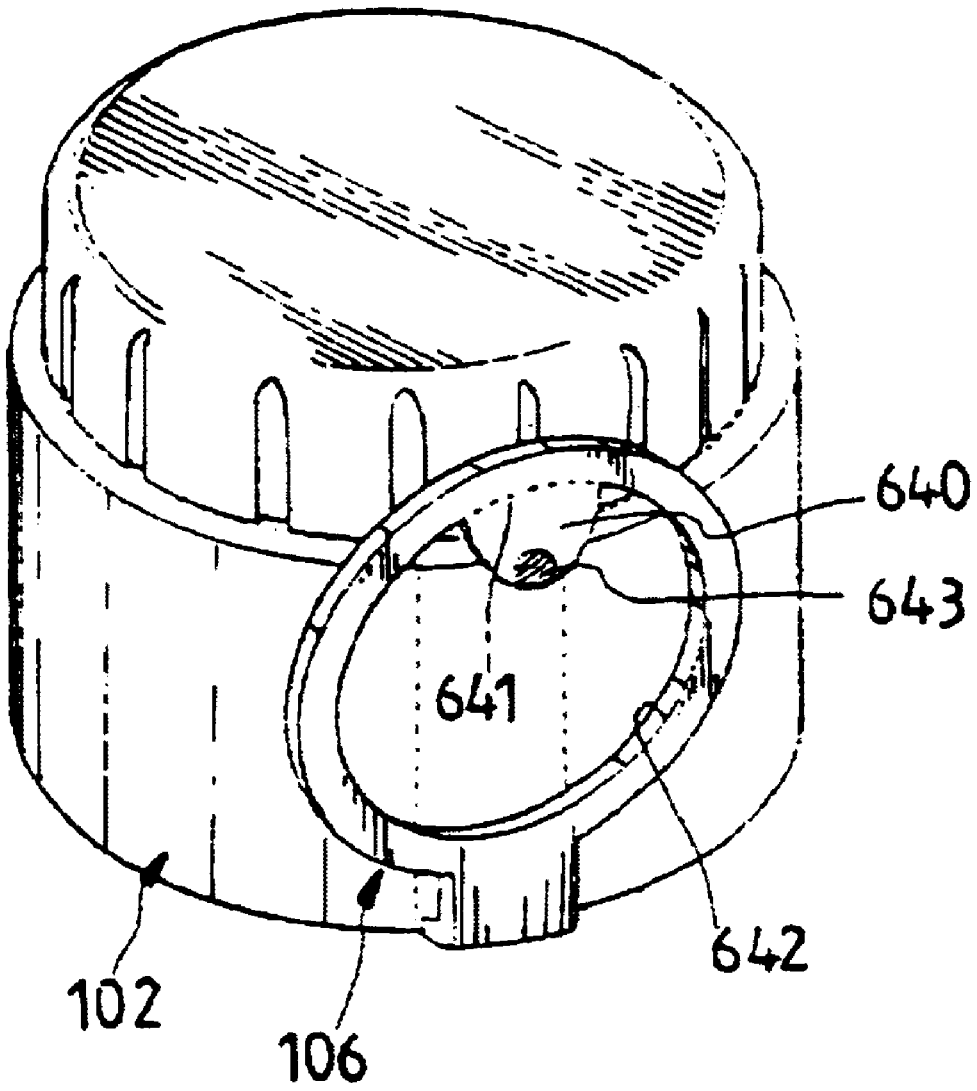
FIG. 64 is a perspective view of a modified example of the third embodiment of the present as shown in FIG. 50.

Another modified example of the third embodiment is shown in FIG. 64. This modified example is formed similarly to that shown in FIG. 63 except that a coupling portion 640 is formed on a top part of a finger hole 642. A finger hole cutting line 641 is formed between an inside edge of the finger hole 642 and the coupling portion 640, and a connecting portion 643 which is activated to fuse on the upper part of the lower body 102 using ultra-sonic waves. The user releases the pull-tab 106 from the lower body 102 by pulling on the pull-tab 106 which cuts the finger hole cutting line 641.

Figure 65A:
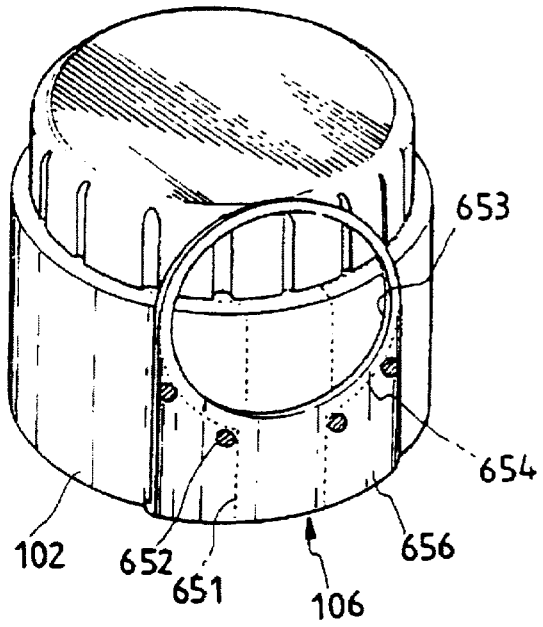
FIGS. 65A and 65B are perspective views of a modified example of the third embodiment of the present invention as shown in FIG. 50.
Figure 65B:
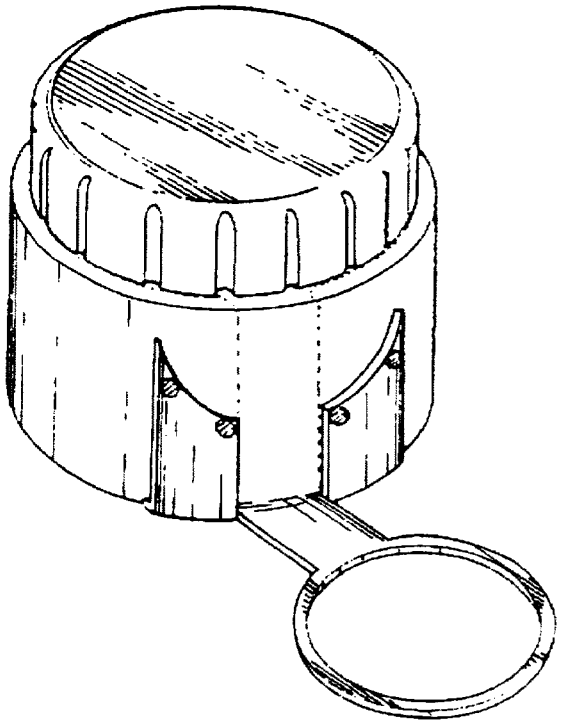

There is shown another modified example of the third embodiment in FIGS. 65A and 65B. As shown in FIG. 65A, the pull-tab 106 is formed similarly to that shown in FIG. 64 and there are formed tab fixing portions 656, connected to the lower body 102, on the outside of the pull-tab 106. The tab fixing portions 656 have connection portions 652, fused to the lower body 102 using ultra-sonic waves, formed on an upper parts thereof. Finger hole cutting lines 654 and tab cutting lines 651 are provided between the pull-tab 106 and the tab fixing portions 656. The user releases the pull-tab 106 from the tab fixing portions 656 by pulling downward on the pull-tab 106 such that the cutting lines 654 and 651 are cut as shown in FIG. 65B.

Figure 66:
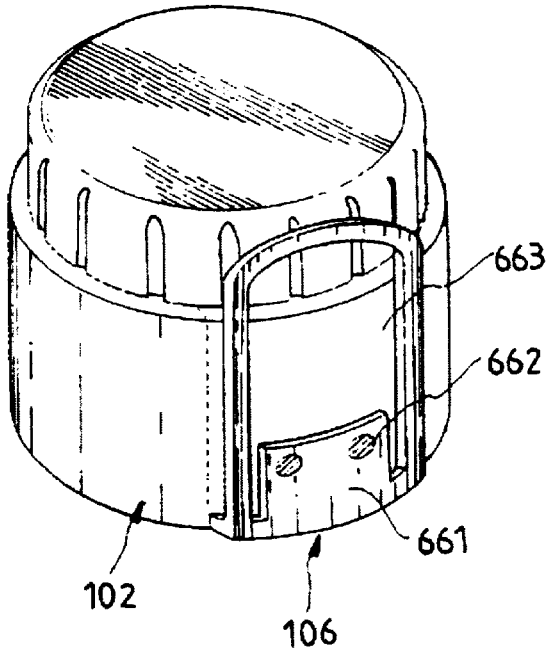
FIG. 66 is a perspective view of a modified example of the third embodiment of the present as shown in FIG. 50.

Another modified example of the third embodiment is illustrated in FIG. 66. As shown in the drawing, the pull-tab 106 is horseshoe-shaped having a finger hole 663 and is fixed directly on the lower body 102. Protruding upward from the bottom of the finger hole 663 is a joining member 661. Connecting portions 662, fused to the lower body 102 using ultra-sonic waves, are provided in the joining member 661. The connecting portions 662 are detached from the lower body 102 when the user pulls outward on the pull-tab 106.

Figure 67:
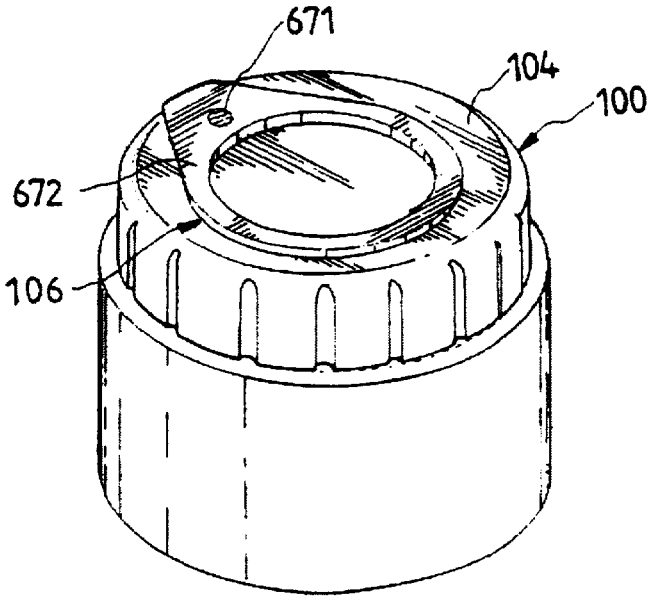
FIG. 67 is a perspective view of a modified example of the third embodiment of the present as shown in FIG. 50.

There is shown another modified example of the third embodiment in FIG. 67. As shown in the drawing, the pull-tab 106 is formed on the upper surface 104 of the upper body 100. A protrusion 672 is formed on a part of the pull-tab 106 extending over to the edge of the upper body 100. A connecting portion 671, fixed to the upper body 100 using ultra-sonic waves, is formed in a center of the protrusion.

Figure 68A:
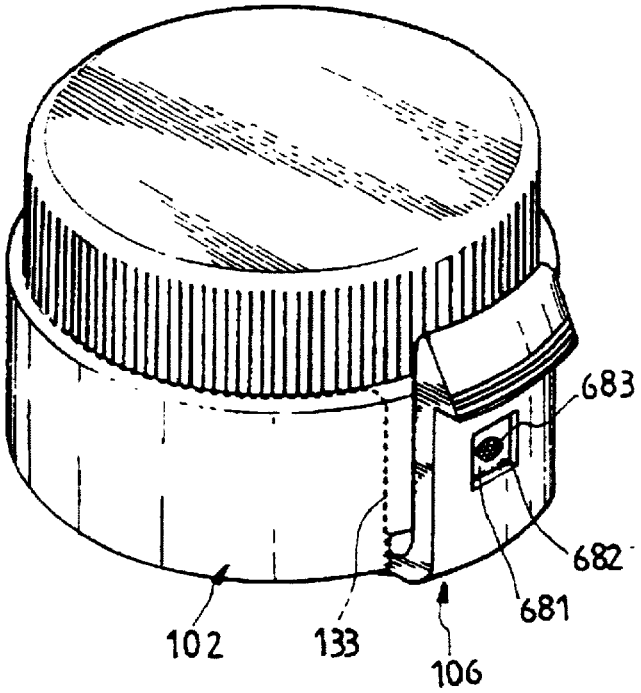
FIGS. 68A and 68B are perspective views of a modified example of the third embodiment of the present invention as shown in FIG. 50.
Figure 68B:
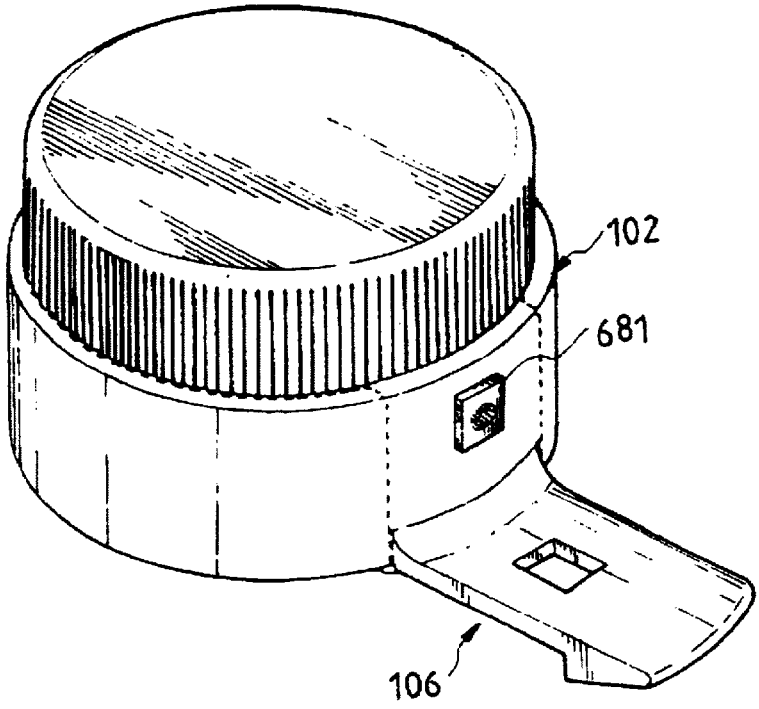

A last modified example of the third embodiment is shown in FIGS. 68A and 68B. As shown in the drawings, the pull-tab 106 is integrally formed with the bottom of the lower body 102. In a center of the pull-tab 106 is formed a square-shaped joining member 681, around the circumference of which is formed a cutting line 682 and in the center of which is formed a connecting portion 683, fused to the lower body 102 using ultra-sonic waves. The pull-tab 106 is fixed to the lower body 102 through the connecting portion 683. The user can detach the pull-tab 106 from the lower body 102 by pulling the pull-tab 106 in an outward direction which cuts the cutting line 682 such that the joining member 681 remains fixed to the lower body 102 and the pull-tab 106 is released from the same as shown in FIG. 68B.

In the above third embodiment, including all modified examples, the pull-tab is maintained in a fixed state in an upward direction. In the fourth embodiment and all modified examples, a separate means is provided which maintains the pull-tab in a fixed state in a downward direction.

Figure 69:
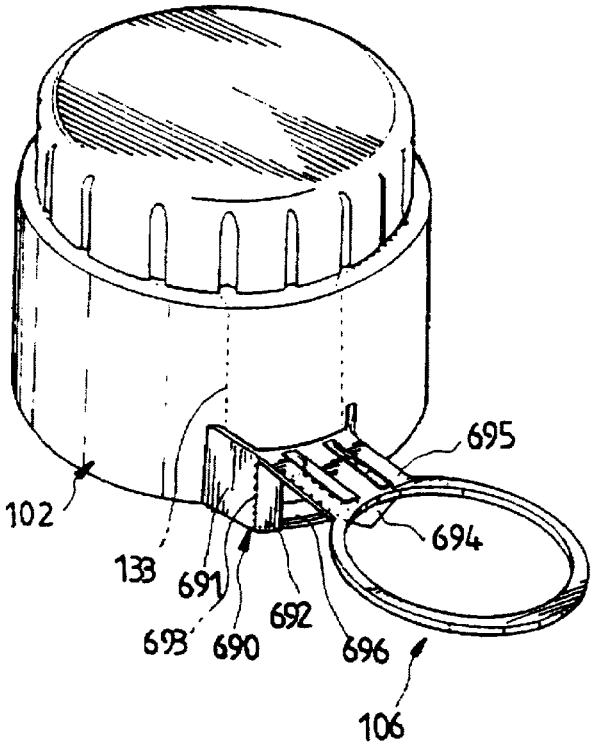
FIG. 69 is a perspective view of a bottle cap according to a fourth embodiment of the present as shown in FIG. 50.

Referring to FIG. 69, there is shown a fourth embodiment of the present invention. As shown in the drawing, a tab fixing member 690 is provided on the lower body 102. The tab fixing member 690 is comprised of supports 691 formed outside the vertical cutting lines 133 and fixing plates 692 formed inward from the supports 691 at an end farthest from the lower body 102. Support cutting lines 693 are provided between the supports 691 and the fixing plates 692, and a gap 696 is formed between the fixing plates 692. A tab body 695 of the pull-tab 106 is integrally connected to a top of the fixing plates 692, the tab body 695 having a catch protrusion 694 formed inwardly such that the same can be inserted in the gap 696. The catch protrusion 694 is arrow-shaped and sized to fit tightly between the fixing plates 692 to maintain the pull-tab 106 in a downward state until the user pulls upward on the same.

Figure 70:
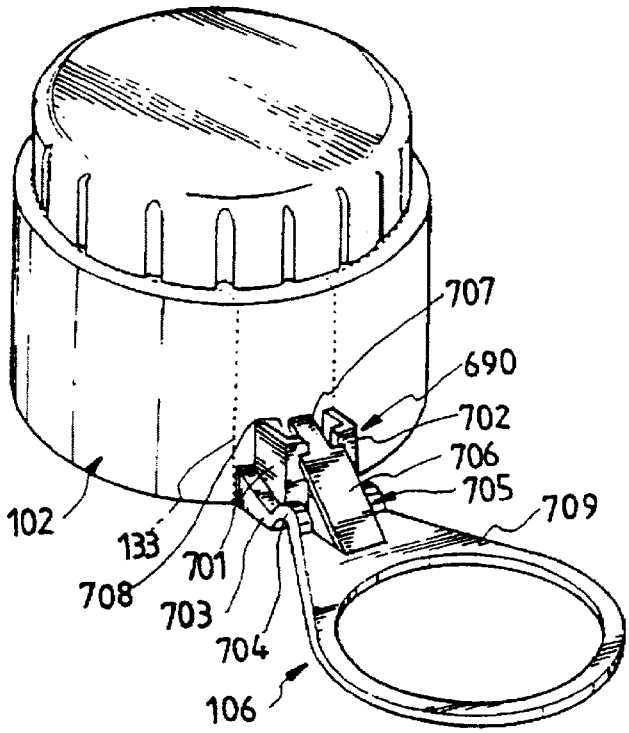
FIG. 70 is a perspective view of a modified example of the fourth embodiment of the present as shown in FIG. 50.

A modified example of the fourth embodiment is shown in FIG. 70. As shown in the drawing, the fixing member 690 is provided between the vertical cutting lines 133 on a lower part of the lower body 102. The fixing member 690 is comprised of supports 701 formed longitudinally and fixing plates 702 formed inwardly from the supports 701, the supports and fixing plates 701 and 702 being formed at a predetermined distance to provide a gap 708 therebetween. The pull-tab 106 is formed directly on the lower body 102 between the vertical cutting lines 133 through tab connectors 703. Bends 704 are provided between the tab connectors 703 and a tab body 709, the bends 704 allowing the pull-tab 106 to fold downward. A catch protrusion 705 having a wide portion 706 and a narrow portion 707 is pivotably formed from the tab body 709 extending toward the lower body 102.

Accordingly, when the pull-tab 106 is pushed downward by the user, the narrow portion 707 of the catch protrusion 705 remains pressed against the lower body 102 and the wide portion 706 is forced between the fixing plates 702 in the gap 708 such that the pull-tab 106 is maintained in a downward direction.

Figure 71:
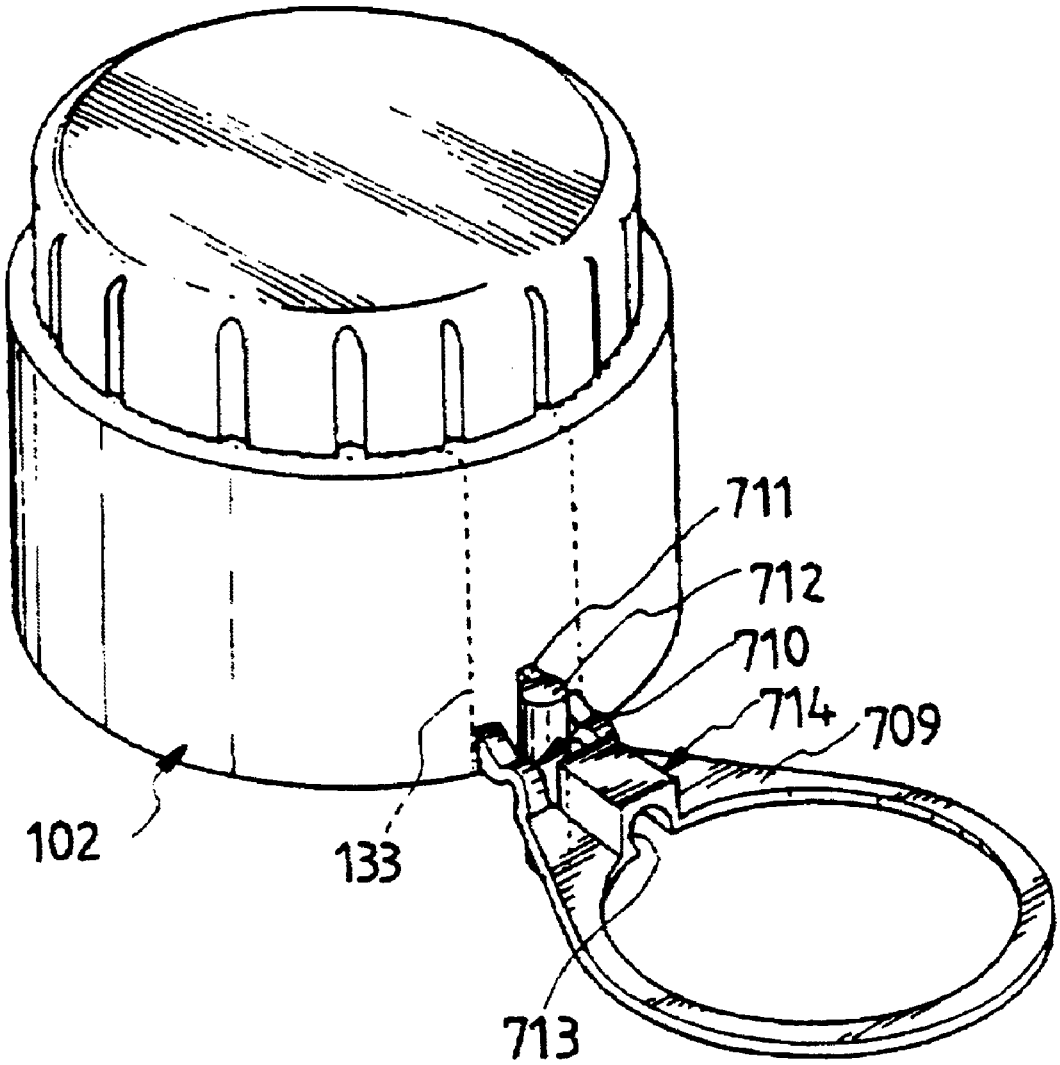
FIG. 71 is a perspective view of a modified example of the fourth embodiment of the present as shown in FIG. 50.

Another modified example of the fourth embodiment is shown in FIG. 71. As shown in the drawing, the pull-tab 106 is formed similarly to that shown in FIG. 70. However, the pull-tab 106 in this modified example has a catch portion 714, including a catch groove 713, formed protruding outward on the tab body 709. A fixing member 710 is comprised of an attachment 711 formed longitudinally on the lower body 102 and a cylindrical fixing protrusion 712 formed integrally on the attachment 711. The fixing protrusion 712 inserts into the catch groove 713 of the catch portion 714 to maintain the pull-tab 106 in a downward position.

Figure 72A:
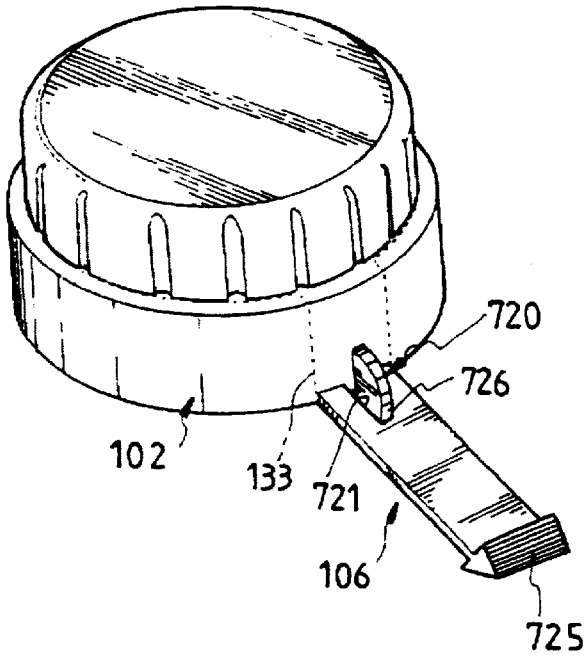
FIGS. 72A and 72B are perspective views of a modified example of the fourth embodiment of the present invention as shown in FIG. 50.
Figure 72B:
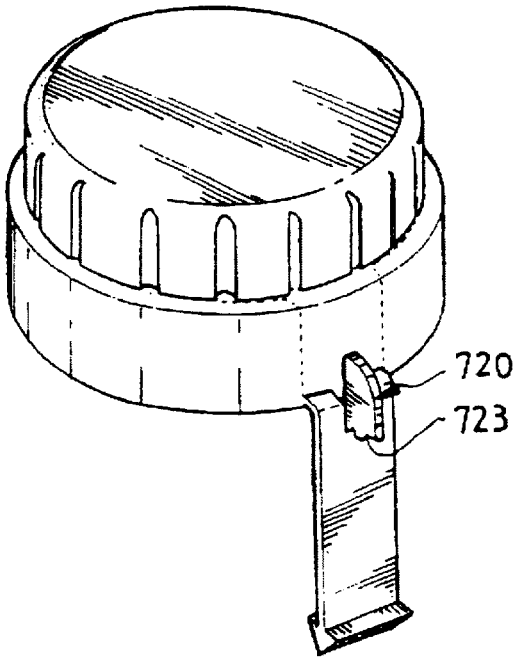

There is shown another modified example of the fourth embodiment in FIGS. 72A and 72B. Here, the pull-tab 106 is integrally formed on the lower body 102 between the vertical cutting lines 133. A grasp 725 is formed on the free end of the pull-tab 106 and a slot 726 is formed on the opposite end thereof. A fixing member 720 is provided on the lower body 102, the fixing member 720 having a ridge 723 as shown in FIG. 723. The slot 726 of the pull-tab 106 is formed surrounding the pull-tab 106 and fixes the same in a downward position through the ridge 723 such that the pull-tab 106 is in a state as shown in FIG. 72B.

Figure 73A:
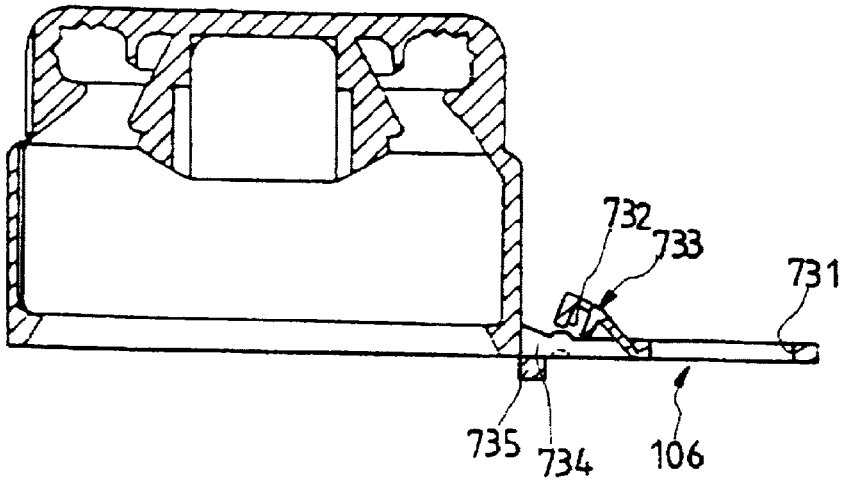
FIGS. 73A and 73B are perspective views of a modified example of the fourth embodiment of the present is invention as shown in FIG. 50.
Figure 73B:
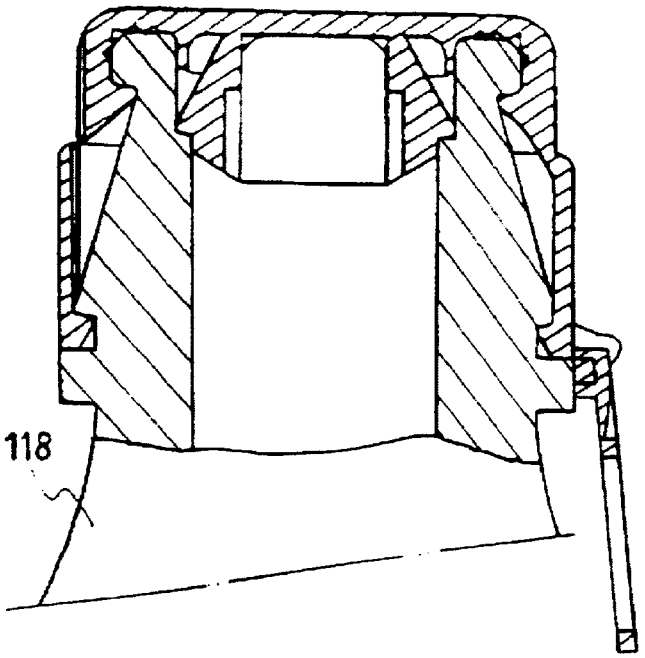

Another modified example of the fourth embodiment is shown in FIGS. 73A and 73B. Here, a support protrusion 733 having a catch groove 732 is formed on the inside of the pull-tab 106, the pull-tab 106 having a finger hole 731. The pull-tab 106 is connected to the lower body 102 between the vertical cutting lines (not shown) by connecting portions 734. A fixing protrusion 735 is formed on a lower side of the connecting portions 734 such that the catch groove 732 of the support protrusion 733 is able to be fastened on the fixing protrusion 735.

Accordingly, when the pull-tab 106 is pushed downward, the support protrusion 733 is also pushed toward the bottle 118, and the catch groove 732 is fixed on the fixing protrusion 735 such that the pull-tab 106 is maintained in a downward state as shown in FIG. 73B.

Figure 74A:
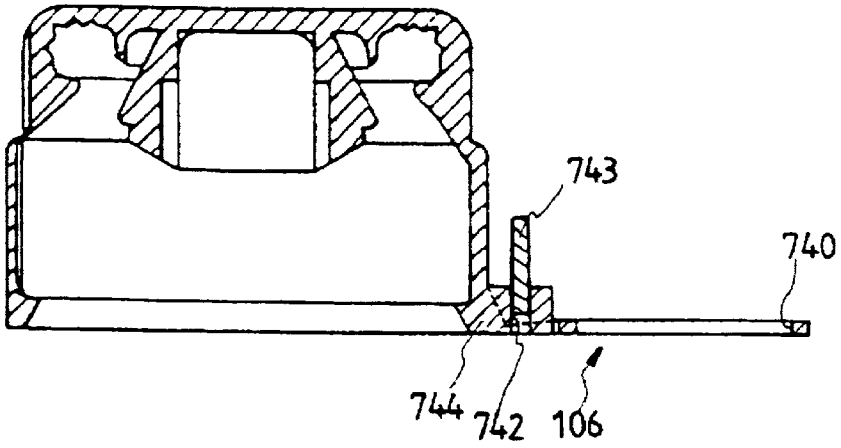
FIGS. 74A and 74B are perspective views of a modified example of the fourth embodiment of the present invention as shown in FIG. 50.
Figure 74B:
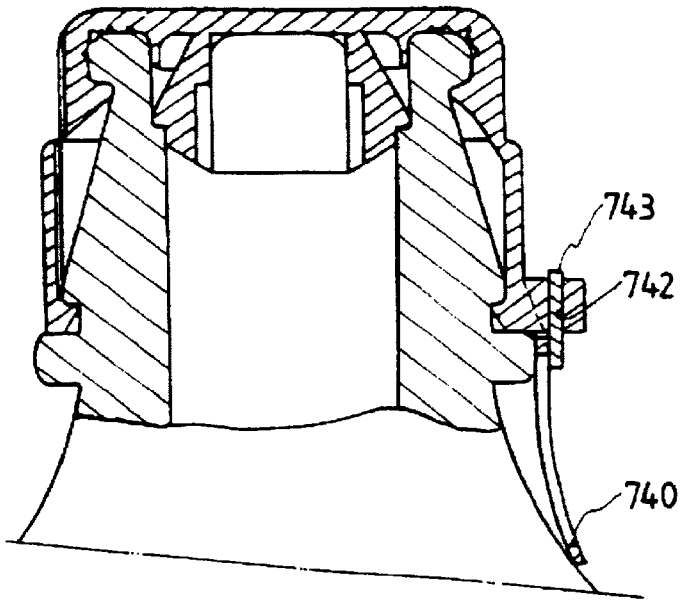

Referring to FIGS. 74A and 74B, there is shown another modified example of the fourth embodiment. As shown in FIG. 74A, the pull-tab 106, having a finger hole 740, is connected to the lower body 102 between the vertical cutting lines (not shown) by connecting portions 744. A slide hole 742 is formed in the connecting portions 744 and a fixing pin 743 is provided in the slide hole 742, the fixing pin 743 able to move up and down in the slide hole 742 and which secures the pull-tab 106.

Accordingly, in a state where the fixing pin 743 is in an upward state, after the pull-tab 106 is pushed downward and the fixing pin 743 pressed down into the slide hole 742, the pull-tab 106 is maintained in the downward state as shown in FIG. 74B.

Figure 75A:
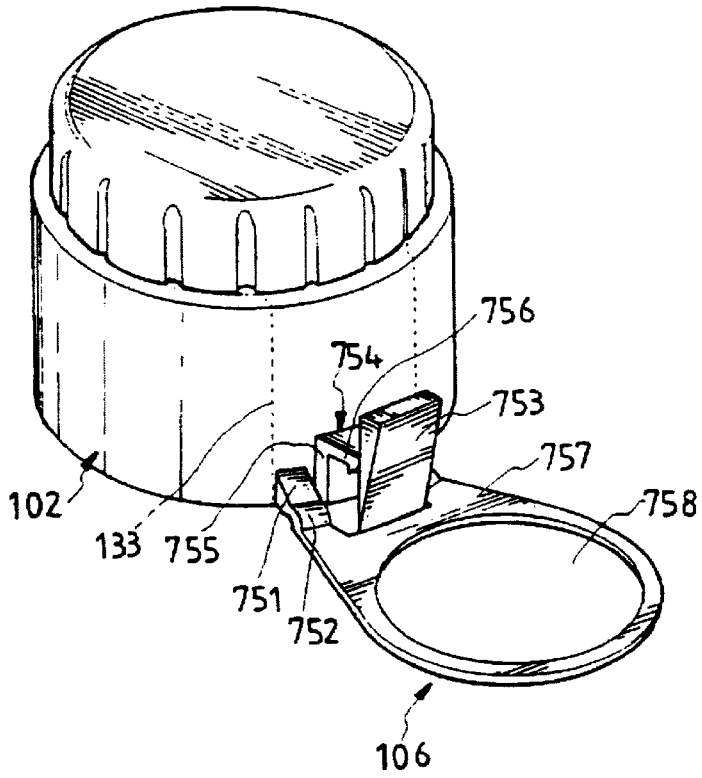
FIGS. 75A and 75B are perspective views of a modified example of the fourth embodiment of the present invention as shown in FIG. 50.
Figure 75B:
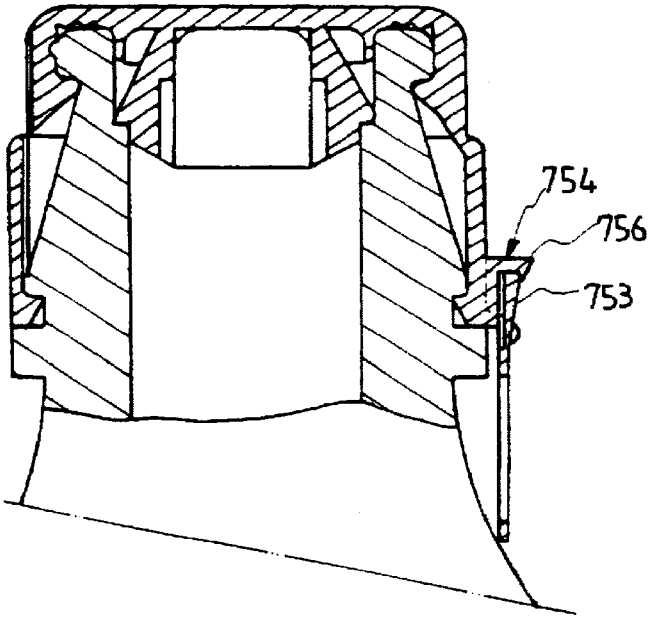

There is shown another modified example of the fourth embodiment in FIGS. 75A and 75B. As shown in FIG. 75A, the pull-tab 106 is formed integrally with the lower body 102 between the vertical cutting lines 133 through tab connectors 751. The pull-tab 106 has a finger hole 758 and has bends 752 formed between the tab connectors 751 and a tab body 757. A wedge 753 is pivotably formed on the tab body 757 and a wedge hook 754, having a body 755 integrally formed extending upward on the lower body 102 and a catch protrusion 756 formed at a right angle from the body 755, is provided on the lower body 102.

Accordingly, when the pull-tab 106 is pushed downward, the wedge 753 comes to be caught by the catch protrusion 756 of the wedge hook 754 such that the pull,-ab 106 is maintained in a downward state as shown in FIG. 75B.

Figure 76A:
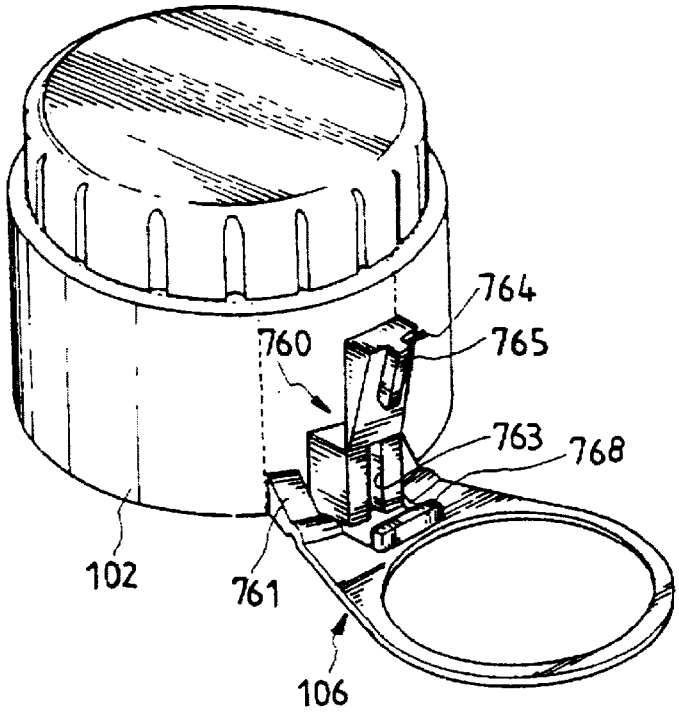
FIGS. 76A and 76B are perspective views of a modified example of the fourth embodiment of the present invention as shown in FIG. 50.
Figure 76B:
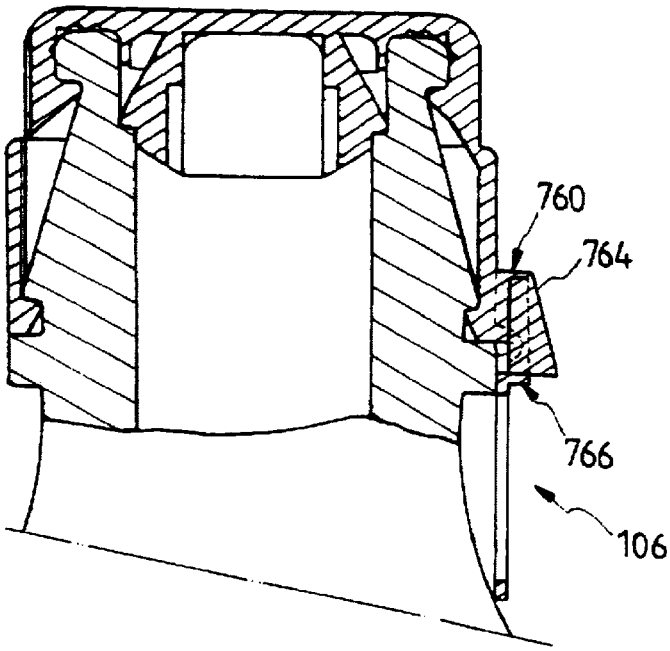

Referring to FIGS. 76A and 76B, there is shown another modified example of the fourth embodiment. As shown in FIG. 76A, a tab holder 766 is formed on the pull-tab 106 between supports 761. Also, a fixing member 760 is formed on the lower body 102 between the supports 761 of the pull-tab 106. The fixing member 760 includes a gap 763 and an extension 764, having an insert 765, pivotably formed on an upper end of the fixing member 760.

Accordingly, after the pull-tab 106 is pushed downward and the insert 76D of the extension 764 placed in the gap 763, the pull-tab 106 is maintained in a downward state as shown in FIG. 76B.

Figure 77A:
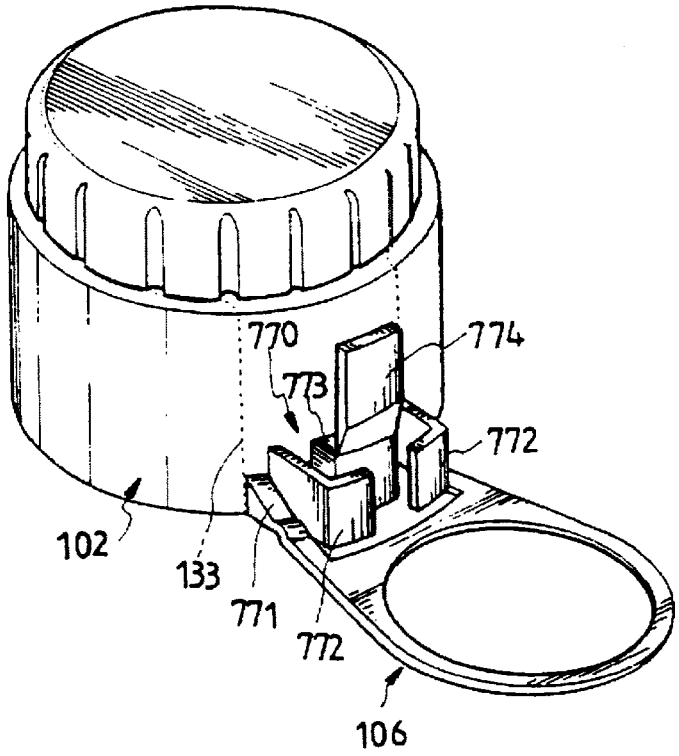
FIGS. 77A and 77B are perspective views of a modified example of the fourth embodiment of the present invention as shown in FIG. 50.
Figure 77B:
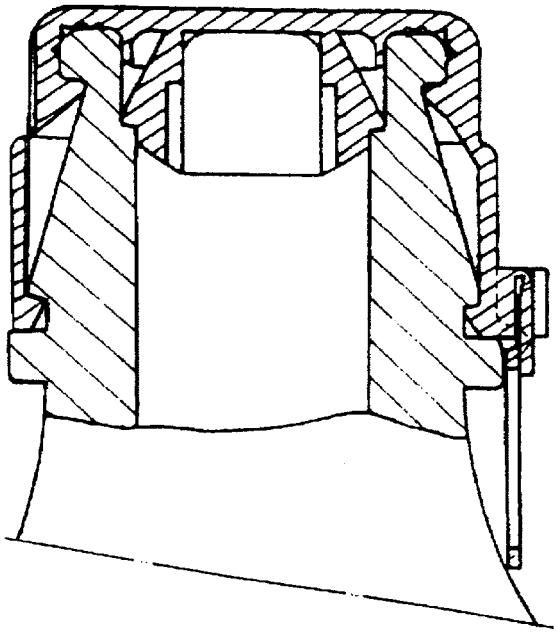

Another modified example is shown in FIGS. 77A and 77B. As shown in FIG. 77A, a fixing member 770 is formed on the lower body 102 between supports 771 of the pull-tab 106. The fixing member 770 includes hooks 772 formed between the supports 771 of the pull-tab 106, a block 773 fixed to the lower body 102 between the hooks 772, and a catch flap 774 pivotably formed on an upper portion of the block 773.

Accordingly, after the pull-tab 106 is pushed downward and the catch flap 774 of the block 773 is pivoted down and forced between the hooks 772 of the fixing member 770, the pull-tab 106 is maintained in a downward state as shown in FIG. 77B by being held by the catch flap 774.

Figure 78:
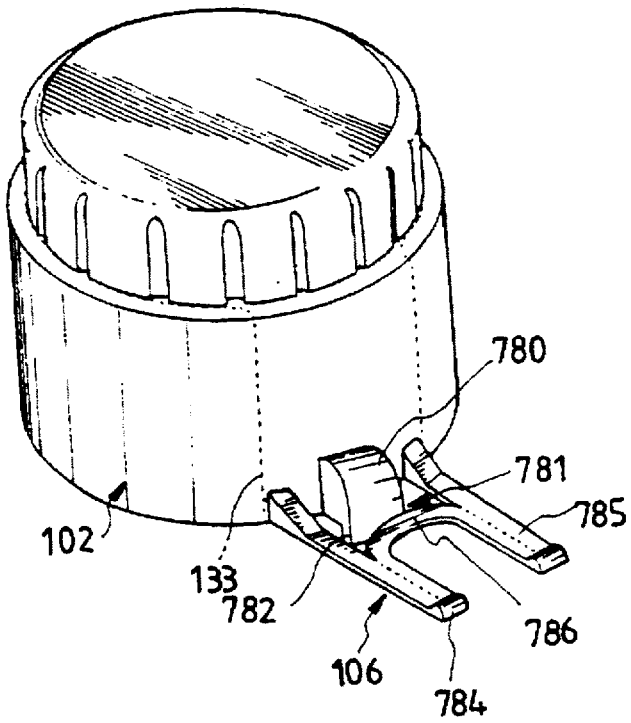
FIG. 78 is a perspective view of a modified example of the fourth embodiment of the present as shown in FIG. 50.

There is shown another modified example of the fourth embodiment in FIG. 78. As shown in the drawing, the pull-tab 106 in this modified example is formed on the lower body 102 between the vertical cutting lines 133 having formed a finger hole 781. Reinforcements 784 are provided on an outside end of the pull-tab 106 and a U-shaped finger grip 786 is formed extending inward from the reinforcements. Also, a fixing member 780 is formed on the lower body 102 in a center of where the pull-tab 106 is fixed to the lower body 102. The fixing member 780 includes a catch lip 782 which, when the pull-tab 106 is pushed in a downward direction, maintains the pull-tab 106 in a downward state by catching on the finger grip 786. Tab cutting lines 785 are also provide between the finger grip 786 and the pull-tab 106 which cut when the finger grip 786 is pulled to increase the sized of the finger hole 781.

Figure 79:
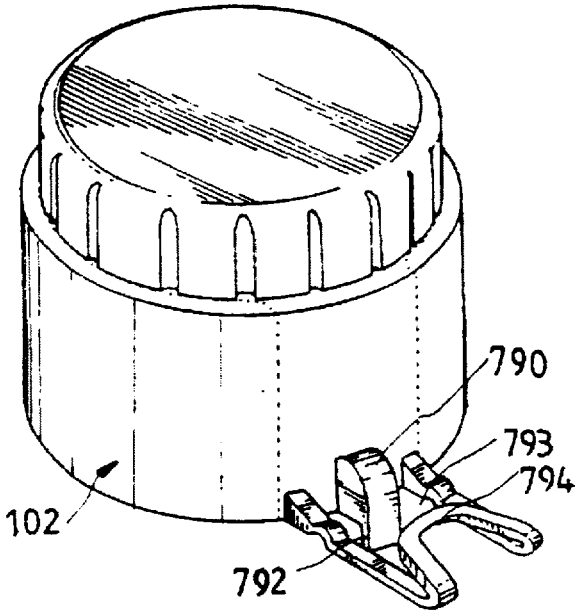
FIG. 79 is a perspective view of a modified example of the fourth embodiment of the present as shown in FIG. 50.

Another modified example of the fourth embodiment is shown in FIG. 79. This modified example of almost identical to that shown in FIG. 78. Here, however, a finger grip 794 of the pull-tab 106 is formed folded over toward the lower body 102 such that it pulls away from the lower body 102 when pulled to increase the size of a finger hole 793. The finger grip 794 catches on a catch lip 792 of a fixing member 790 as in the above.

Figure 80A:
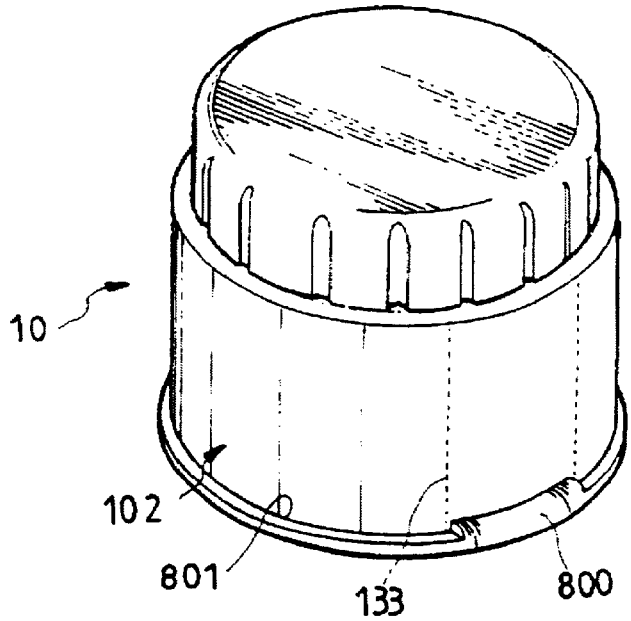
FIGS. 80A and 80B are perspective views of a modified example of the fourth embodiment of the present invention as shown in FIG. 50.
Figure 80B:
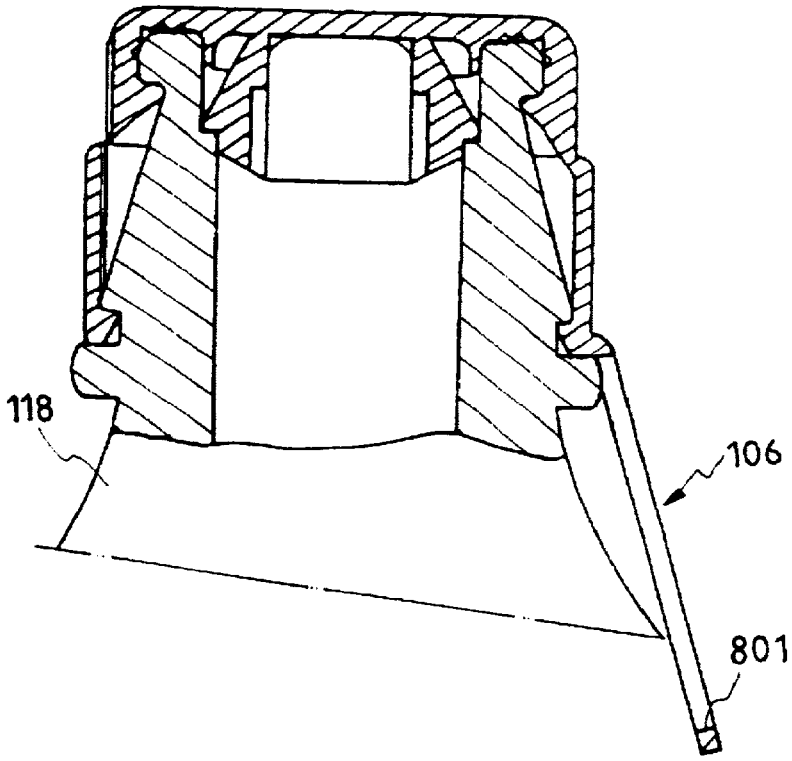

Referring to FIGS. 80A and 80B, there is shown another modified example of the fourth embodiment. As shown in FIG. 80A, the pull-tab 106 is formed connected to the lower body 102 between the vertical cutting lines 133 through a connector 800. The remainder of the pull-tab 106 provides a finger hole 801 and is formed unconnected from the lower body 102 around a bottom circumference of the same.

Accordingly, before the bottle cap 10 is placed on the bottle (not shown) in the capping process, the pull-tab 106 is pulled downward and in a direction toward the connector 800 so that the finger hole 801 is formed on one side of the bottle 118 in a downward state as shown in FIG. 80B.

Figure 81A:
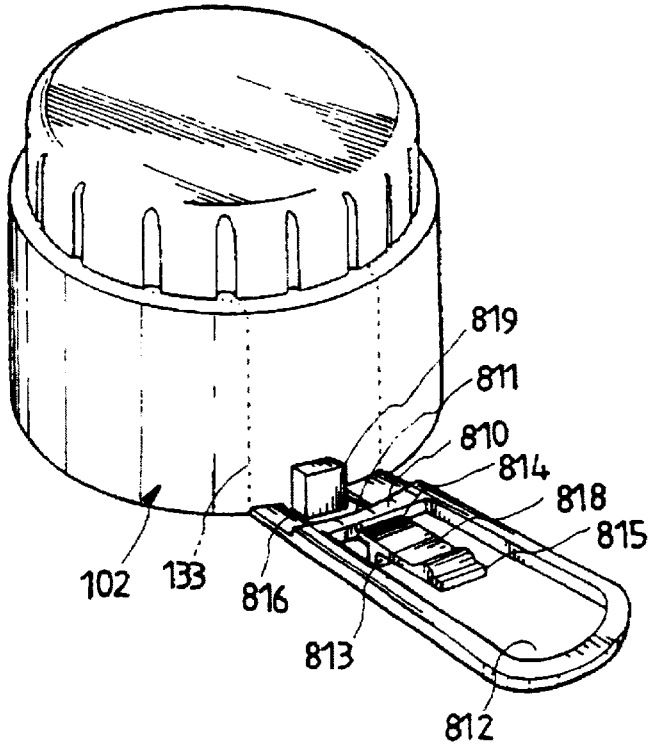
FIGS. 81A, 81B, and 81C are perspective views of a modified example of the fourth embodiment of the present invention as shown in FIG. 50.
Figure 81B:
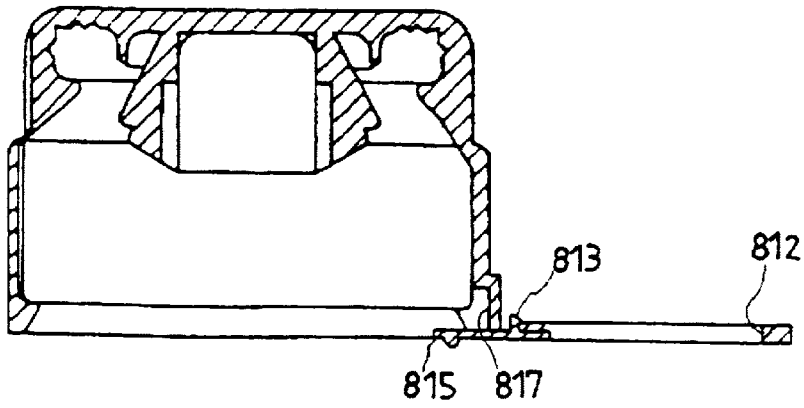
Figure 81C:
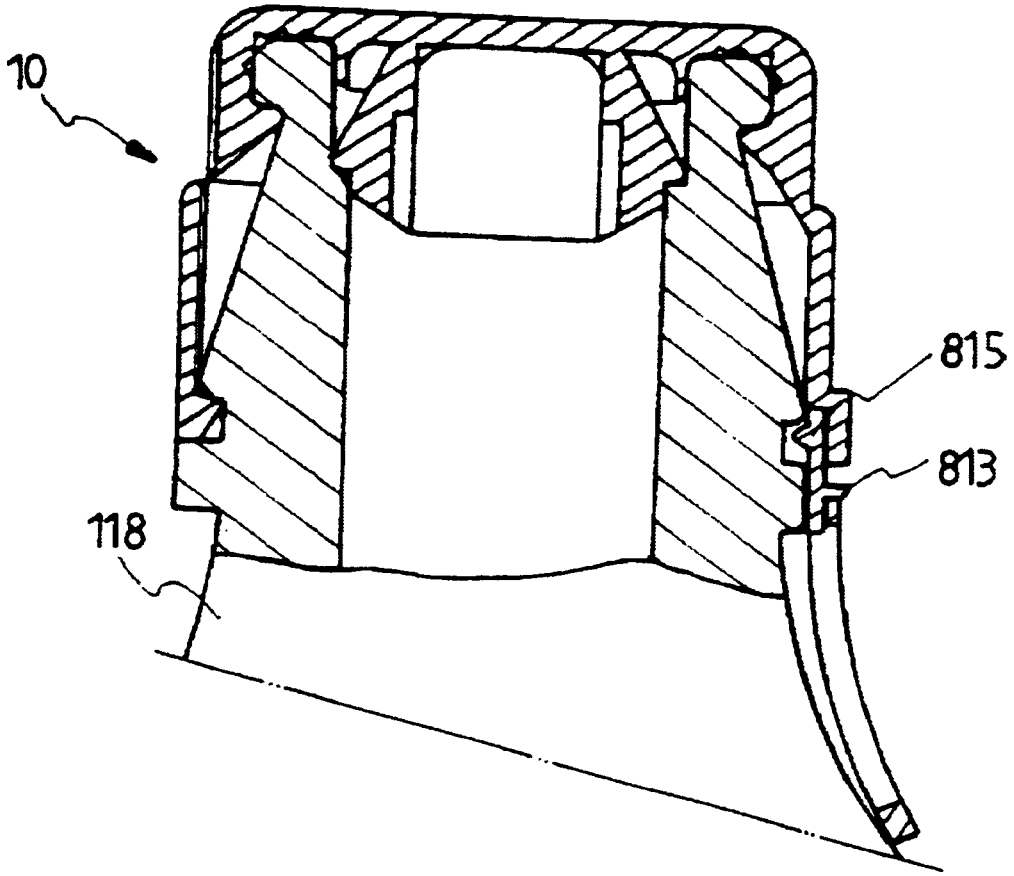

Another modified example is illustrated in FIGS. 81A, 81B, and 81C. Referring to FIG. 81A, the pull-tab 106 is fixed to the lower body 102 through connectors 816, and a bridge 810 is formed between the connectors 816. The bridge 810 and the connectors 816 define a cavity 811. Integrally connected to the bridge 810 and extending toward a free end of the pull-tab 106 in a finger hole 812 is a holder 818. The holder 818 is comprised of a fold portion 814, a fixing protrusion 813, and a lead insert 815. Also, an extension 819, defining a hole 817 inside of which the lead insert 815 can be placed, is formed on the lower body 102 between the connectors 816 of the pull-tab 106.

When the holder 818 is folded down and around the bridge 810, the fixing protrusion 813 is positioned in the cavity 811 and the lead insert 815 is positioned extending past the lower body 102 as shown in FIG. 81B. In this state, if the bottle cap 10 is placed on the bottle, the lead insert 815 automatically comes to be placed in the hole 817 of the extension 819 such that the pull-tab 106 is maintained in a downward state as shown in FIG. 81C.

Figure 82A:
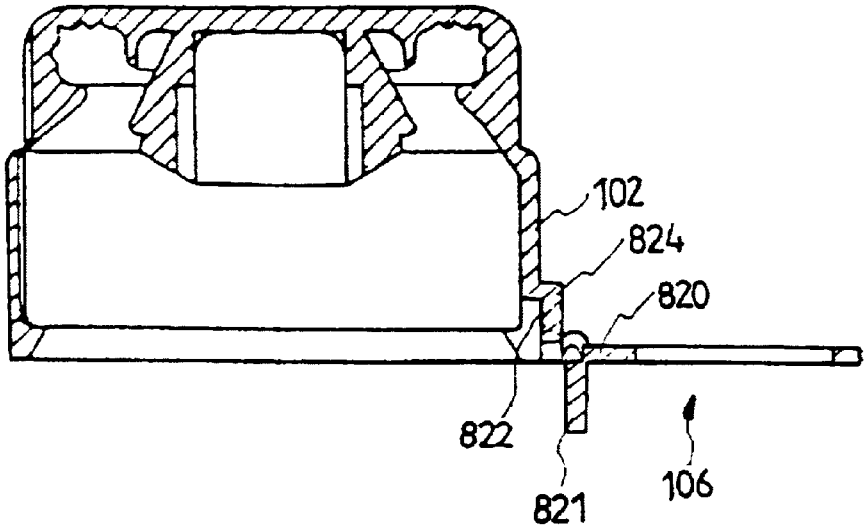
FIGS. 82A, 82B, and 82C are perspective views of a modified example of the fourth embodiment of the present invention as shown in FIG. 50.
Figure 82B:
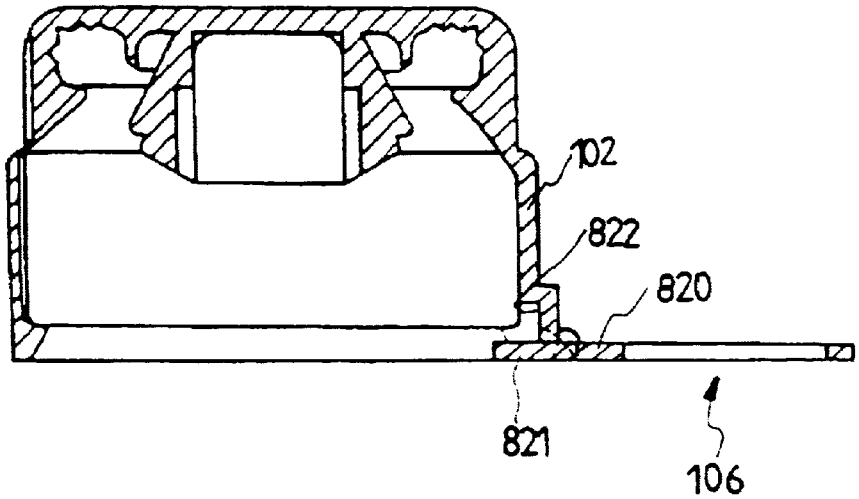
Figure 82C:
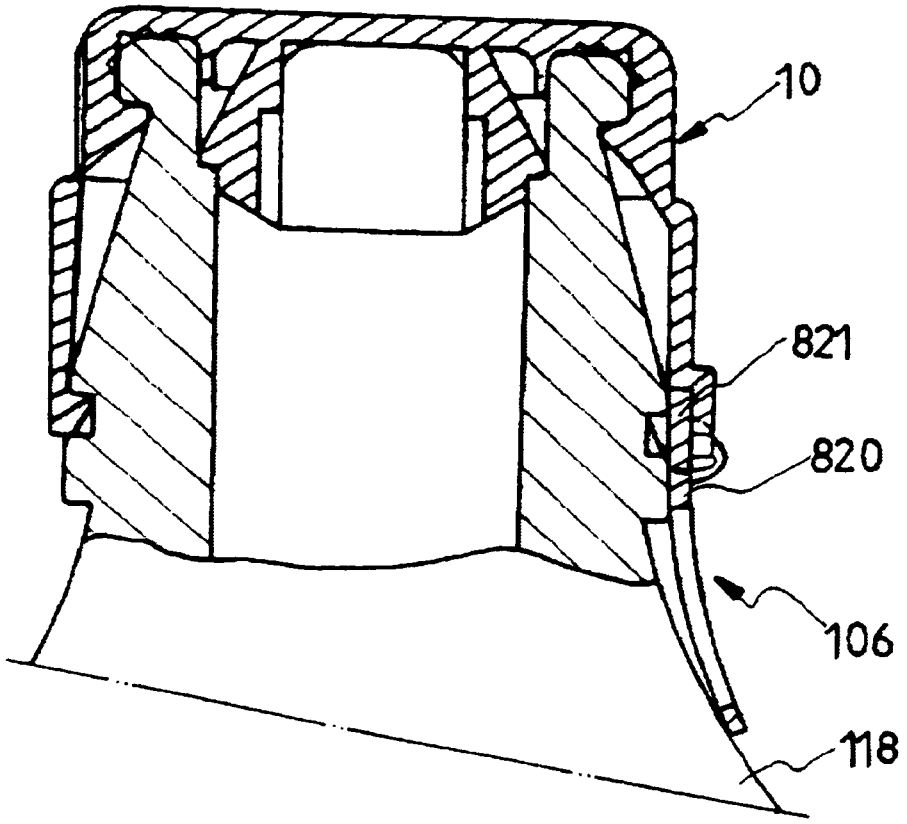

There is shown another modified example of the fourth embodiment in FIGS. 82A, 82B, and 82C. In this modified example, the pull-tab 106 is formed almost identically to that shown in FIGS. 75 and 76. However, a catch protrusion 821 is fixed to the pull-tab 106 in a downward direction between connectors 820, and an extension 824, defining a hole 822 inside of which the catch protrusion 821 can be placed, is formed on the lower body 102 between the connectors 820 of the pull-tab 106.

Accordingly, as shown in FIG. 82B, when the catch protrusion 821 is spread so that it is on an equal plane with the rest of the pull-tab 106, the catch protrusion 821 extends past the lower body 102. In this state, if the bottle cap 10 is placed on the bottle 118, the catch protrusion 821 is forced upward into the hole 822 of the extension 824 such that the pull-tab 106 is maintained in a downward state as shown in FIG. 83B.

Figure 83A:
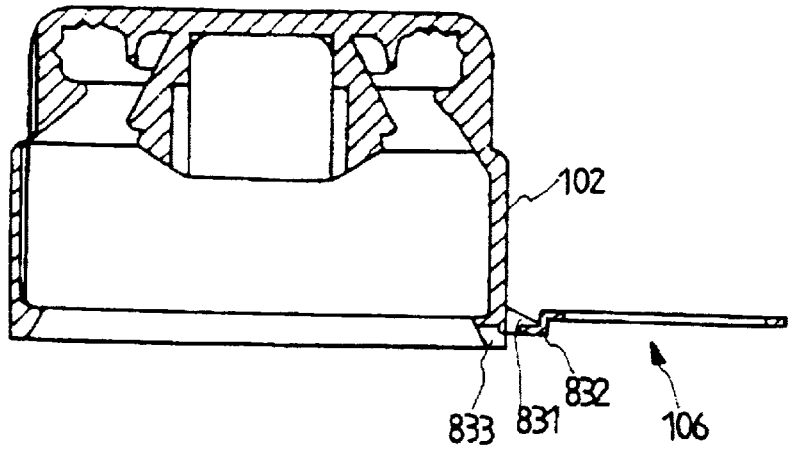
FIGS. 83A and 83B are perspective views of a modified example of the fourth embodiment of the present invention as shown in FIG. 50.
Figure 83B:
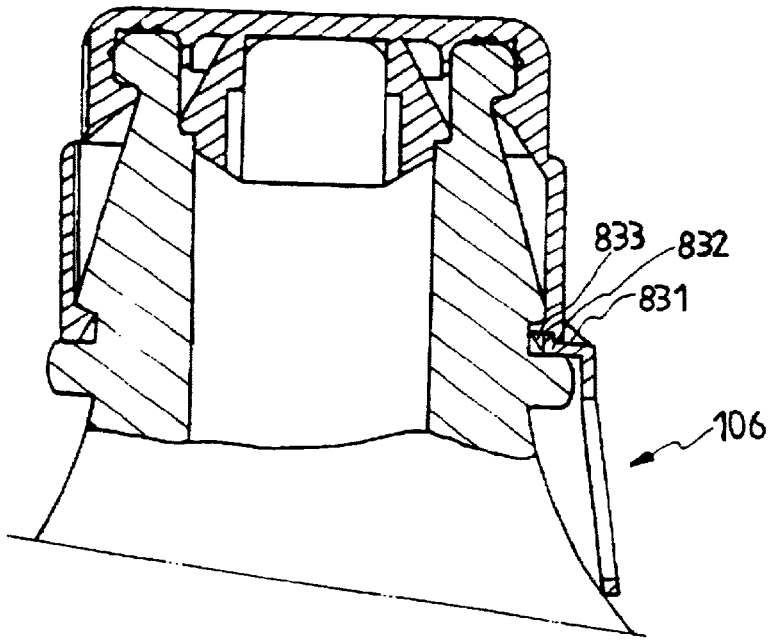

There is shown another modified example of the fourth embodiment in FIGS. 83A and 83B. The pull-tab 106 in this modified example is connected to the bottom portion of the lower body 102 between the vertical cutting lines (not shown) through supports 831. A catch protrusion 832 is formed between the supports 831 extending toward the lower body 102, and a catch groove 833 is formed on the bottom of the lower body 102 in a position corresponding to the catch protrusion 832.

In the above, when the pull-tab 106 is pushed in a downward position, the catch protrusion 832 is inserted in the catch groove 833 such that the pull-tab 106 is maintained in a downward state.

Figure 84A:
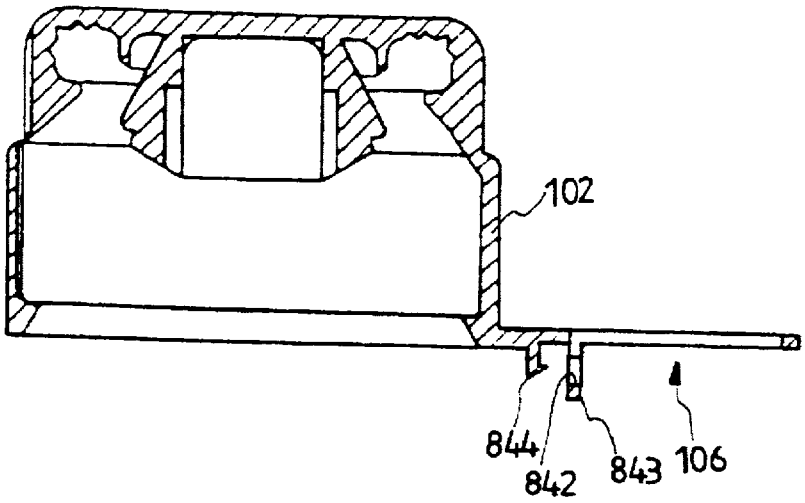
FIGS. 84A and 84B are perspective views of a modified example of the fourth embodiment of the present invention as shown in FIG. 50.
Figure 84B:
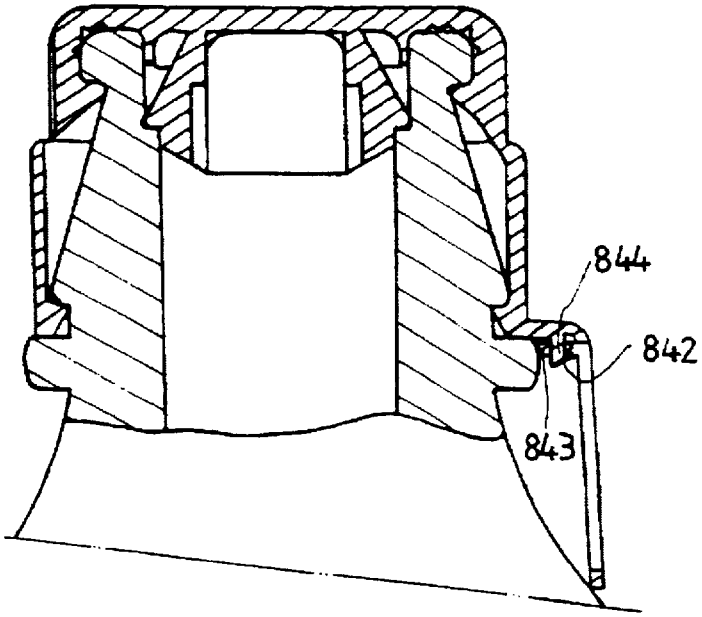

Referring to FIGS. 84A and 84B, another modified example of the fourth embodiment is illustrated. As shown in FIG. 84A, the pull-tab 106 is again fixed to the lower body 102 between the vertical cutting lines (not shown) through supports 841. A catch protrusion 843 having a hole 842 is formed extending from the pull-tab 106, and at a predetermined distance from the catch protrusion 843 is formed a hook 844 also formed extending downward.

Accordingly, when the pull-tab 106 is pushed downward, a portion between the catch protrusion 843 and the hook 844 bends and the latter is inserted in the former as shown in FIG. 84B such that the pull-tab 106 is maintained in a downward position.

Figure 85A:
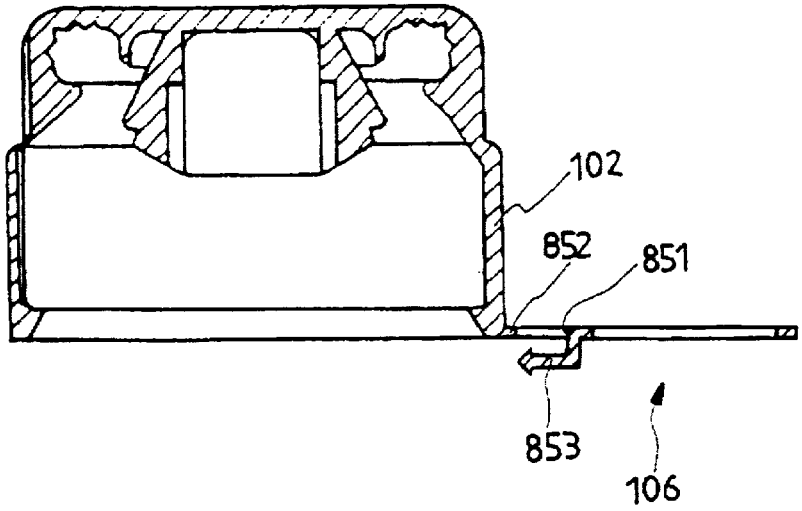
FIGS. 85A and 85B are perspective views of a modified example of the fourth embodiment of the present invention as shown in FIG. 50.
Figure 85B:
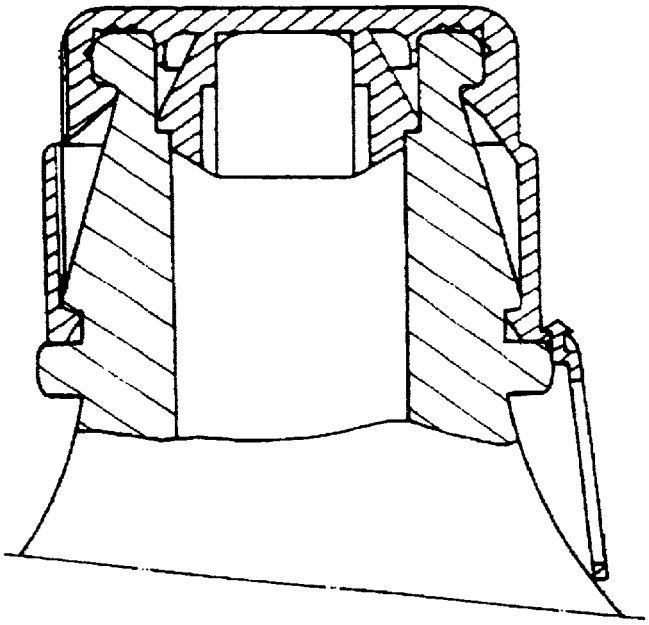

Another modified example of the fourth embodiment is illustrated in FIGS. 85A and 85B. A support 852 fixes the pull-tab 106 to the lower body 102 between the vertical cutting lines (not shown) also in this modified example. A fixing hole 851 is formed in the support 852 and a catch protrusion 853 is provided extending downward next to the fixing hole 851 then, at a right angle, extending toward the lower body 102.

Accordingly, when the pull-tab 106 is pushed downward, the catch protrusion 853 is caught in the fixing hole 851 such that the pull-tab 106 is maintained in a downward state as shown in FIG. 85B.

Figure 86A:
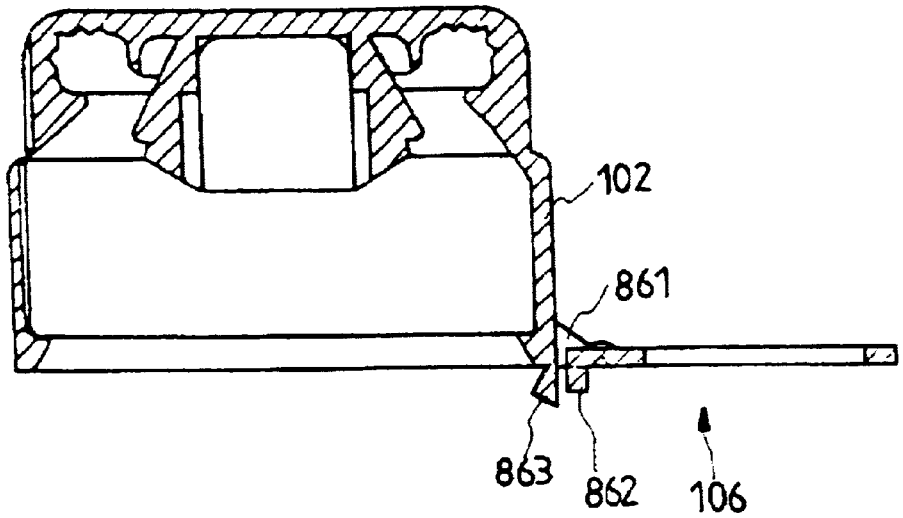
FIGS. 86A and 86B are perspective views of a modified example of the fourth embodiment of the present invention as shown in FIG. 50.
Figure 86B:
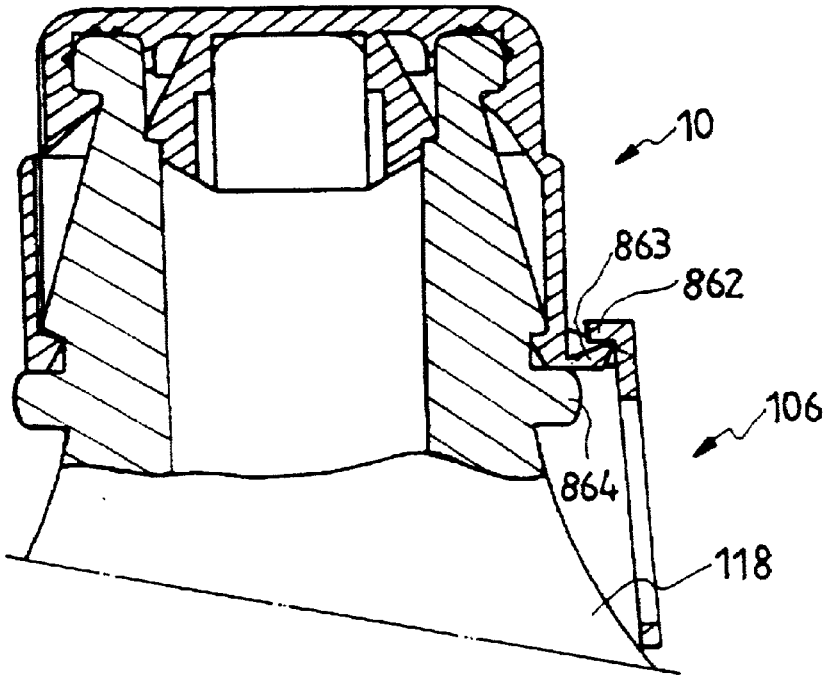

FIGS. 86A and 86B illustrate another modified example of the fourth embodiment. As shown in FIG. 86A, the pull-tab 106 is fixed to the lower body 102 through connectors 861. A catch hook 862 is formed protruding downward from the pull-tab 106 between the connectors 861. Also, a fixing protrusion 863 is pivotably formed on the bottom of the lower body 102 such that the fixing protrusion 863, when forced upward, makes contact with the catch hook 862 to force the same to move up past the connectors 861.

As shown in FIG. 86B, during the capping process, when the bottle cap 10 is placed on the bottle 188, a lower lip 864 of the bottle 118 forces the fixing protrusion 863 upward which, in turn, pushes the catch hook 862 to be in an upward state such that the pull-tab 106 is maintained in the state shown in the drawing.

Figure 87A:
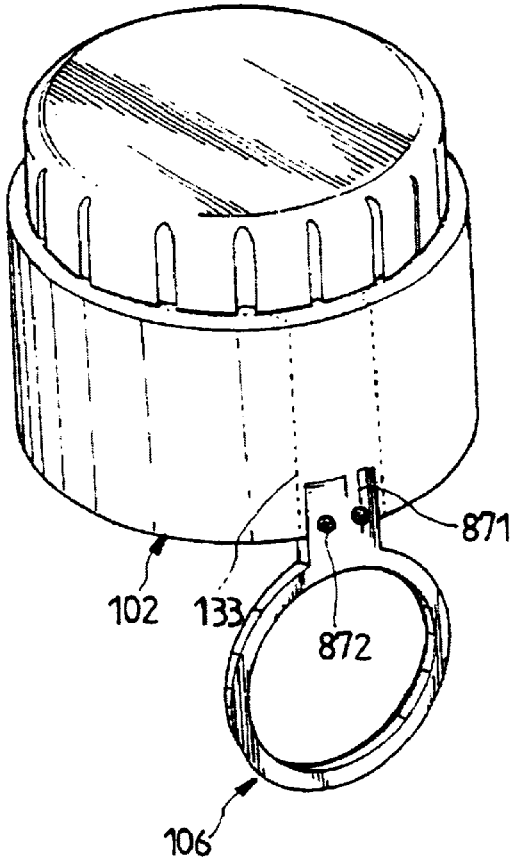
FIGS. 87A and 87B are perspective views of a modified example of the fourth embodiment of the present invention as shown in FIG. 50.
Figure 87B:
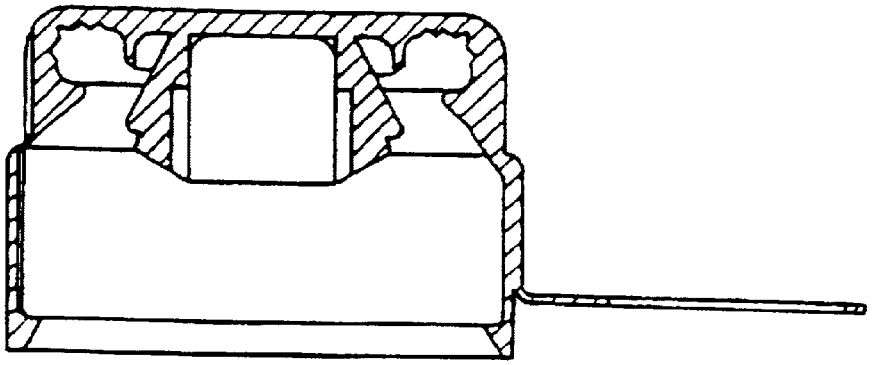

Another modified example is shown in FIGS. 87A and 87B. Referring to FIG. 87A, the pull-tab 106 is integrally fixed to the lower body 102 in a downward state and between the vertical cutting lines 133 through a fixing flap 871. The fixing flap 871 is integrally connected to the lower body 102 on a top end, but on a lower end is attached to the lower body 102 through connection portions 872, fused to the lower body 102 using ultra-sonic waves. Accordingly, when the user pulls upward on the pull-tab 106, the connection portions 872 first detach from the lower body 102 such that the pull-tab 106 is in a state as shown in FIG. 87B.

Figure 88:
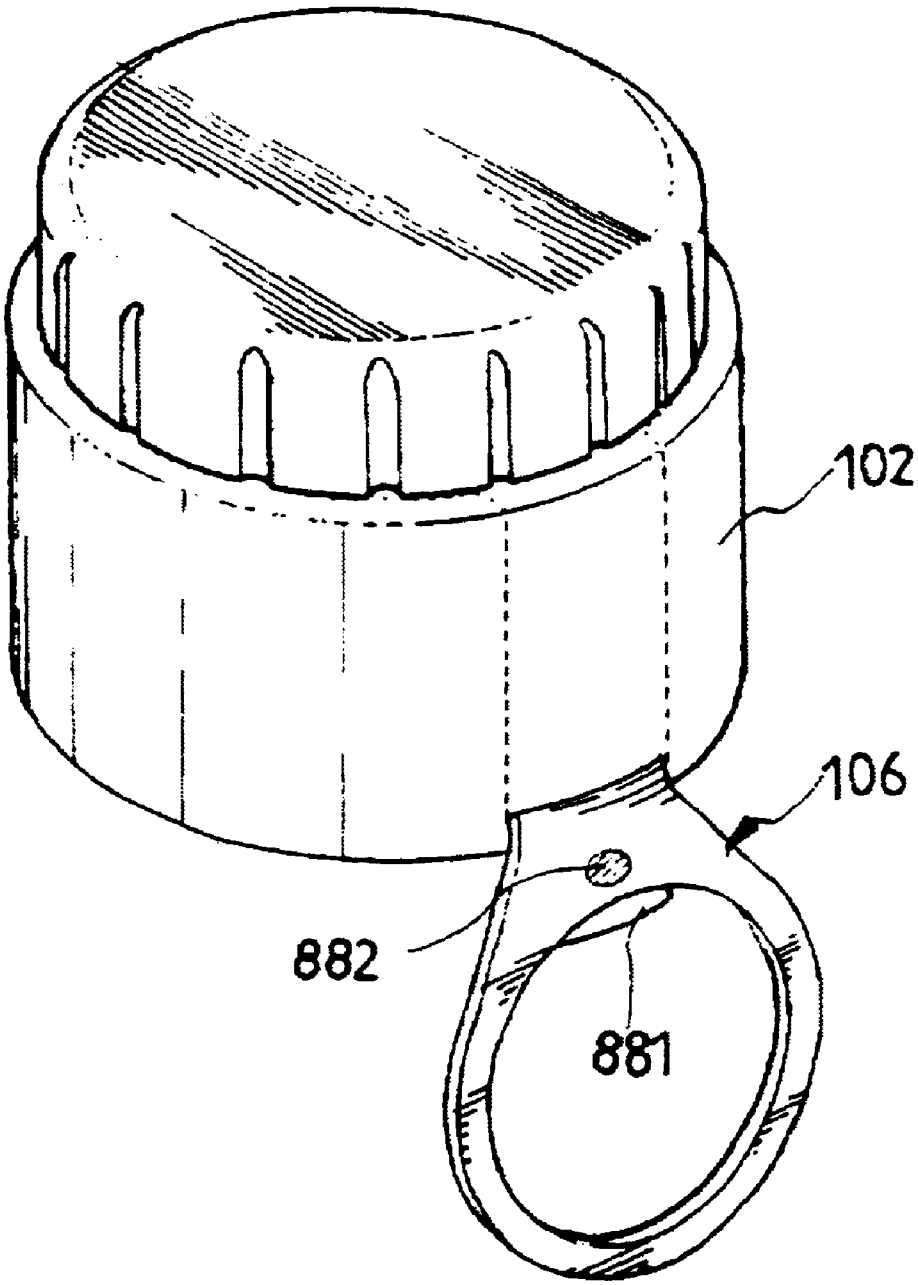
FIG. 88 is a perspective view of a modified example of the fourth embodiment of the present as shown in FIG. 50.

Another modified example of the fourth embodiment is shown in FIG. 88. Here, the pull-tab 106 is directly connected to the bottom end of the lower body 102. The pull-tab 106 is folded over a fixing plate 881, extending downward from the bottom of the lower body 102, and attached thereon through connection portion 882 fused through the use of ultra-sonic waves. As a result, the pull-tab 106 is maintained in a downward state.

Figure 89A:
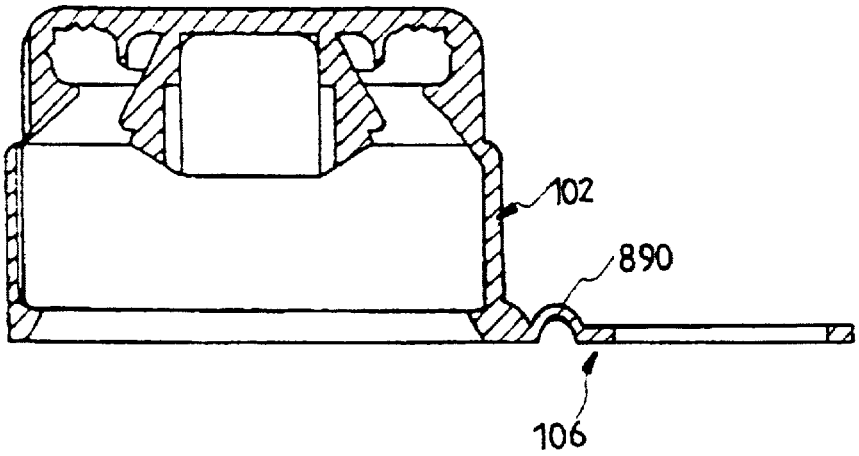
FIGS. 89A and 89B are perspective views of a modified example of the fourth embodiment of the present invention as shown in FIG. 50.
Figure 89B:
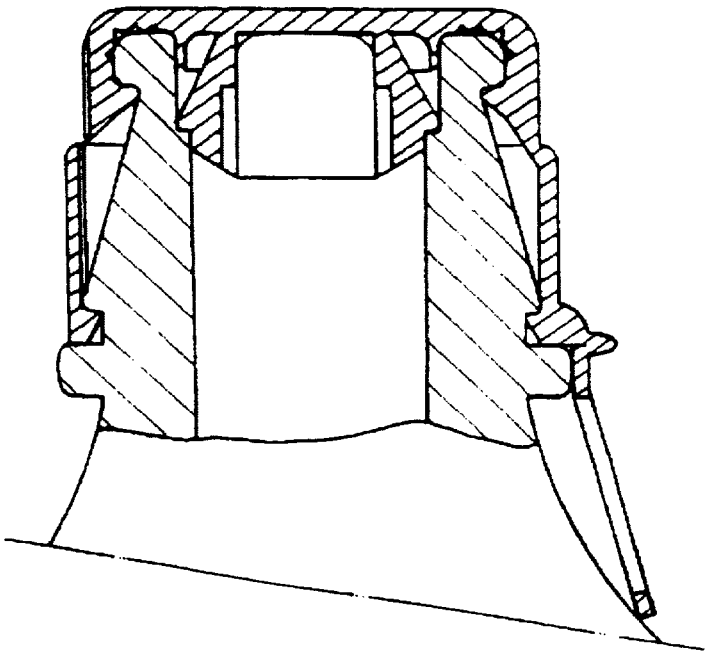

There is shown another modified example of the fourth embodiment in FIGS. 89A and 89B. As shown in the drawings, both sides of the pull-tab 106 next to a bending portion 890 are connected to each other to maintain the pull-tab 106 in a downward state as shown in FIG. 89B.

Figure 90A:
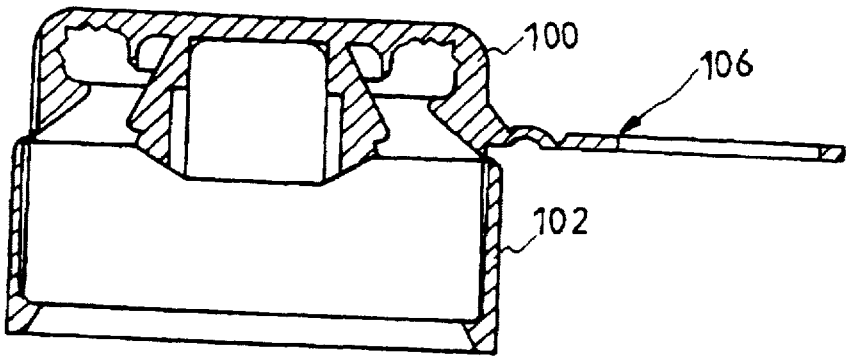
FIGS. 90A and 90B are perspective views of a modified example of the fourth embodiment of the present invention as shown in FIG. 50.
Figure 90B:
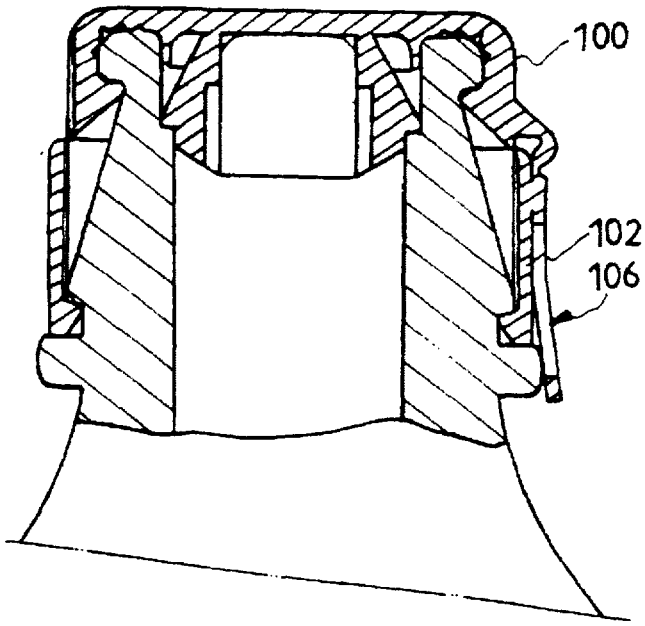

Referring to FIGS. 90A and 90B, there is shown another modified example of the fourth embodiment. As shown in FIG. 90A, the pull-tab 106 is integrally fixed to the lower part of the upper body 100, and an upper part of the pull-tab 106 is fixed to the lower body 102 through a connection portion (not shown), fused to the lower body 102 by the use of ultra-sonic waves. As a result, the pull-tab 106 is maintained in a downward state as shown in FIG. 90B.

Figure 91A:
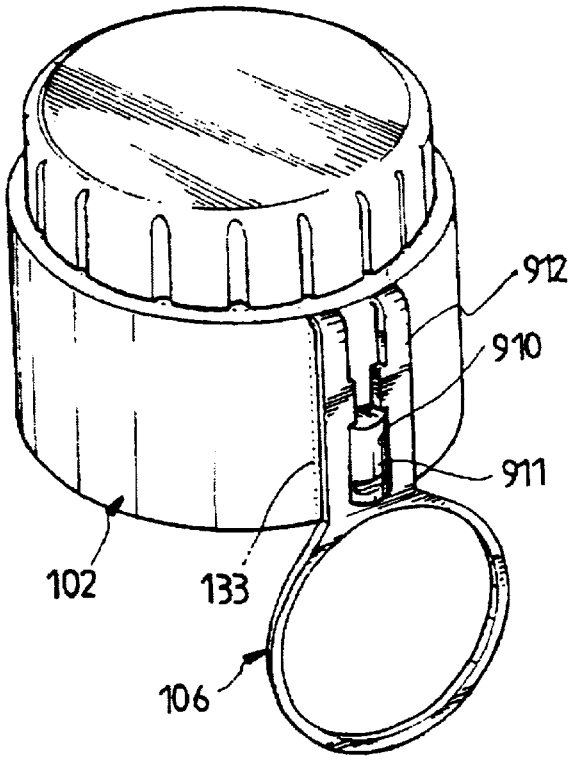
FIGS. 91A and 91B are perspective views of a modified example of the fourth embodiment of the present invention as shown in FIG. 50.
Figure 91B:
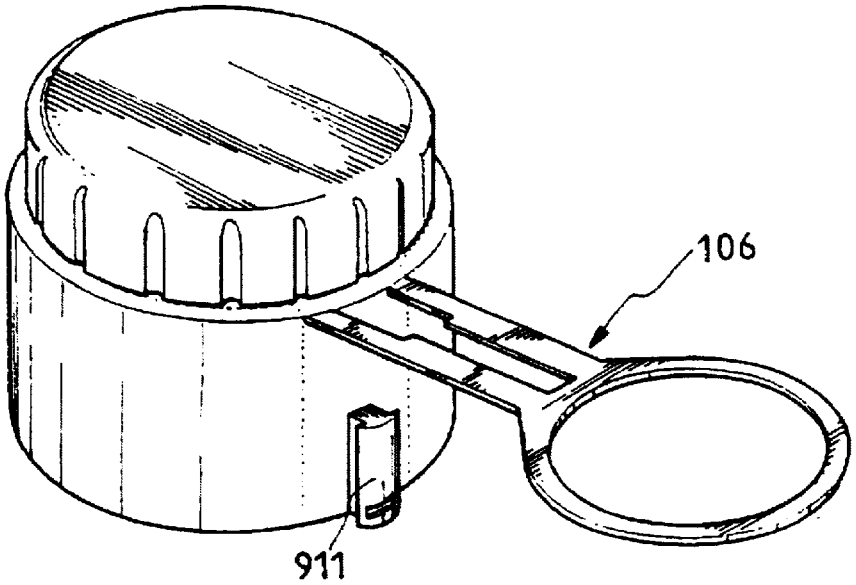

Another modified example of the fourth embodiment is shown in FIGS. 91A and 91B. As shown in FIG. 91A, the pull-tab 106 is fixed to the upper part of the lower body 102 between the vertical cutting lines 133. A catch groove 910 is formed over the length of a tab body 912. Also, fixing protrusion 911 is provided on a lower part of the lower body 102 to which the catch groove 910 of the pull-tab 106 is fixed. FIG. 91B shows the pull-tab 106 in a state released from the fixing protrusion 911.

Figure 92:
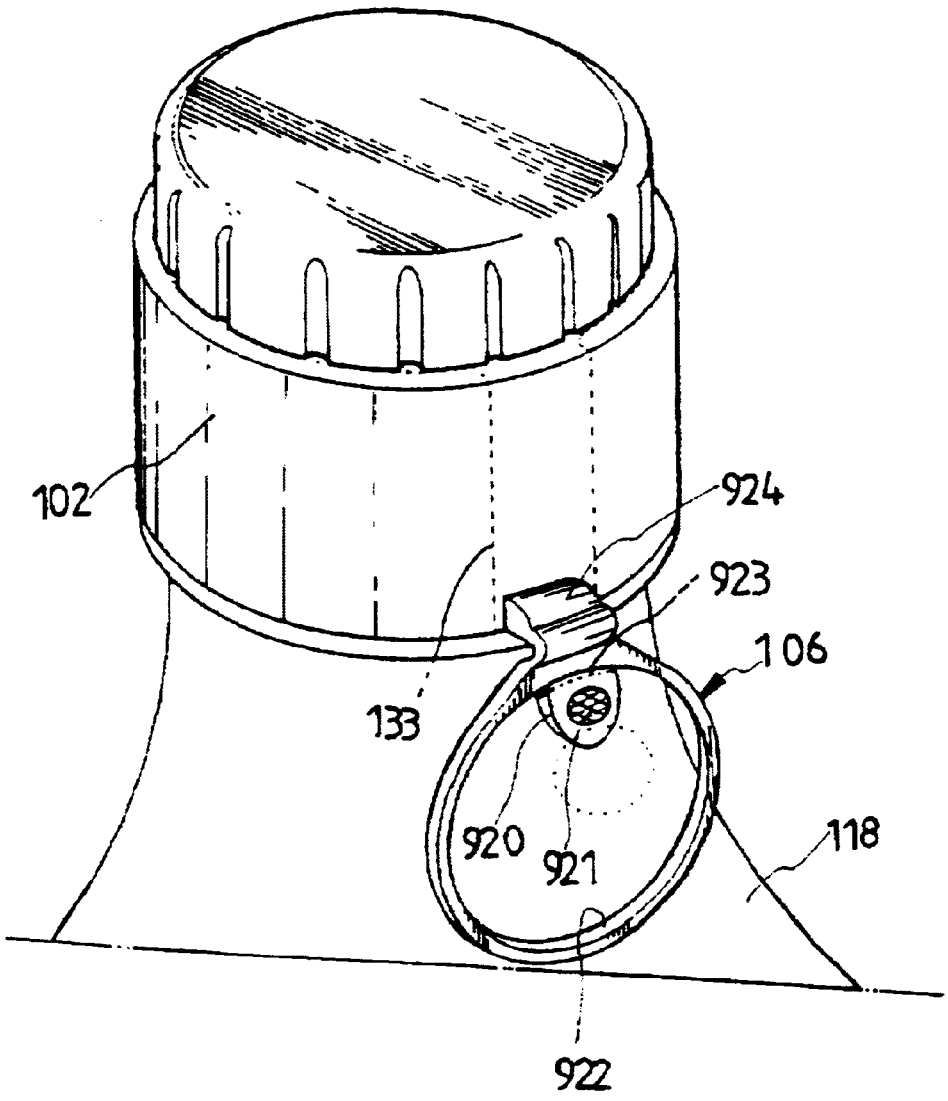
FIG. 92 is a perspective view of a modified example of the fourth embodiment of the present as shown in FIG. 50.
Figure 93:
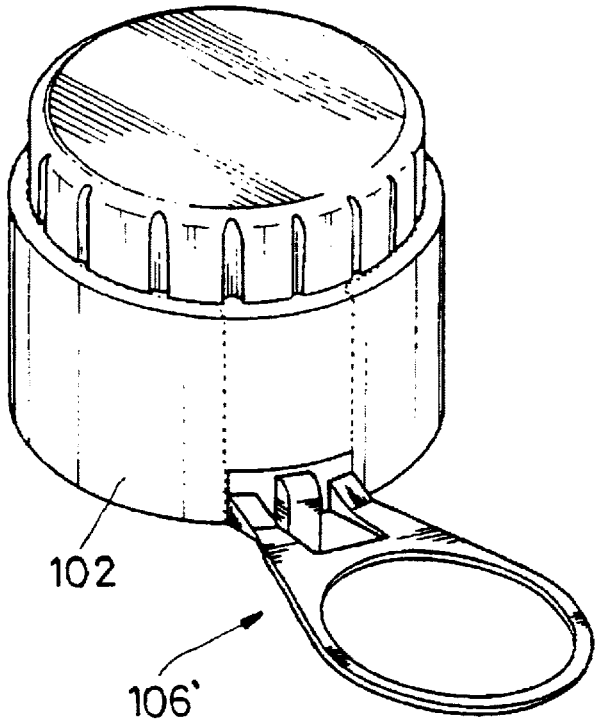
FIG. 93 is a perspective view of a bottle cap according to a fifth embodiment of the present.
Figure 94:
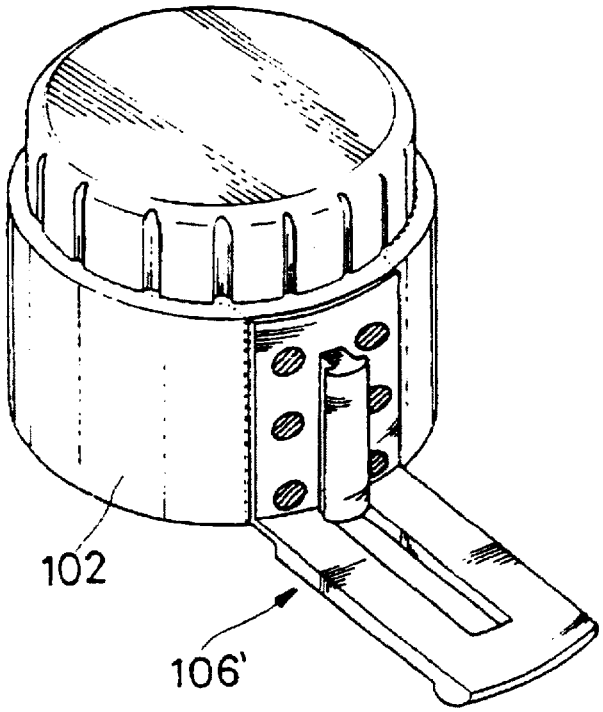
FIGS. 94 to 115 are perspective views of modified examples of the fifth embodiment of the present as shown in FIG. 93.
Figure 95:
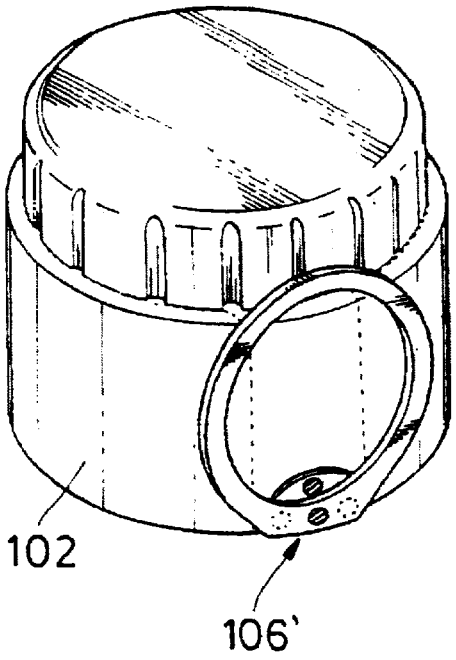
Figure 96:
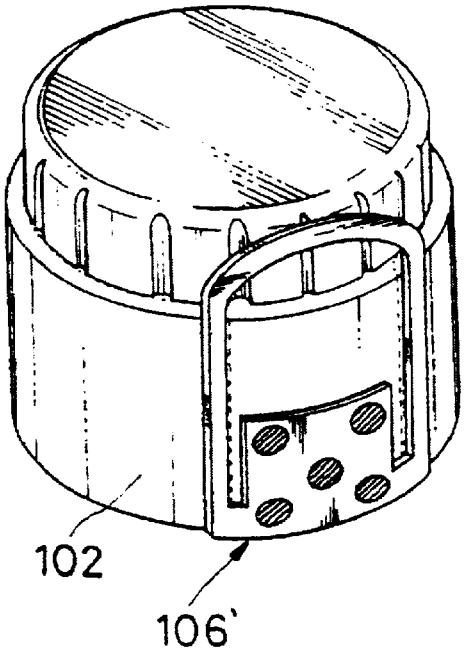
Figure 97:
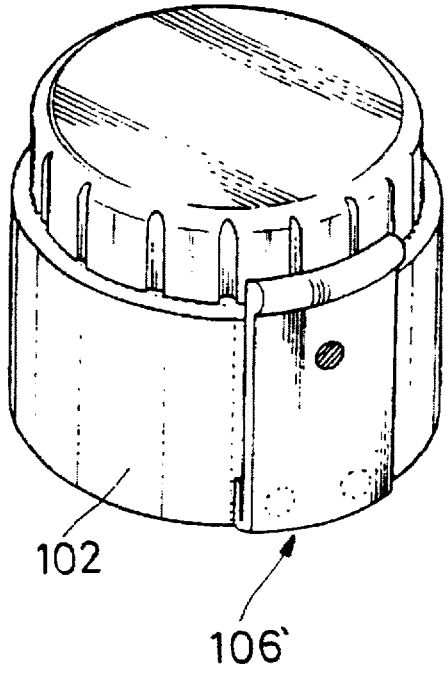
Figure 98:
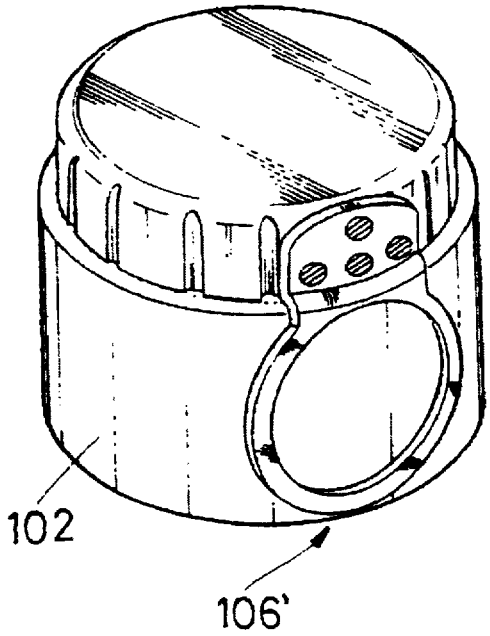
Figure 99:
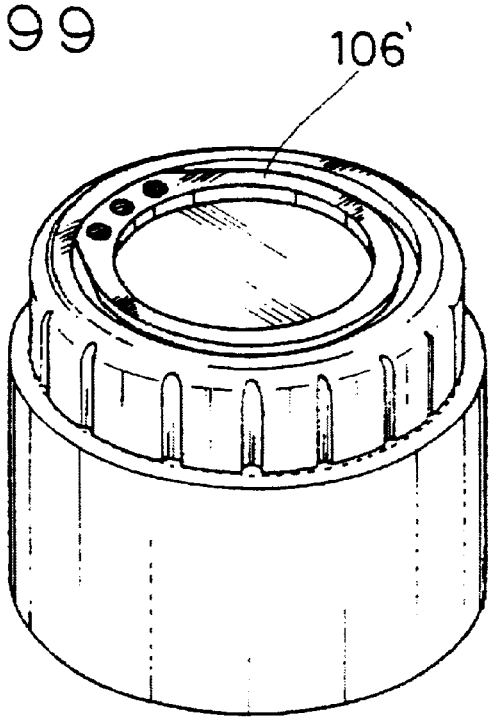
Figure 100:
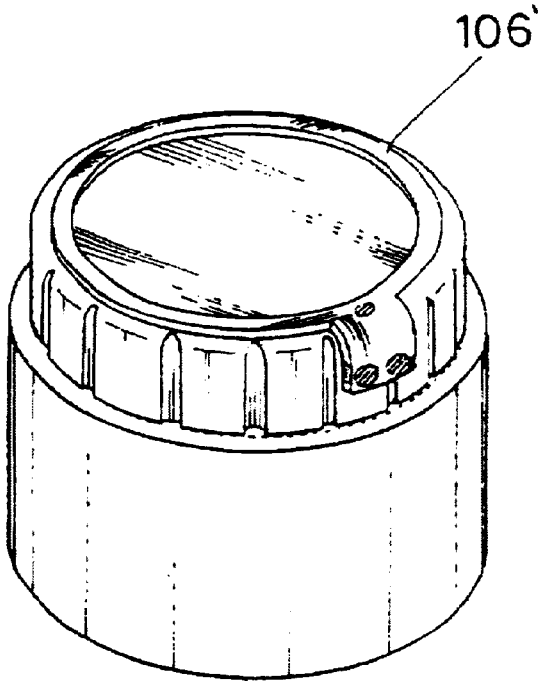
Figure 101:
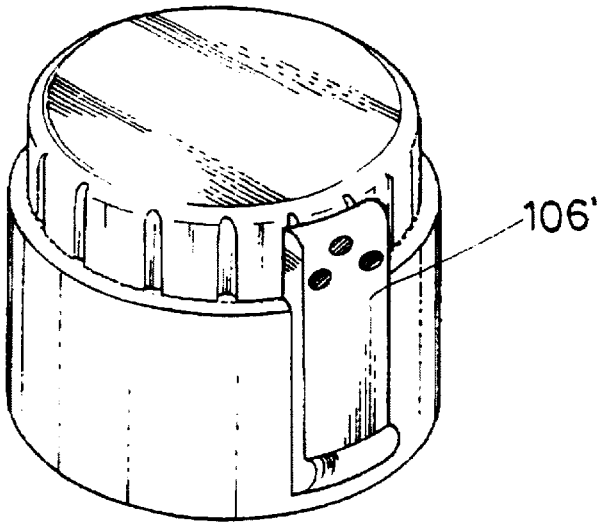
Figure 102:
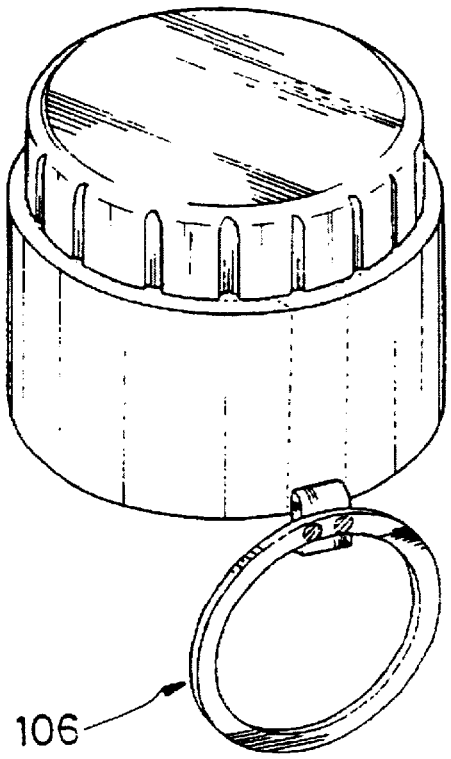
Figure 103:
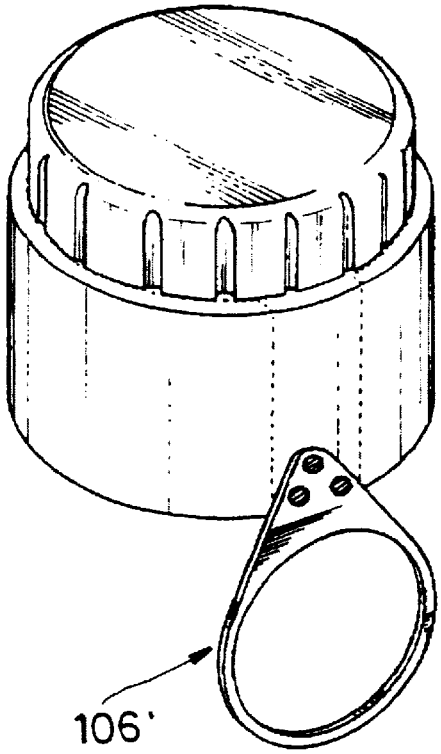
Figure 104:
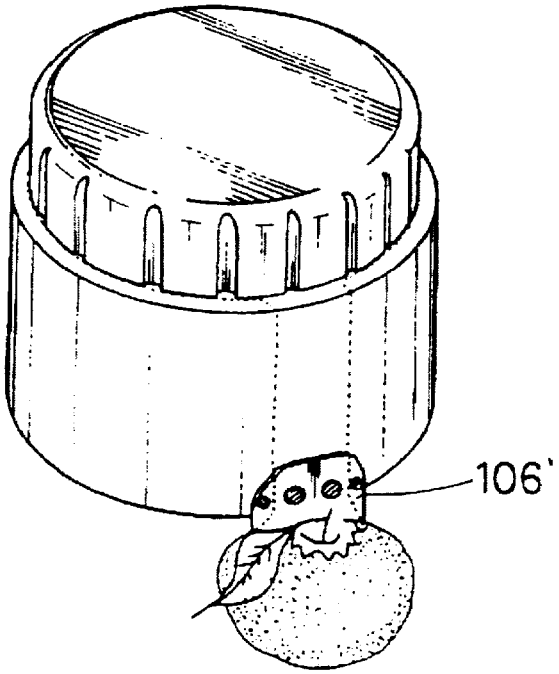
Figure 105:
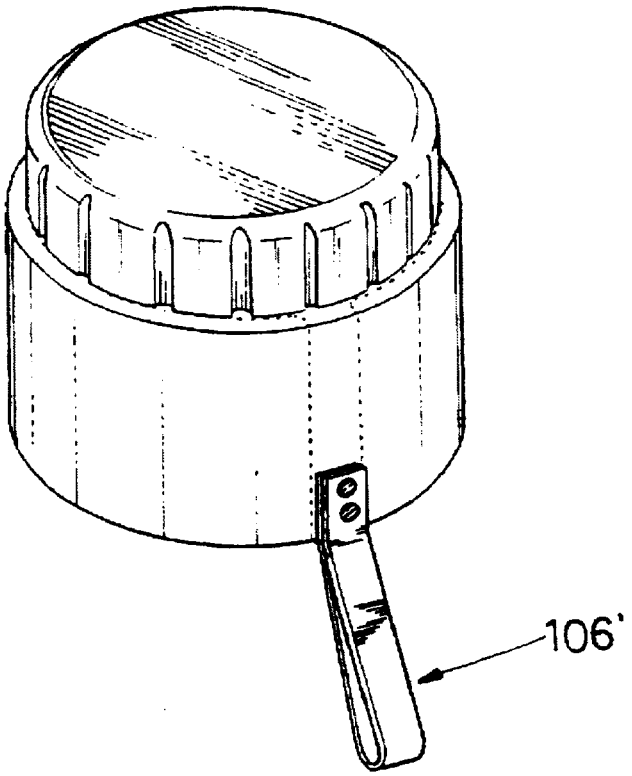
Figure 106:
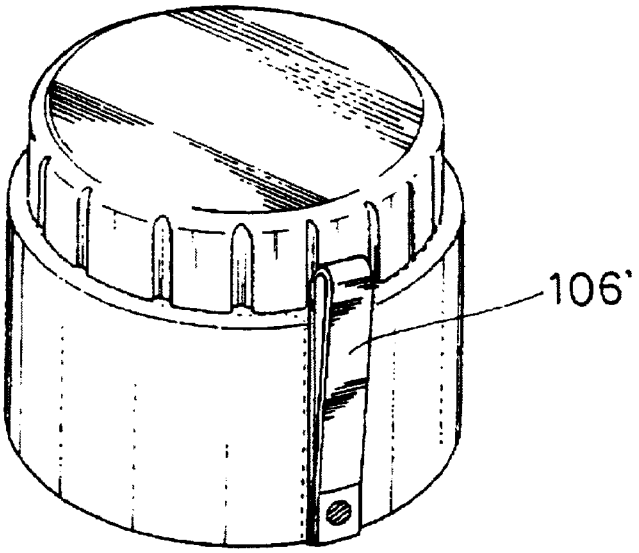

A final modified example of the fourth embodiment Es shown in FIG. 92. As shown in the drawing, the pull-tab 106 is integrally connected to the lower body 102 between the vertical cutting lines 133 through a connector 924. The connector 924 extends outward from the lower body 102 then bends downward to a finger hole 922 of the pull-tab 106. A fixing portion 920 is formed having a cutting line 923 at a top of the finger hole 922. In a, center of the fixing portion 920 is formed a connection portion 921 which is attached, using ultra-sonic waves, to the bottle 118 such that the pull-tab 106 is maintained in a downward state.

In the above first-fourth embodiments, the pull-tab is integrally fixed to either the upper or lower body. In the fifth embodiment, to be explained hereinafter, the pull-tab is separately manufactured and assembled on to either the upper or lower body.

FIGS. 93–106 illustrate examples of the fifth embodiment wherein the pull-tab 106 is manufactured separately and fixed to either the upper body, lower body, or upper surface of the upper body.

Figure 107A:
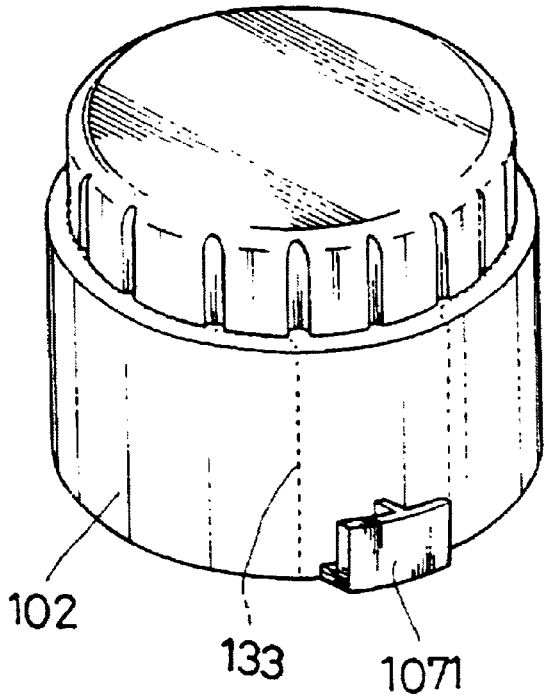
Figure 107B:
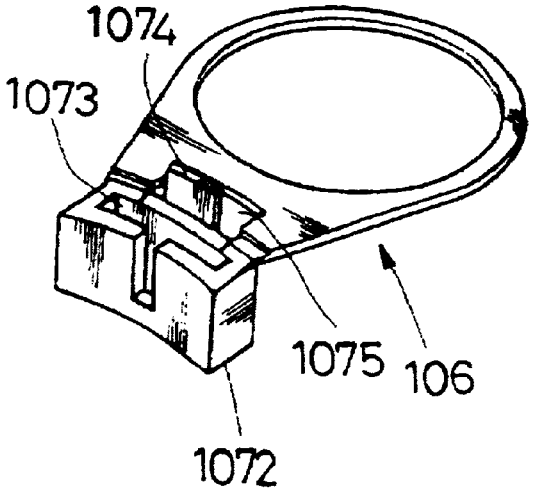
Figure 107C:
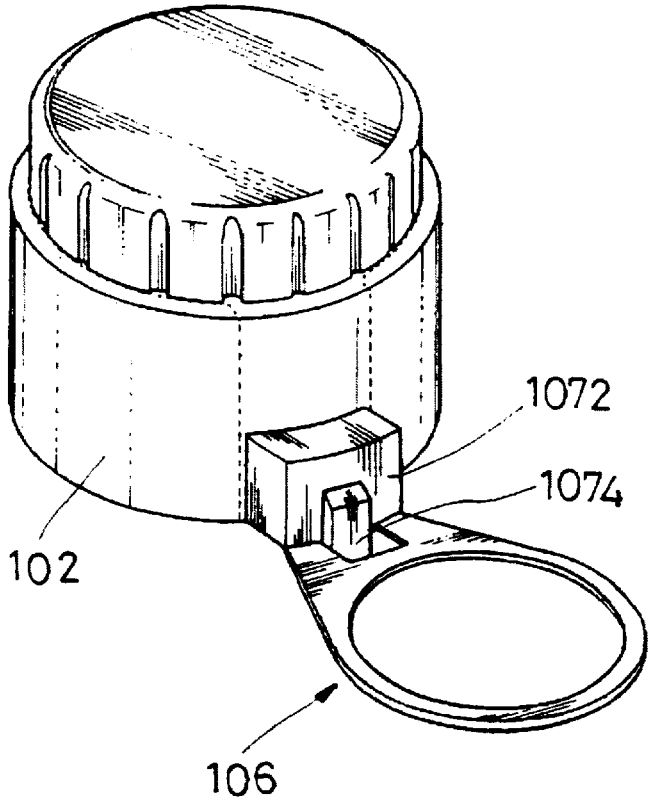
Figure 107D:
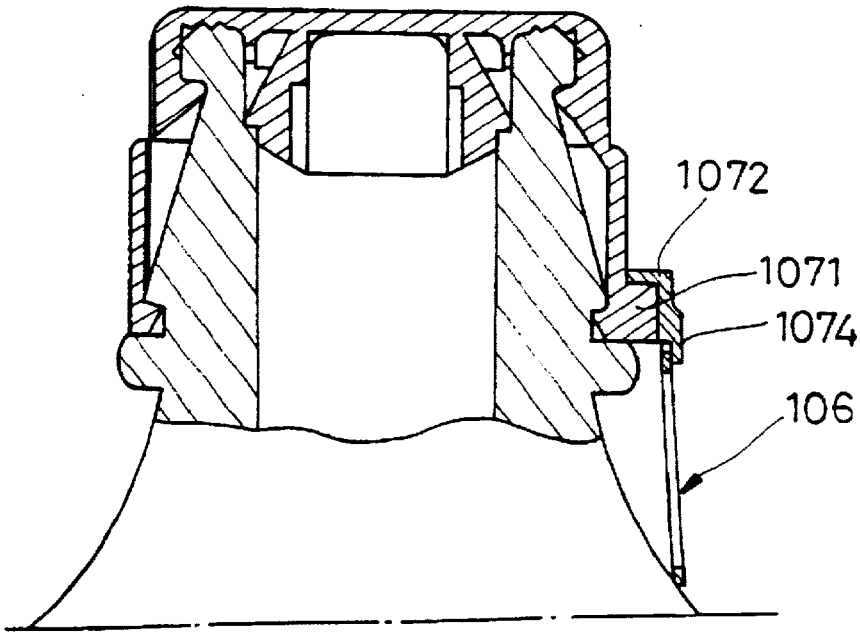
Figure 108A:
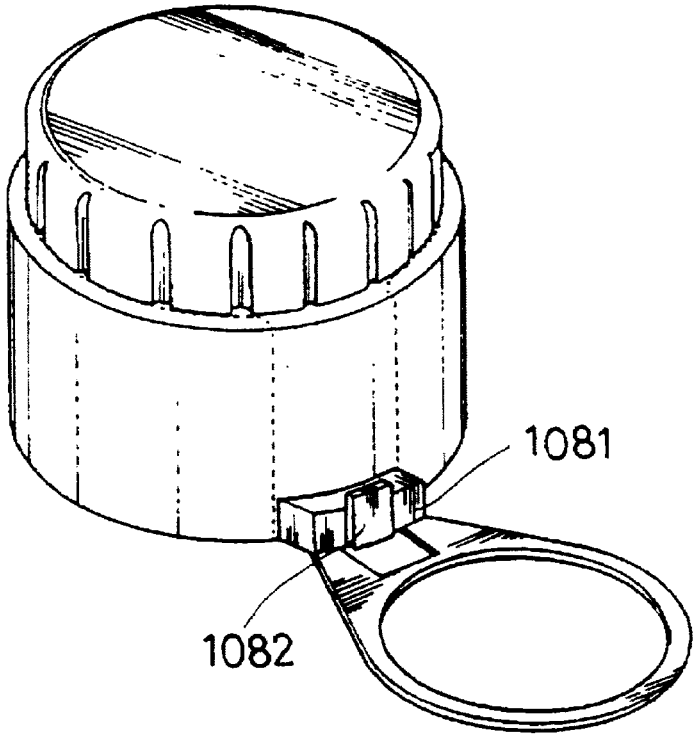
Figure 108B:
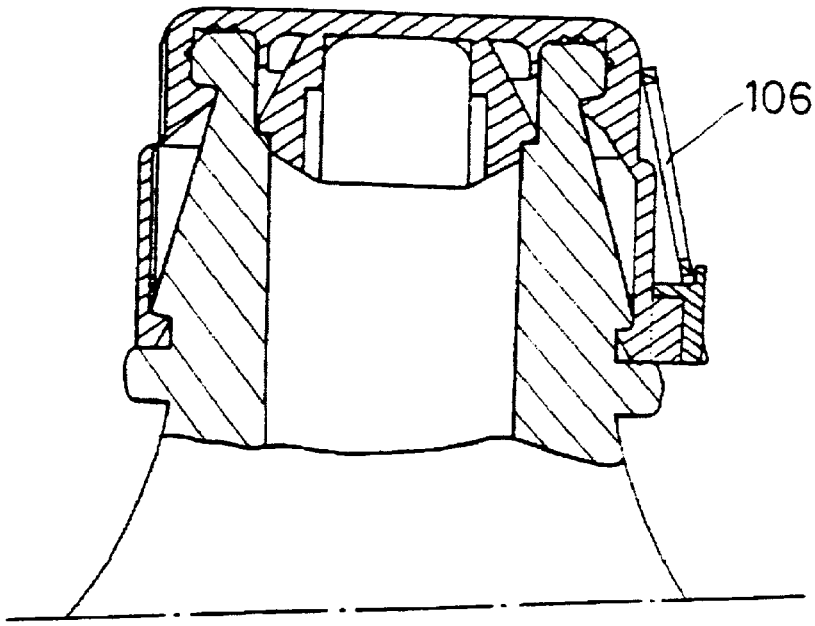

Referring to FIGS. 107A–107D, there is shown a modified example of the fifth embodiment. As shown in FIG. 107A, an assembly protrusion 1071 is formed on a bottom end of the lower body 102. As shown in FIG. 107B, the pull-tab 106 is pivotably connected to an assembly support 1072 having an insert groove 1073 shaped to fit over the assembly protrusion 1071 formed on the lower body 102. A catch flap 1074 is formed protruding through a gap 1075 formed between the pull-tab 106 and the assembly support 1072. The pull-tab 106 is shown assembled to the lower body 102 in FIG. 107C. Also, the pull-tab 106 is maintained in a downward state by the catch flap 1074 as shown in FIG. 107D. FIG. 108 illustrates another modified example of the fifth embodiment. As shown in the drawing, this modified example is identical to that shown in FIG. 107 except that a catch flap 1082 is formed on an assembly support 1081 extending upward (and not downward) such that the pull-tab 106 is maintained in an upward state as shown in FIG. 108B.

Figure 109A:
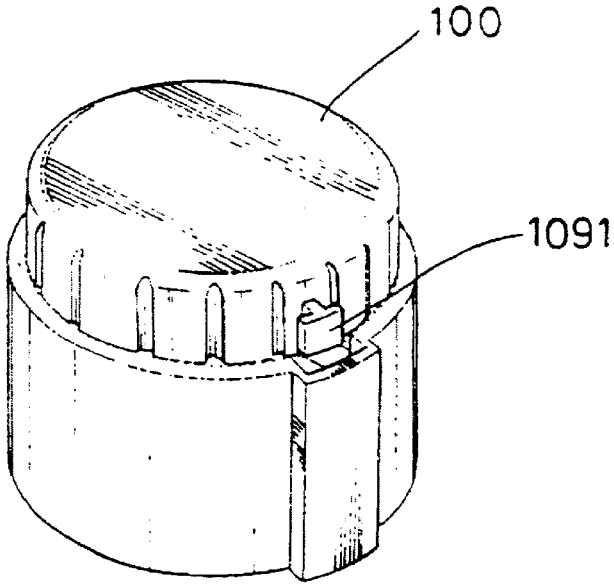
Figure 109B:
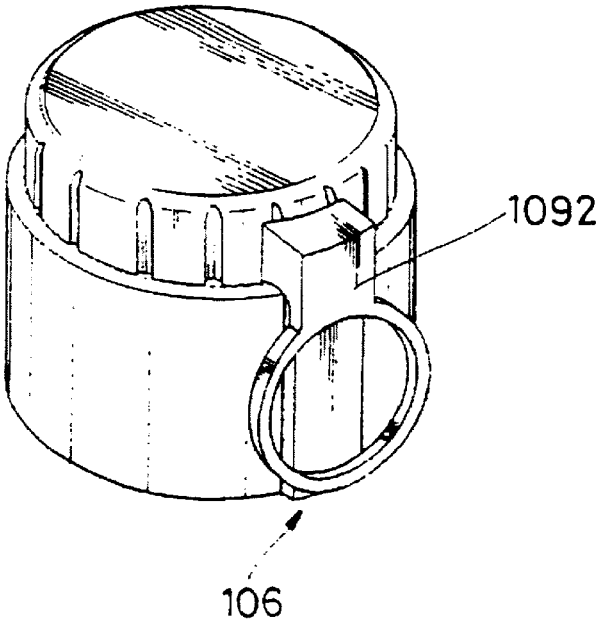

Another modified example of the fifth embodiment is shown in FIGS. 109A and 109B. As shown in the drawings, this modified example is similar to the above examples. Here, an assembly protrusion 1091 is formed on the upper body 100 to which an assembly support 1092 is dismountably fixed. The pull-tab 106 is formed downward from the assembly support as shown in FIG. 109B.

Figure 110:
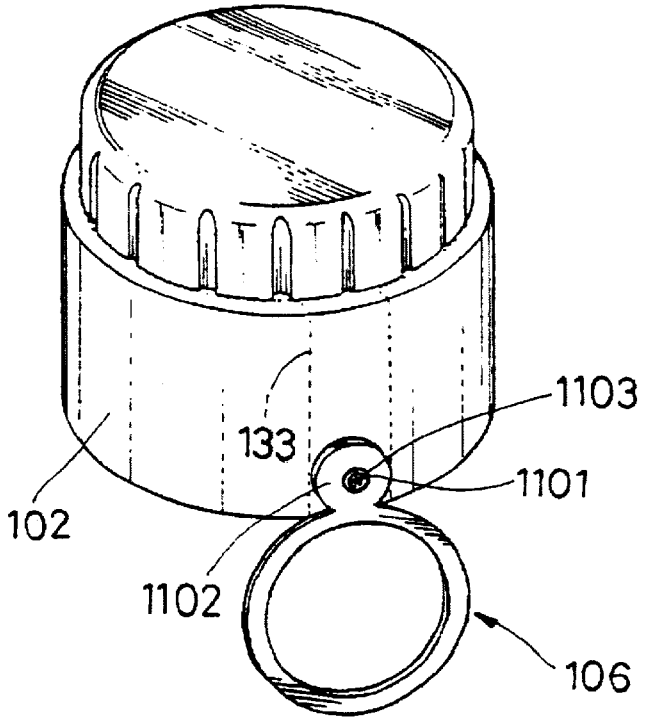
Figure 111:
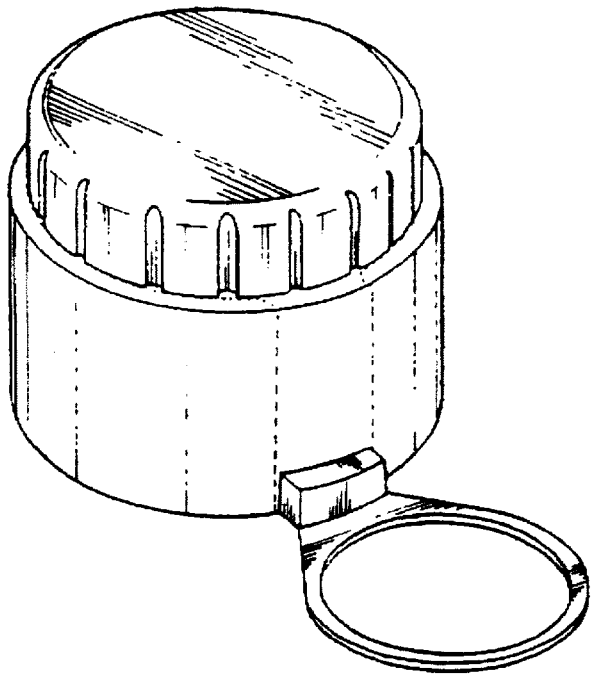
Figure 112:
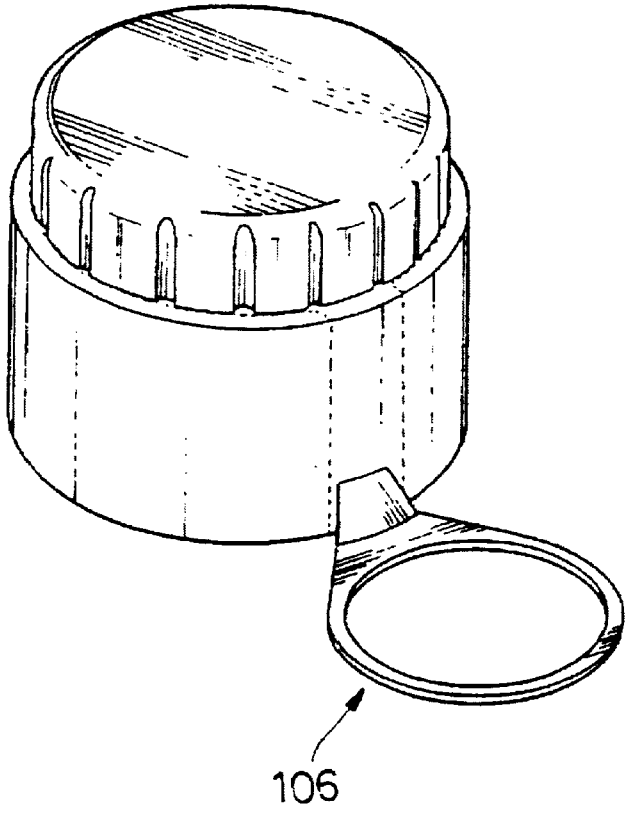
Figure 113:
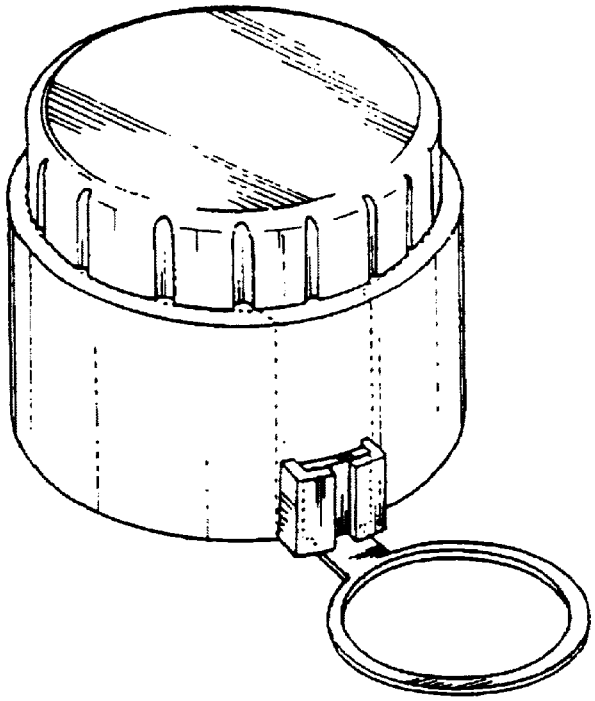
Figure 114:
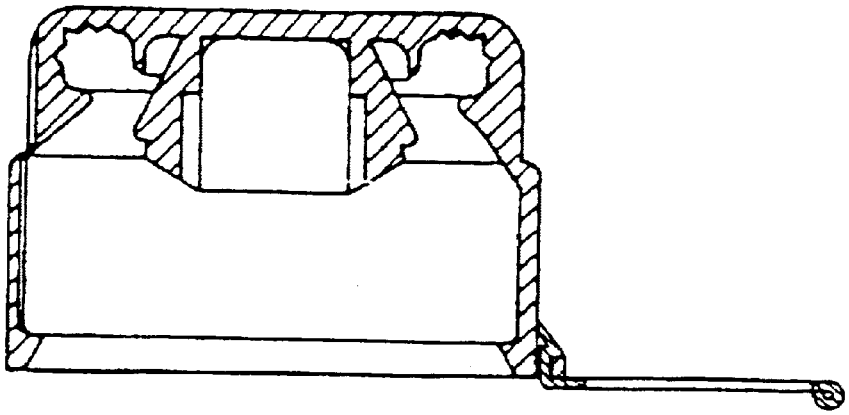
Figure 115:
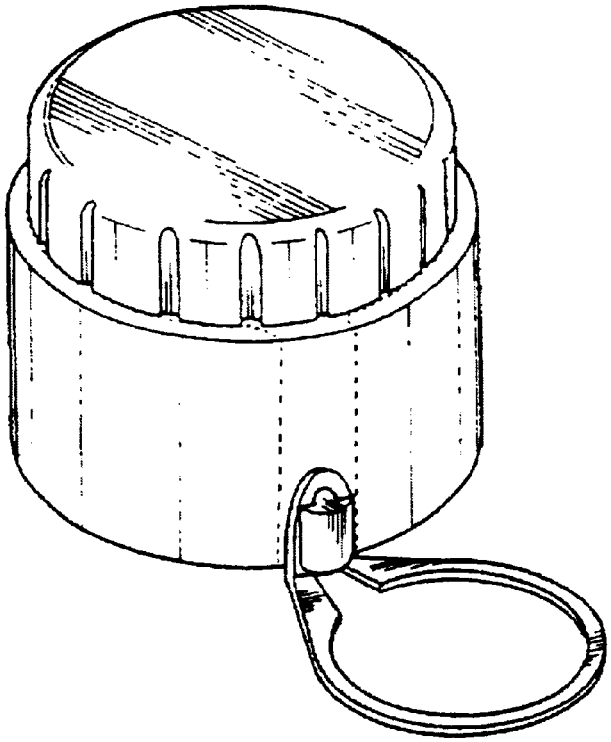

There is shown another modified example of the fifth embodiment in FIG. 110. In this modified example, the pull-tab 106 is formed having a connecting portion 1103, in a middle of which is provided an insertion hole 1102. A catch protrusion 1101 is integrally formed between the vertical cutting lines 133 on the bottom of the lower body 102. As a result of this structure, the pull-tab 106 can be rotated such that the same in maintained in an upward state.

The pull-tab of the modified examples appearing in FIGS. 111–115 can be made of metallic substances and is structured allowing insertion into an assembly fixing portion.

In the sixth embodiment, problems caused by the material used for the bottle cap are solved. Namely, sealant problems and the problem of the bottle cap coming apart during the capping process are solved in the sixth embodiment.

Figure 116A:
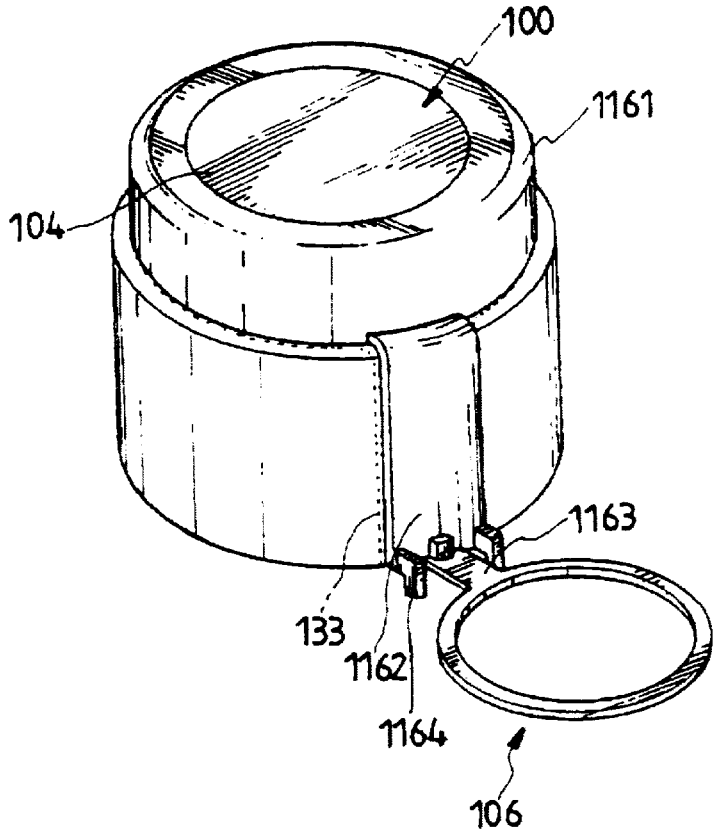
FIGS. 116A and 116B are perspective views of a bottle cap according to a sixth embodiment of the present invention.
Figure 116B:
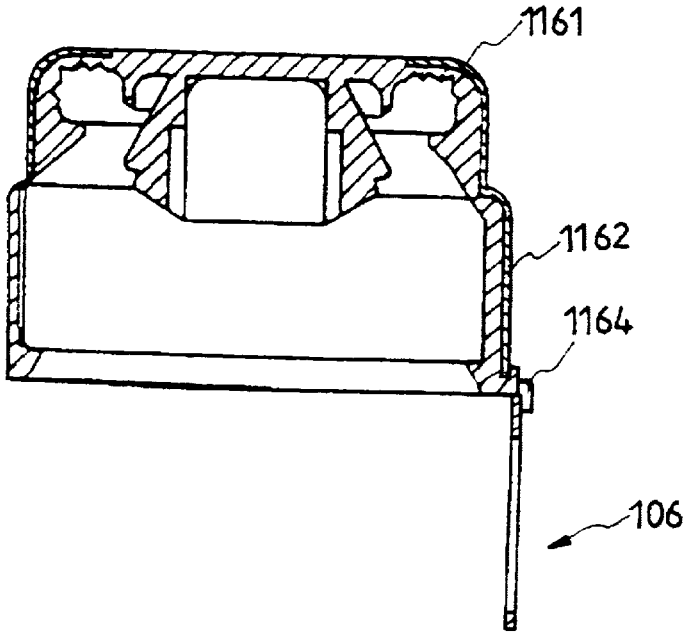

Referring to FIGS. 116A and 116B, there is shown a sixth embodiment of the present invention. As shown in FIG. 116A, the pull-tab 106 is fixed to the lower body 102 through a connector 1163. Also, a reinforcing member 1161 is formed over the outside circumference and part of the upper surface 104 of the upper body 100. A tear strip 116,2 is provided connected to the reinforcing member 1161 and extending downward to the bottom of the lower body 102 between the vertical cutting lines 133. A fixing protrusion 1164, for fixing the pull-tab 106, is provided on a bottom of the tear strip 1162. The pull-tab 106 is maintained in a downward state by the fixing protrusion 1164 as shown in FIG. 116B.

Figure 117A:
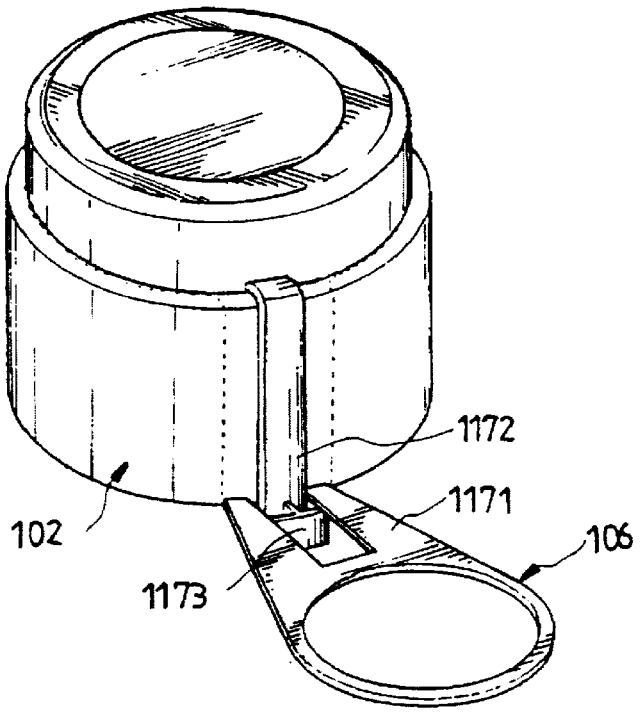
FIGS. 117 to 127 are perspective views of modified examples of the sixth embodiment of the present as shown in FIG. 116.
Figure 117B:
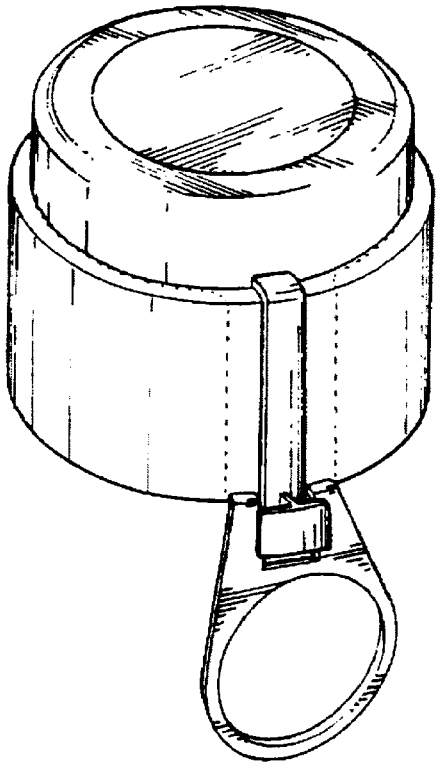

A modified example of the sixth embodiment is shown in FIGS. 117A and 117B. As shown in FIG. 117A, this modified example is similar to that shown in FIG. 166. However, a tear strip 1172 is much thinner and the pull-tab 106 is connected to the lower body 102 through connectors 1171 on both sides of the tear strip 1172. A fixing protrusion 1173 is provided on the tear strip 1172 extending outward therefrom. The pull-tab 106 maintained in a downward state by the fixing protrusion 1173 as shown in FIG. 117B.

Figure 118:
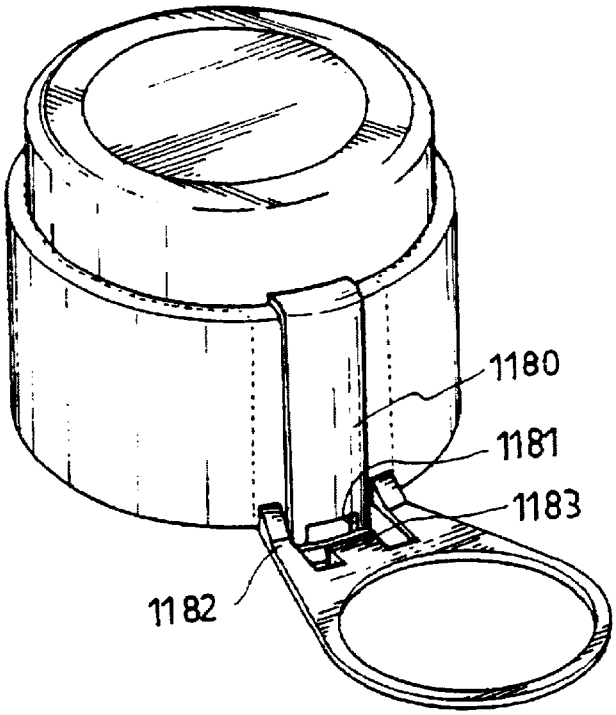

There is shown another modified example of the sixth embodiment in FIG. 118. As shown in the drawing, a tear strip 1180 is provided as in the above examples but having a fixing groove 1181. The pull-tab 106 is formed having a catch hook 1183 formed in a space between connectors 1182. The catch hook 1183 is inserted in the fixing groove 1181 to maintain the pull-tab 106 in a downward state when the same is pushed downward.

Figure 119:
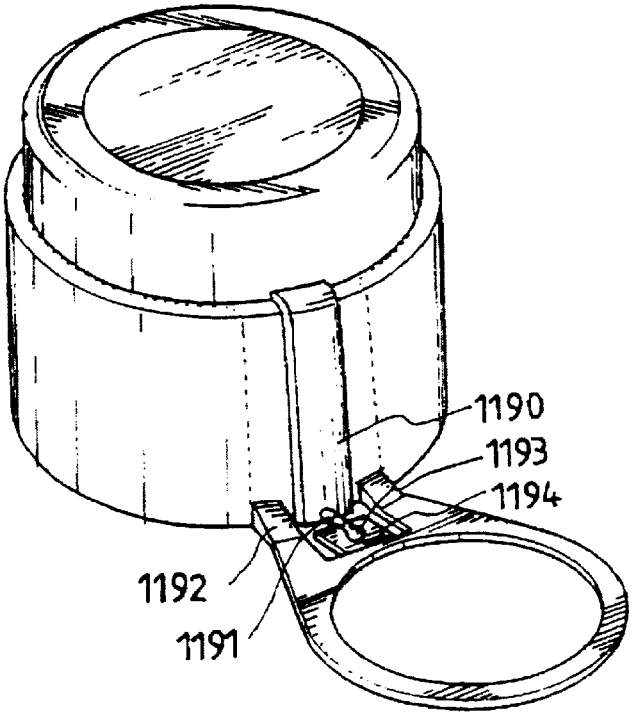

Referring to FIG. 119, there is shown another modified example of the sixth embodiment. As shown in the drawing, a tear strip 1190 is formed having a catch pin 1191 formed on a bottom portion thereof. A clasp 1194 having a slot 1193 is provided on the pull-tab 106 between connectors 1192. The pull-tab 106 is maintained in a downward state by the connection of the slot 1193 of the clasp 1194 and the catch pin 1191.

Figure 120A:
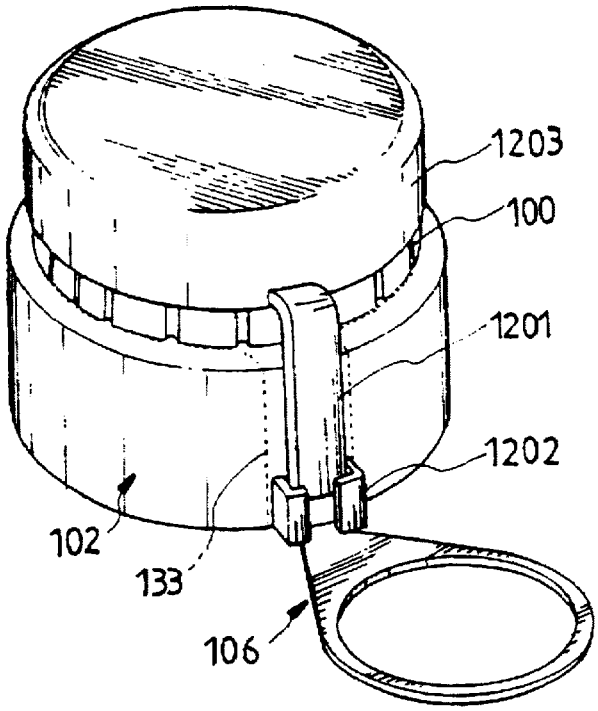
Figure 120B:
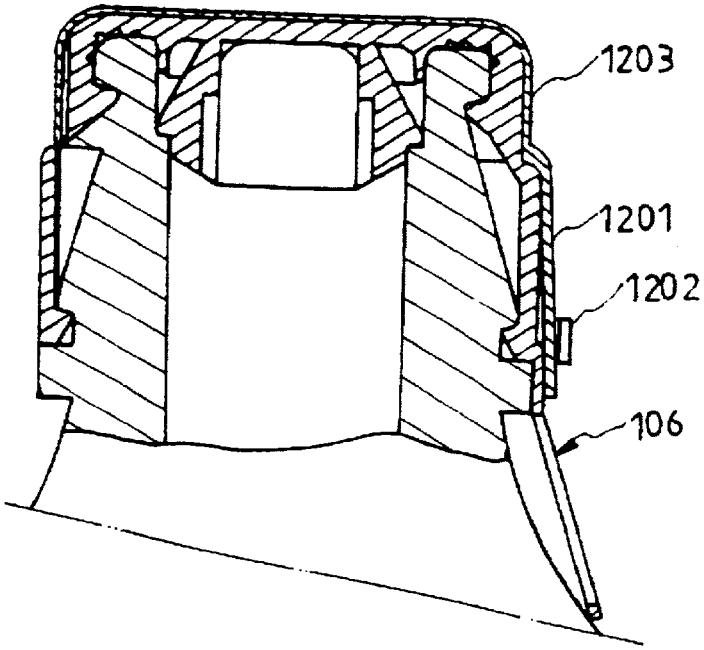

Another modified example of the sixth embodiment is shown in FIGS. 120A and 120B. As shown in the drawings, the pull-tab 106 is integrally formed to the bottom of the lower body 102. Also, a reinforcing member 1203 covers the entire upper surface (not shown) of the upper body 100. A tear strip 1201 is formed extending downward from the reinforcing member 1203 between the vertical cutting lines 133. Clasps 1202 are formed on the bottom of the lower body 102 between the vertical cutting lines 133. A bottom of the tear strip 1201 is inserted and held between the clasps 1202. The tear strip 1201 follows down along between the clasps 1202 to push the pull-tab 106 downward and maintain the same in a position shown in FIG. 120B.

Figure 121:
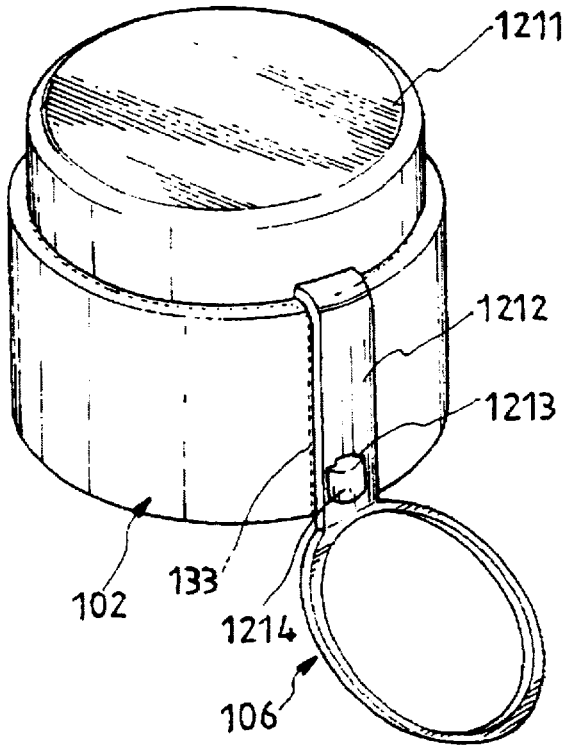

There is shown another modified example of the sixth embodiment in FIG. 121. As shown in the drawing, a tear strip 1212 extends down from a reinforcing member 1211, covering the upper body (not shown), between the vertical cutting lines 133 to the bottom of the lower body 102 where the tear strip 1212 is connected to the pull-tab 106. A fixing protrusion 1214 is integrally connected to a bottom portion of the lower body 102 and a catch groove 1213 is formed on the tear strip 1212 corresponding to the location of the fixing protrusion 1214.

The pull-tab 106 is maintained in a downward state through this structure as seen in the drawing, and the catch groove 1213 of the tear strip 1212 can be removed from the fixing protrusion 1214 by the upward pulling motion on the pull-tab 106 by the user.

Figure 122:
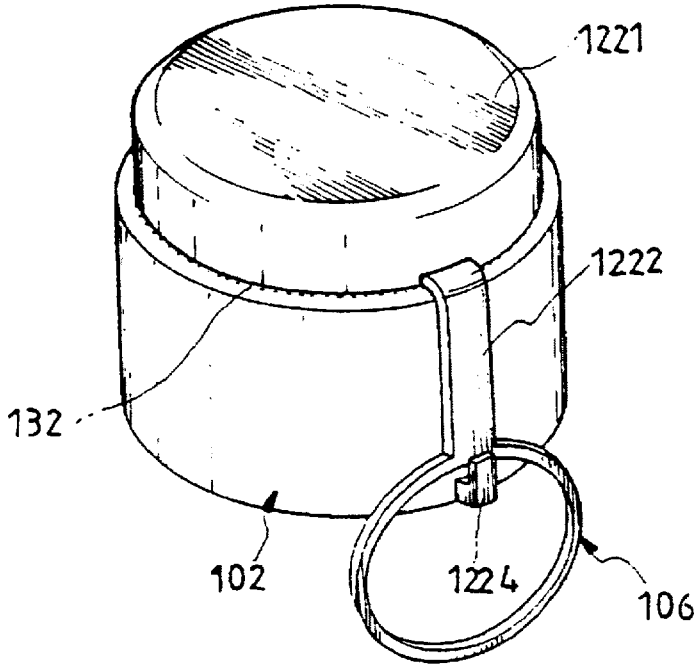
Figure 123:
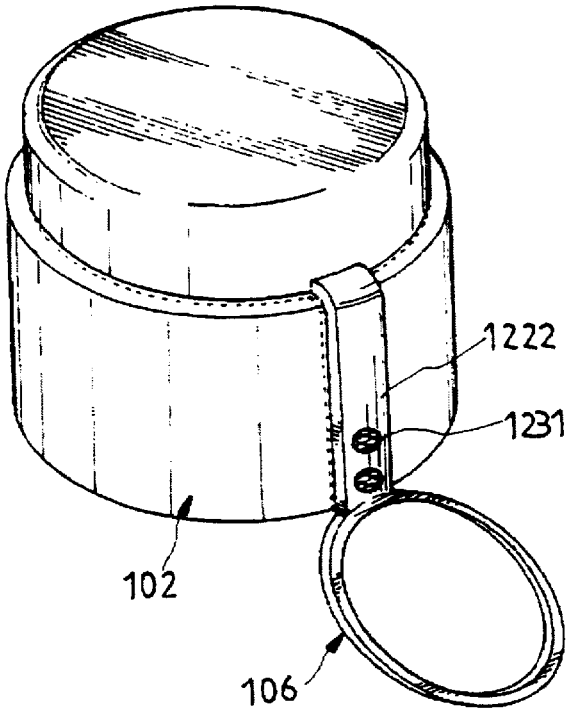

Referring to FIG. 122, there is shown another modified Example of the sixth embodiment. As shown in the drawing, a catch hook 1224 is formed on the bottom of the lower body 102 to which the pull-tab 106 is connected to be maintained in a downward state. A tear strip 1222 extends upward to connect with a reinforcing member 1221. In this modified example, no vertical cutting lines are provided and the upper body (not shown) is removed from the lower body 102 by the cutting of the upper cutting lines 132 when the user pulls upward on the pull-tab 106. Another modified example of the sixth embodiment is shown in FIG. 123. As shown in the drawing, this modified example is similar to that shown in FIG. 121. However, a tear strip 1222 is fixed to the lower body 102 through connection portions 1231, fused by using ultra-sonic waves.

Figure 124:
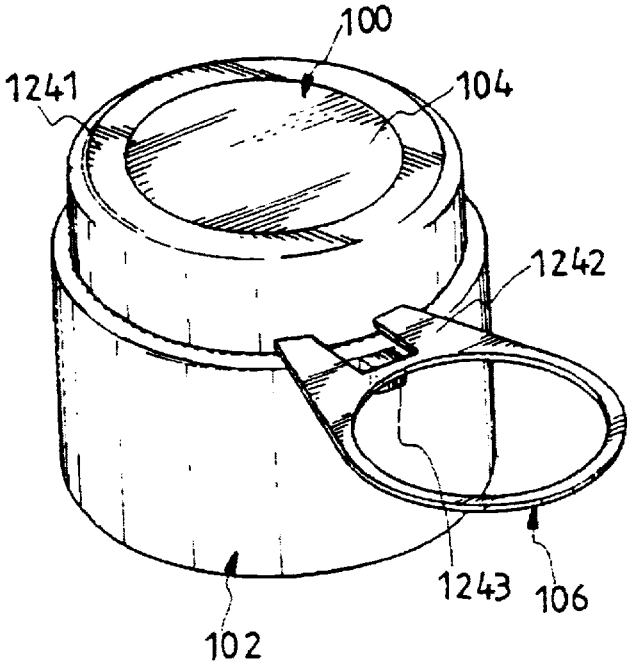

FIG. 124 illustrates yet another modified example of the sixth embodiment. In the drawing, a reinforcing member 1241 covers the outer circumference of the upper body 100 and extends to cover part of the upper surface 104 of the upper body 100. The pull-tab 106 is connected directly lo the reinforcing member 1241 through connectors 1242. Also, a catch hook 1243 is provided on the upper portion of the lower body 102 such that the pull-tab 106 can be maintained in a downward state by the catching of the catch hook 1243 between the connectors 1242.

Figure 125:
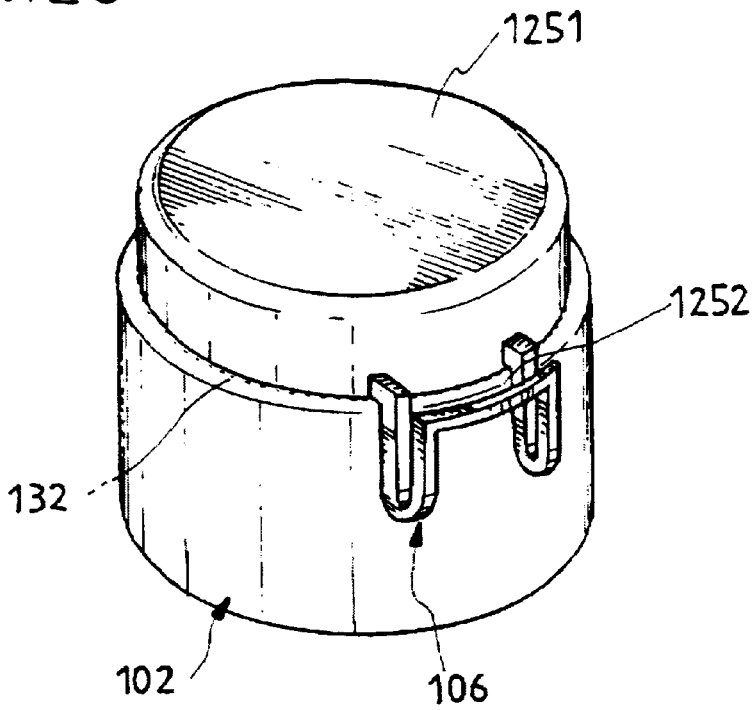

Another modified example of the sixth embodiment is shown in FIG. 125. As shown in the drawing, a reinforcing member 1251 is formed covering the upper body (not shown) and the pull-tab 106 is connected directly to the reinforcing member 1251, the pull-tab 106 extending downward then folding upward such that the pull-tab 106 unfolds increasing the size of a finger hole 1252 when the user pulls outward on the pull-tab 106. The upper body (not shown) is removed from the lower body 102 by the cutting of the upper cutting line 132.

Figure 126:
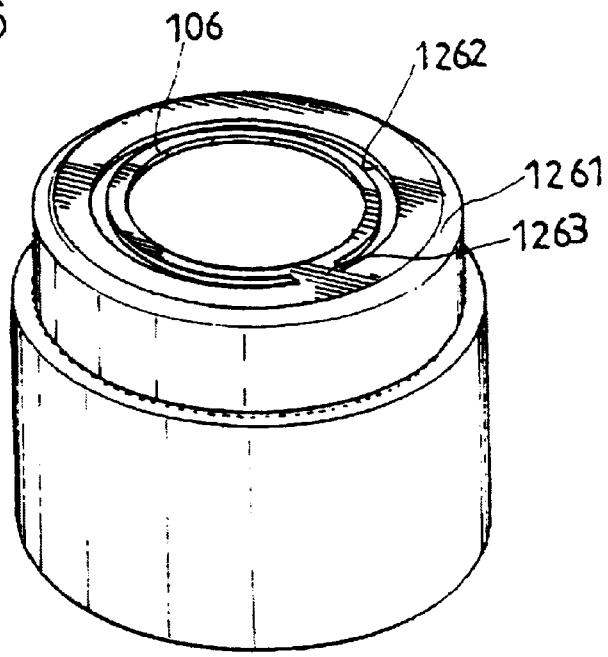

FIG. 126 illustrates another modified example of the sixth embodiment. As shown in the drawing, a reinforcing member 1261 is formed covering an outer circumference of the upper body (not shown) and part of its upper, surface (not shown) A hollow portion 1262 is formed on the upper surface (not shown) inside of which the pull-tab 106 is formed. The pull-tab 106 is connected, to the upper body inside the hollow portion 1262 by a connector 1263.

Figure 127:
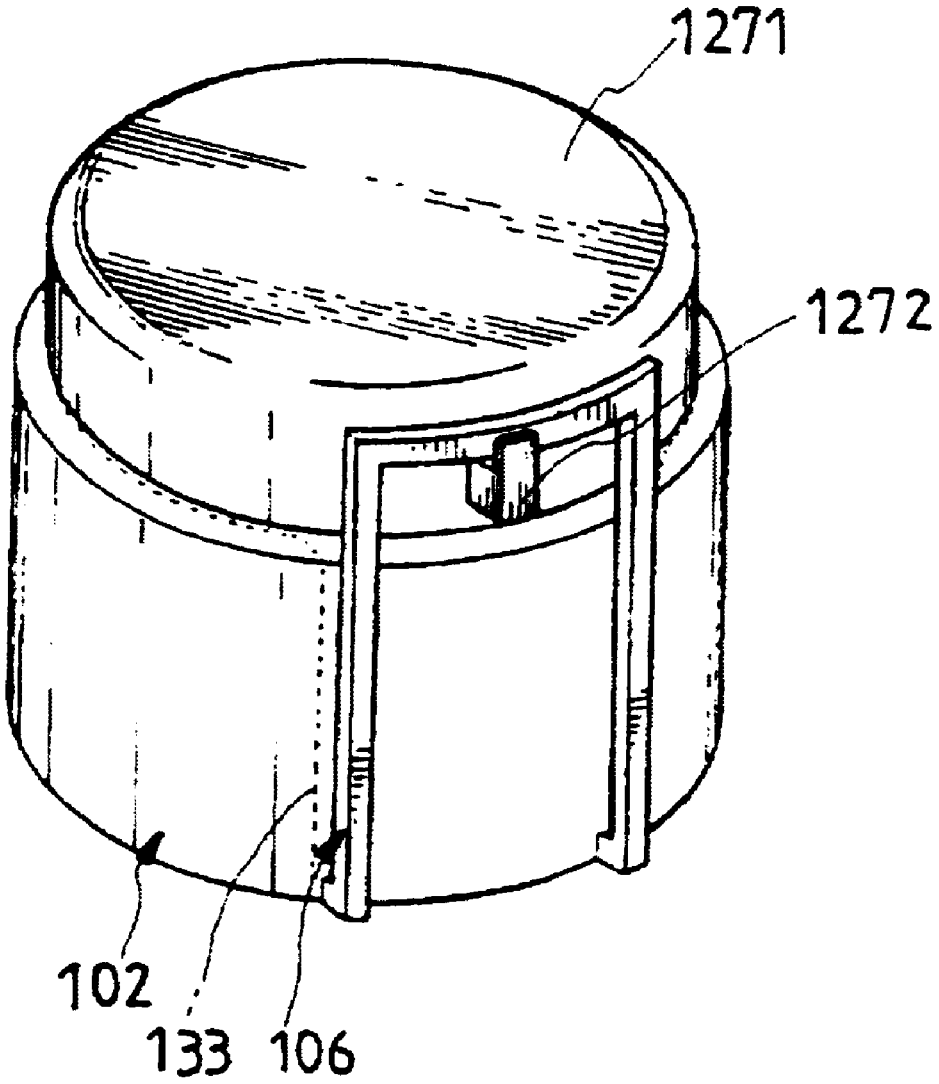

A final modified example of the sixth embodiment is shown in FIG. 127. As shown in the drawing, the pull-tab 106 is connected to the bottom of the lower body 102 between the vertical cutting lines 133. The pull-tab 106 extends upward to the upper body (not shown). A catch hook 1272 is formed on a reinforcing member 1271, covering the upper body (not shown). An upper part of the pull-tab 106 is maintained in a fixed, upward position by the catch hook 1272.

In all the above embodiments (first to sixth embodiments), the upper body and lower body are integrally connected having an upper cutting line formed therebetween. In the following seventh embodiment, an upper body and a lower body are manufactured separately then assembled.

Referring to FIG. 128A–128D, a bottle cap is comprised of an upper body 100' and a lower body 102'. The upper body 100' includes a side portion 1282, having a circumferential ring 1281, and an upper surface 1283. A bottle plug 1284 is formed extending downward from the upper surface 1283 inside the upper body 100'. The bottle plug 1284 has a reinforcing portion 1285 formed on an inside portion thereof (FIG. 128C) and a ring protrusion 1286 formed on an outside portion. A gap 1288 and a circular stopper 1281 are formed between the side portion 1282 and the bottle plug 1284.

On an outside circumference of the lower body 102' is formed a vertical cutting line 133', and a pull-tab 106' is fixed to one side of the lower body 102' through a connector 1289. A circumferential groove 1281' and a catch protrusion 1282' are formed on an inside of the lower body 102'. The upper body 100' and lower body 102' are connected by the meshing of the circumferential ring 1281 of the upper body 100' with the circumferential groove 1281' of the lower body 102'.

Figure 128A:
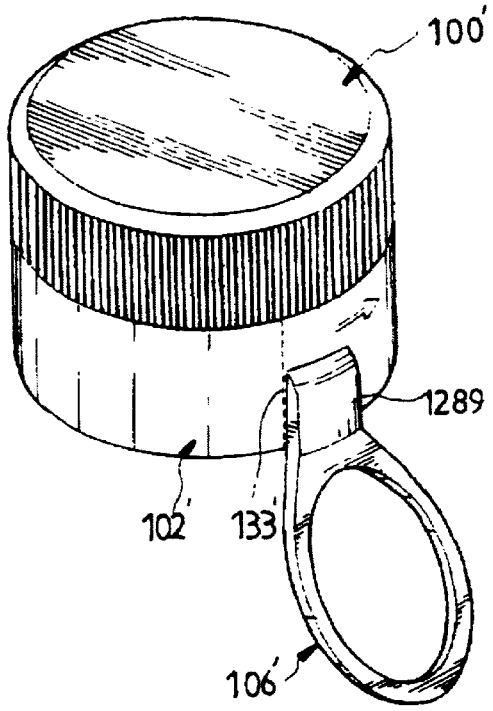
FIGS. 128A to 128D are perspective views of a bottle cap according to a seventh embodiment of the present invention.
Figure 128B:
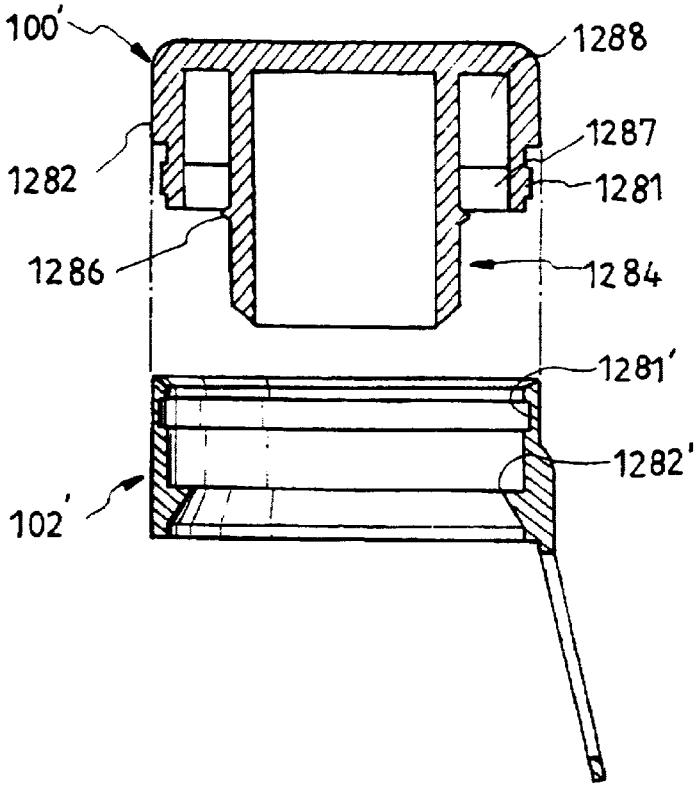
Figure 128C:
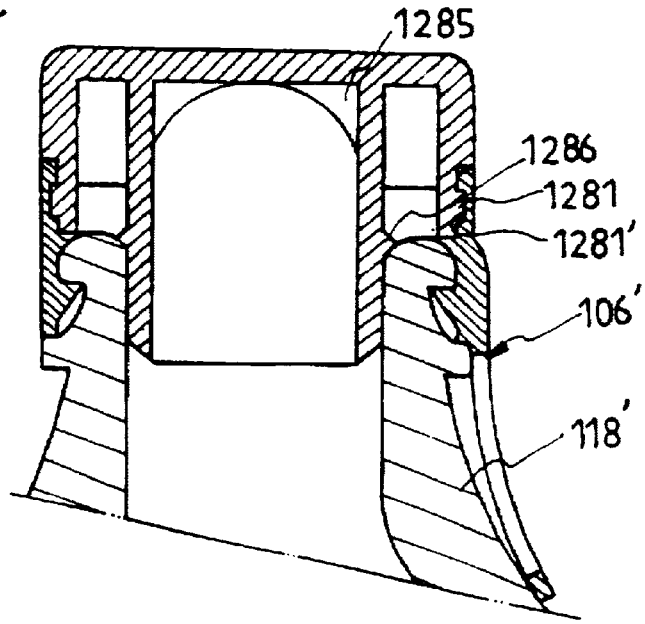

FIG. 128C illustrates the upper body 100' and the lower body 102' assembled to each other and to a bottle 118'. As shown in the drawing, the catch protrusion 1282' is caught under an upper lip of the bottle 1181, the bottle plug 1284 is positioned inside the bottle 118', and the ring protrusion 1286 is caught on a top of the bottle 118'.

Figure 128D:
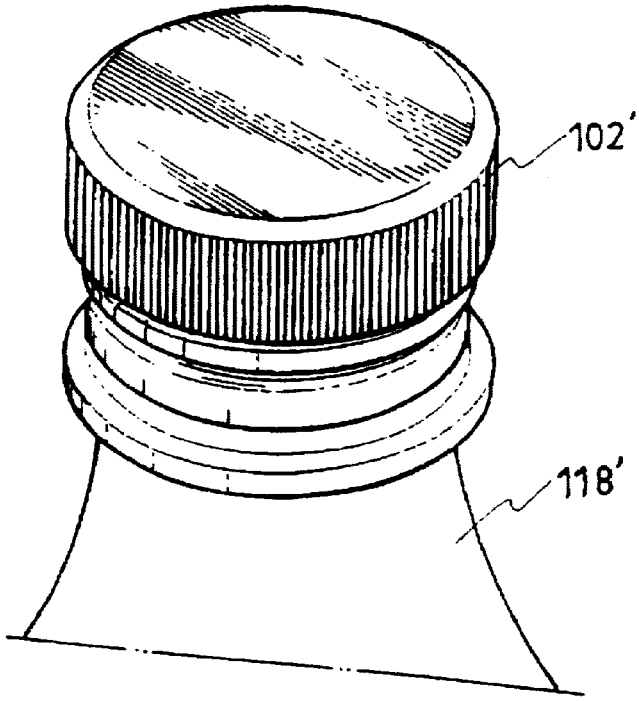

In the above state, if the pull-ring 106' is pulled in first an upward direction, cutting the vertical cutting line 133', then around the upper body 100' in a direction away from the vertical cutting line 133', the lower boded 100' is removed from the upper body 102' such that only the upper body 102' remains as shown in FIG. 128D. From this state, the user can remove the upper body 102' from the bottle 118' by pulling upward on the same, and the contents of the bottle 118' can be stored by replacing the upper body 102'.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims

What is claimed is:

1. A bottle cap made of synthetic resin comprising:

an upper body including a plurality of longitudinal grooves formed around an outer circumferential surface, an inner cap having a wall with inner and outer surfaces and extending along an axis downward from all inside of the upper body, at least two protruding seals formed on the outer surface of the inner cap for fitting against an inside upper circumference of a bottle, a side reinforcement connected to the inner surface of the wall of the inner cap, wherein said side reinforcement extends longitudinally along the inner surface of the inner cap and is in axial alignment with said seals, and wherein said side reinforcement provides resistance against lateral movement of said inner cap, thereby maintaining a positive engagement between the seals of said inner cap and an inner surface of the bottle, and at least one stopper projection for catching on an upper portion of a bottle;

a lower body connected to a lower end of the upper body and having a plurality of longitudinal grooves formed around an inner circumferential surface and at least one stopper projection;

wherein an upper cutting line is formed between the upper body and the lower body except for a non-cutting portion; mid a vertical cutting line is formed such that the upper body and the inner cap of the upper body can be separated from remaining parts of the bottle cap, and a pull-tab is further provided to cut the vertical cutting line and to allow the upper body and inner cap to be removed from the bottle by a user.

2. The bottle cap of claim 1, wherein the upper cutting line is formed around a border between the upper body and the lower body and the pull-tab is formed on the upper body such that when the pull-tab is pulled, the upper cutting line is cut and the upper body is removed from the bottle.

3. The bottle cap of claim 2, wherein the pull-tab is formed extending downward to the bottom of the lower body and connected thereon by a connecting portion and detachably connected to the upper body, and vertical cutting lines are provided connected to the upper cutting line and extending on both sides of the pull-tab and the connecting portion.

4. The bottle cap of claim 2, wherein the pull-tab, fixed to the upper body, extends downward past the lower body.

5. The bottle cap of claim 4, wherein a protruding portion is formed on the lower body which extends over and wraps around the pull-tab and has a cutting line vertically formed on one side.

6. The bottle cap of claim 4, wherein cutting lines are formed between the pull-tab and lower body.

7. The bottle cap of claim 2, wherein the pull-tab is ring-shaped and fixed to a cavity of the upper body.

8. The bottle cap of claim 7, wherein a cavity is formed around a circumference of the pull-tab.

9. The bottle cap of claim 8, wherein the pull-tab is connected to a face of the cavity through a ring connector such that the pull-tab is positioned parallel to and above the face of the cavity.

10. The bottle cap of claim 8, wherein the pull-tab is fixed integrally to a side wall of the cavity.

11. The bottle cap of claim 7, wherein a single vertical cutting line is provided and grip is formed on one side of the vertical cutting line having a support connection detachably fixed to the other side of the vertical cutting line.

12. The bottle cap of claim 2, wherein the pull-tab is formed integrally on the upper body and extending downward therefrom having a finger hole, and a lower body cutting line is formed to one side of where the pull-tab fixed to the upper body, on one side of which is provided a pull-grip.

13. The bottle cap of claim 2, wherein the pull-tab is formed on the upper surface of the upper body, and a protrusion, having a connecting portion, is formed on a part of the pull-tab extending over to the edge of the upper body.

14. The bottle cap of claim 2, wherein the pull-tab is integrally fixed to the lower part of the upper body, and an upper part of the pull-tab is fixed to the lower body through a connection portion, fused to the lower body by the use of ultra-sonic waves.

15. The bottle cap of claim 2, wherein the pull-tab is separately manufactured and assembled on either the upper or lower body.

16. The bottle cap of claim 15, an assembly protrusion is formed on the upper body to which an assembly support is dismountably fixed, and the pull-tab is formed downward from the assembly support.

17. The bottle cap of claim 15, wherein the pull-tab is made from metallic substances and is structured allowing insertion into an assembly fixing portion.

18. The bottle cap of claim 2, wherein a reinforcing member is formed surrounding the upper body to improve sealing effectiveness of the bottle cap.

19. The bottle cap of claim 2, wherein a tear strip extends down from a reinforcing member, covering the upper body, between the vertical cutting lines to the bottom of the lower body where the tear strip is connected to the pull-tab, and a fixing protrusion is integrally connected to a bottom portion of the lower body and a catch groove is formed on the tear strip corresponding to the location of the fixing protrusion.

20. The bottle cap of claim 2, wherein a catch hook is formed on the bottom of the lower body to which the pull-tab is connected to be maintained in a downward state, and a tear strip extends upward to connect with a reinforcing member.

21. The bottle cap of claim 20, wherein the tear strip is fixed to the lower body through connection portions, fused by using ultra-sonic waves.

22. The bottle cap of claim 2, wherein a reinforcing member surrounds the upper body and the null-tab is fixed to the reinforcing member.

23. The bottle cap of claim 22, wherein the pull-tab is connected to the reinforcing member through connectors fixed to the reinforcing member at a predetermined from each other, and the pull-tab is fixed to the lower body.

24. The bottle cap of claim 23, wherein a fixing protrusion is formed lower body to connect with the pull-tab between the connectors such hat the pull-tab is maintained in a fixed state.

25. The bottle cap of claim 22, wherein the pull-tab extends down toward the lower body then folds over to extend back toward the upper body.

26. The bottle cap of claim 22, wherein the reinforcing member is formed covering an outer circumference of the upper body and part of its upper surface, and a hollow portion is formed on the upper surface inside of which the pull-tab is formed, the pull-tab being connected to the upper body inside the hollow portion by a connector.

27. The bottle cap of claim 1, wherein the upper cutting line is formed around the border between the upper body and the lower body except for the non-cutting portion, and the upper cutting line extends downward to meet two vertical cutting lines formed at a predetermined distance extending to a bottom of the lower body such that when the pull-tab is pulled upward, the vertical cutting lines are cut and the upper cutting line is cut while the upper body is removed from the bottle.

28. The bottle cap of claim 27, wherein the pull-tab is formed extending upward and fixed to the bottom of the lower body, supports to which the pull-tab is connected are formed on the lower body outside the vertical cutting lines, and tab cutting lines are formed between the supports and the pull-tab.

29. The bottle cap of claim 28, wherein a width between the supports increasingly decreases toward the bottom of the lower body.

30. The bottle cap of claim 28, wherein a width of the supports, from where the supports are connected to the lower body toward an outsize edge, increasingly decreases toward the bottom of the lower body.

31. The bottle cap of claim 28, wherein the pull-tab extends downward from a top of the supports.

32. The bottle cap of claim 28, wherein a slot is formed between the pull-tab and the lower body by the formation of the pull-tab on supports, the pull-tab having a bend, a catch protrusion, and a catch groove to allow the folding and securing of the pull-tab.

33. The bottle cap of claim 27, wherein a finger hole is formed by the pull-tab.

34. The bottle cap of claim 27, wherein a ridge portion is formed on an upper end of the pull-tab.

35. The bottle cap of claim 27, wherein the pull-tab is formed extending upward and fixed to the bottom of the lower body, supports to which the pull-tab is connected are formed on the lower body inside the vertical cutting lines, and tab cutting lines are formed between the supports and the pull-tab.

36. The bottle cap of claim 35, wherein a single support is formed as a protrusion at a top of the lower body.

37. The bottle cap of claim 35, wherein a single support is formed longitudinally along a width of the lower body.

38. The bottle cap of claim 37, wherein the a width of the support, from where the support is connected to the lower body toward an outside edge, increasingly decreases toward the bottom of the lower body.

39. The bottle cap of claim 27, wherein the pull-tab is formed diagonally between the vertical cutting lines.

40. The bottle cap of claim 27, wherein the pull-tab extends upward to a predetermined height then is folded over to extend downward.

41. The bottle cap of claim 27, wherein a reinforced connecting portion is provided in the non-cutting portion to more securely connect the upper and lower bodies.

42. The bottle cap of claim 41, wherein an arch is formed projecting outward from the pull-tab.

43. The bottle cap of claim 27, wherein the pull-tab is formed integrally with the lower body having a non-cutting portion at one end and a finger grip at another end.

44. The bottle cap of claim 43, wherein the pull-tab is formed along the lower body extending in a direction away from the non-cutting portion.

45. The bottle cap of claim 27, wherein the pull-tab is folded over at least two times by bends to allow the pull-tab to be lengthened when pulled.

46. The bottle cap of claim 45, wherein cutting lines-are formed in a space between where the pull-tab is folded over.

47. The bottle cap of claim 21, wherein the pull-tab is further extended upward and bent over an indent of an upper surface of the upper body.

48. The bottle cap of claim 27, wherein the pull-tab extends upward after being connected to the lower body, a finger hole provided by the pull-tab, and a slot is formed in the lower body such that the finger hole and slot combine into a single hole when the pull-tab is pulled upward.

49. The bottle cap of claim 48, wherein a tie line is formed between bottom ends of the pull-tab to prevent the finger hole and slot from spreading apart.

50. The bottle cap of claim 48 wherein supports are formed outside the vertical cutting lines, the pull-tab is formed on the supports, and tab cutting lines are formed between the pull-tab and the supports.

51. The bottle cap of claim 27, wherein the pull-tab is fixed to a bottom end of lower body by a connecting portion between the vertical cutting lines, compressed by having one end fixed to the upper body, this connection easily broken by the user through a joining portion, and forms finger hole which expands after the pull-tab is disconnected to the upper body.

52. The bottle cap of claim 27, wherein the pull-tab is connected to the lower body by supports between the vertical cutting lines and formed extending downward to form a finger hole, and a guard portion is formed elevated from the lower body and having a catch protrusion to maintain the pull-tab in a state bent downward.

53. The bottle cap of claim 51, wherein a guard cutting line is formed around the circumference of the guard portion enabling detachment from the lower body.

54. The bottle cap of claim 27, wherein a slot is formed in the lower body between the vertical cutting lines, a finger hole is formed by the pull-tab and a hook is provided on a top end of the pull-tab such that by the attachment of the hook to the slot, the pull-tab can be secured against the lower body.

55. The bottle cap of claim 54, wherein a tie line is formed between bottom ends of the pull-tab, the tie line able to be detached on one end therefrom.

56. The bottle cap of claim 27, wherein the pull-tab is formed directly on the lower body having a finger hole, the pull-tab and the finger hole extending the bottom of the lower body including supports.

57. The bottle cap of claim 27, wherein the pull-tab is formed including a finger hole formed in the lower body around which a hole cutting line is provided which extends upward and connects to the upper cutting line, and tab grip is formed on a bottom portion inside the finger hole projecting upward toward a center of the finger hole including a protrusion extending inward toward the bottle.

58. The bottle cap of claim 27, wherein a slot is formed in the lower body between the vertical cutting lines at a predetermined height and length, and the pull-tab having a connector is fixed to the lower body inside the vertical cutting lines, the remaining part of the pull-tab being formed folded over the connector and, through tab cutting lines, is connected to the supports which are connected to the lower body outside the vertical cutting lines.

59. The bottle cap of claim 27, wherein a lower body tab is further provided on an outside of one of the vertical cutting lines.

60. The bottle cap of claim 27, wherein the pull-tab extends downward from the lower body.

61. The bottle cap of claim 60, wherein a cut-away portion is formed elevated on the lower body and connected to the upper body and the upper end of the pull-tab.

62. The bottle cap of claim 60, wherein a reinforcing member is formed between the pull-tab and the lower body.

63. The bottle cap of claim 62, wherein the pull-tab is formed having reinforcements formed integrally on both sides thereon and to the lower body, and tab release lines are formed on the pull-tab inside the reinforcements and which connect to the vertical cutting lines.

64. The bottle cap of claim 60, wherein supports and a holding member, including cutting lines formed therebetween, are formed on the bottom part of the lower body, the supports being fixed at points outside the vertical cutting lines.

65. The bottle cap of claim 64, wherein a support band is provided at a bottom portion of the lower body, the support band being integrally fixed to the lower body on the outside of one of the vertical cutting lines, and connected to the lower body through a detachable connecting portion on the outside of the other vertical cutting line.

66. The bottle cap of claim 65, wherein a finger grip is formed on the support band on a side to which the connecting portion is formed.

67. The bottle cap of claim 60, wherein at least one of the vertical cutting lines is a partial cutting line formed extending partially up the length of the lower body such that it does not connect with the upper cutting line.

68. The bottle cap of claim 60, wherein a peg is formed on an extreme part of the free end of the pull-tab, fold creases on a middle portion of the pull-tab, and an insertion hole to which the peg is inserted when the pull-tab 106 is folded.

69. The bottle cap of claim 60, wherein the pull-tab is formed in an upside-down V shape having a finger hole and a bend formed in the pull-tab which when pulled, expands outward to increase the size of the finger hole.

70. The bottle cap of claim 27, wherein a fixing member is provided on the lower body enabling the pull-tab to be fixed and detached to the lower body.

71. The bottle cap of claim 70, wherein the fixing member is comprised of a pair of bendable fixing protrusions formed longitudinally on the lower body such that a gap is formed therebetween, and the pull-tab includes a tab hole formed corresponding to the fixing member such that the pull-tab can be fixed and detached to and from the lower body.

72. The bottle cap of claim 70, wherein the fixing member is a single piece comprised of a protrusion formed longitudinally along the lower body and a bendable head portion.

73. The bottle cap of claim 70, wherein the fixing member includes an unbendable fixing protrusion, and a tab hole formed in the pull-tab has included bendable catch hooks which bend when the pull-tab is pushed in a direction toward the lower body to allow the fixing of the pull-tab to the lower body.

74. The bottle cap of claim 73, wherein the catch hooks are formed inward facing each other in a middle of the tab hole.

75. The bottle cap of claim 73, wherein bendable catch hooks are formed in the tab hole of the pull tab, the catch hooks bending outward to be fixed to the fixing member when the pull-tab is pressed against or pulled from the lower body.

76. The bottle cap of claim 70, wherein a catch flap is formed extending down partway from a top of a tab hole of the pull-tab, and L-shaped flap hooks are formed extending outward on-the lower body which, when the pull-tab is pushed in a direction toward the lower body, grabs the catch flap to maintain the pull-tab in a state fixed against the lower body.

77. The bottle cap of claim 70, wherein a projection is formed on the lower body integrally connected to the upper body on one end, and the pull-tab is connected to the projection through a folding crease, a catch groove being formed along most of the length of the projection and a catch protrusion formed on the pull-tab.

78. The bottle cap of claim 77, wherein the projection is formed having an increasingly larger width toward an outside of the same.

79. The bottle cap of claim 70, wherein the pull-tab is connected to the lower body through connectors provided between the vertical cutting lines, the pull-tab extending upward from the connectors and folding downward through a bend such that the pull-tab tucks behind a catch protrusion integrally formed to the bottom of the lower body between the connectors.

80. The bottle cap of claim 70, wherein the pull-tab is mounted to the lower body through connectors formed between the vertical cutting lines, the pull-tab extending upward from the connectors and having formed two slits longitudinally formed inside the connectors to form a grip extending downward in the center of the pull-tab, the grip catching behind a catch protrusion formed on the bottom of the lower body.

81. The bottle cap of claim 70, wherein the pull-tab is rectangular and forms a finger hole, the pull-tab connecting to the lower body through a connector and able to catch on catch members, having catch hooks formed on an upper portion thereof, formed longitudinally on the lower body outside the vertical cutting lines.

82. The bottle cap of claim 70, wherein the pull-tab having a finger hole is fixed to the bottom of the lower body through connectors fixed between the vertical cutting lines and forming a gap therebetween the pull-tab including a fold crease formed between the connectors and the finger hole and a hold extension formed protruding from the pull-tab to be positioned in the gap such that the hold extension is blocked by a hold plate formed on the bottom of the lower body between the connectors.

83. The bottle cap of claim 70, wherein the pull-tab is formed directly on the lower body having a finger hole, and a hook is formed on the bottom of the pull-tab and a hook hole is formed on the bottom of the lower body corresponding to the location of the hook when the pull-tab is folded toward the lower body.

84. The bottle cap of claim 27, wherein a fixing protrusion, to which the pull-tab can be fixed an detached, is formed on the upper body.

85. The bottle cap of claim 84, wherein a hook is formed on an end of the fixing protrusion to which the pull-tab is held.

86. The bottle cap of claim 27, wherein connecting portions, which are fused to the lower body through the use of ultra-sonic waves, are provided to fix the pull-tab to the lower body.

87. The bottle cap of claim 86, wherein a coupling portion is formed on a top part of a finger hole of the pull-tab including at least one connecting portion, the finger hole including a finger hole cutting line formed between an inside edge of the finger hole and the coupling portion.

88. The bottle cap of claim 86, wherein tab fixing portions, connected to the lower body and including at least one connecting portion each, are provided on the outside of the pull-tab, and finger hole cutting lines and tab cutting lines are provided between the pull-tab and the tab fixing portions.

89. The bottle cap of claim 86, wherein the pull-tab is horseshoe-shaped having a finger hole and fixed directly on the lower body, and protruding upward from the bottom of the finger hole is a joining member having at least: one connecting portion.

90. The bottle cap of claim 86, wherein the pull-tab is integrally formed to the lower body, and in a center of the pull-tab is formed a square-shaped joining member, around the circumference of which is formed a cutting line and in the center of which is formed a connecting portion, the pull-tab being fixed to the lower body through the connecting portion.

91. The bottle cap of claim 27, wherein a fixing member is provided for maintaining the pull-tab in a detachable, downward state.

92. The bottle cap of claim 91, wherein a tab fixing member is formed on the lower body to maintain the pull-tab in a fixed state.

93. The bottle cap of claim 92, wherein the tab fixing member is comprised of supports formed outside the vertical cutting lines and fixing plates formed inward from the supports, wherein support cutting lines provided therebetween and a gap is formed between the fixing plates, the pull-tab including a connecting end integrally connected to a top of the fixing plates, the connecting end having a catch protrusion formed inwardly such that the same can be inserted in the gap, and the catch protrusion being arrow-shaped and sized to fit tightly between the fixing plates to maintain the pull-tab in a downward state until the user pulls upward on the same.

94. The bottle cap of claim 91, wherein the fixing member is provided between the vertical cutting lines on the lower part of the lower body, the fixing member comprised of supports formed longitudinally and fixing plates formed inwardly from the supports, the supports and fixing plates being formed at a predetermined distance to provide a gap therebetween, and the pull-tab is formed directly on the lower body between the vertical cutting lines through tab connectors, the pull-tab having bends provided between the tab connectors and a tab body.

95. The bottle cap of claim 94, wherein a catch protrusion having a wide portion and a narrow portion is pivotably formed from the tab body extending toward the lower body such that when the pull-tab is pushed downward by the user, the narrow portion of the catch protrusion remains pressed against the lower body and the wide portion is forced between the fixing plates in the, gap to maintain the pull-tab in a downward direction.

96. The bottle cap of claim 92, wherein the pull-tab is formed having a catch portion, including a catch groove, formed protruding outward on the tab body, and a fixing member, comprised of an attachment formed longitudinally on the lower body and a cylindrical fixing protrusion formed integrally on the attachment, is provided on the lower body.

97. The bottle cap of claim 92, wherein the pull-tab, having a grasp formed on the free end and a slot formed on the opposite end, is integrally formed on the lower body between the vertical cutting lines, and a fixing member is provided on the lower body, the fixing member having a ridge.

98. The bottle cap of claim 92, wherein a catch member is formed on the pull-tab, the pull-tab fixed on the lower body through connecting portions between the vertical cutting lines, and a fixing protrusion is formed on a lower end of the connecting portions such that the catch member connects with the fixing protrusion.

99. The bottle cap of claim 98, wherein a catch groove is formed in the catch member, the catch groove connects with the fixing protrusion.

100. The bottle cap of claim 92, wherein the pull-tab is connected to the lower body between the vertical cutting lines by connecting portions, an operational hole is formed in the connecting portions, and a fixing pin, able to move up and down and which fixes the pull-tab, is provided in the operational hole.

101. The bottle cap of claim 92, wherein the pull-tab is formed integrally with the lower body between the vertical cutting lines through tab connectors, the pull-tab having a finger hole and bends formed between the tab connectors and a tab body, and a wedge is pivotably formed on the tab body and a wedge hook, having a body integrally formed extending upward on the lower body and a catch protrusion formed at a right angle from the body, is provided on the lower body.

102. The bottle cap of claim 92, wherein a tab holder is formed on the pull-tab between supports and a fixing member is formed on the lower body between the supports of the pull-tab, the fixing member including a gap and an extension, having an insert, pivotably formed on an upper end of the fixing member.

103. The bottle cap of claim 92, wherein a fixing member is formed on the lower body between supports of the pull-tab, the fixing member including hooks formed between the supports of the pull-tab, a block fixed to the lower body between the hooks, and a catch flap pivotably formed on an upper portion of the block.

104. The bottle cap of claim 92, wherein a fixing member is formed between the vertical cutting lines on the lower body, the fixing member having a catch lip formed downward, and the pull-tab is folded toward the lower body such that a far end of a folded over portion catches under the catch lip to maintain the pull-tab in a downward state.

105. The bottle cap of claim 92, wherein the pull-tab is fixed to the lower body through connectors integrally mounted between the vertical cutting lines, and the pull-tab provides a fixing member formed extending toward the lower body such that when the bottle cap is pushed on the bottle, the fixing member is fixed to the lower body to maintain the pull-tab in downward position.

106. The bottle cap of claim 105, wherein an extension, defining a hole inside of which the fixing member can be placed, is formed on the lower body between the connectors of the pull-tab.

107. The bottle cap of claim 91, wherein the pull-tab is connected to the bottom portion of the lower body between the vertical cutting lines through supports, a catch protrusion being formed between the supports extending toward the lower body, and a catch groove is formed on the bottom of the lower body in a position corresponding to the catch protrusion.

108. The bottle cap of claim 91, wherein the pull-tab is fixed to the lower body though supports, a catch protrusion having a hole being formed extending from the pull-tab, and a hook is formed at a predetermined distance from the catch protrusion such that the pull-tab is maintained in a downward direction when the hook is placed in the hole of the catch protrusion.

109. The bottle cap according to claim 91, wherein a support fixes the pull-tab to the lower body between the vertical cutting lines, and a fixing hole is formed in the support and a catch protrusion is provided extending downward from the lower body.

110. The bottle cap according to claim 91, wherein the pull-tab is fixed to the lower body through connectors, a catch hook is formed protruding downward from the pull-tab between the connectors, and a fixing protrusion is pivotably formed on the bottom of the lower body such that the fixing protrusion, when forced upward, makes contact with the catch hook to force the same to move up past the connectors.

111. The bottle cap of claim 27, wherein the pull-tab is formed connected to the lower body between the vertical cutting lines, and the bottle cap is placed on the bottle after the pull-tab is pulled downward such that the pull-tab remains elastically biased in the direction of the bottle.

112. The bottle cap of claim 111, wherein a finger hole is defined by the pull-tab and the pull-tab is formed unconnected from the lower body around a bottom circumference of the same.

113. The bottle cap of claim 27, wherein the pull-tab is integrally fixed to the lower body between the vertical cutting lines, and connection portions, fused using ultrasonic waves, are used to maintain the pull-tab in a downward state.

114. The bottle cap of claim 27, wherein both sides of the pull-tab next to a bending portion are connected to each other to maintain the pull-tab in a downward state.

115. The bottle cap of claim 27, wherein the pull-tab is fixed to the upper part of the lower body between the vertical cutting lines, a catch groove is formed over the length of a tab body, and a fixing protrusion is provided on a lower part of the lower body to which the catch groove of the pull-tab is fixed.

116. The bottle cap of claim 27, wherein the pull-tab having a finger hole is integrally connected to the lower body between the vertical-cutting lines through a connector, and a fixing portion is formed having a cutting line at a top of the finger hole, in a center of which is formed a connection portion attached, using ultra-sonic waves, to the bottle such that the pull-tab is maintained in a downward state.

117. The bottle cap of claim 27, wherein the pull-tab is separately manufactured and assembled on either the upper or lower body.

118. The bottle cap of claim 117, wherein an assembly protrusion is formed on a bottom end of the lower body, and the pull-tab is pivotably connected to an assembly support having an insert groove shaped to fit over the assembly protrusion.

119. The bottle cap of claim 118, wherein a catch flap is formed protruding through a gap formed between the pull-tab and the assembly support, the catch flap allowing the pull-tab to be maintained in an upward or downward state.

120. The bottle cap of claim 117, wherein the pull-tab is formed having a connecting portion, in a middle of which is provided an insertion hole, and a catch protrusion is integrally formed between the vertical cutting lines on the bottom of the lower body.

121. The bottle cap of claim 117, wherein the pull-tab is made from metallic substances and is structured allowing insertion into an assembly fixing portion.

122. The bottle cap of claim 27, wherein a reinforcing member is formed surrounding the upper body to improve sealing effectiveness of the bottle cap.

123. The bottle cap of claim 122, wherein a tear strip is connected to the reinforcing member and formed extending down to a bottom of the lower body, the tear strip including a fixing means to maintain the pull-tab in a fixed state.

124. The bottle cap of claim 123, wherein the pull-tab is fixed to the lower body through a connector, and a fixing protrusion, for fixing the pull-tab, is provided on a bottom of the tear strip.

125. The bottle cap of claim 123, wherein the pull-tab 106 is connected to the lower body through connectors, fixed to the lower body at a predetermined distance, the connectors able to connect with the fixing means of the tear strip.

126. The bottle cap of claim 125, wherein the fixing means includes fixing protrusion on both sides such that when the connectors of the pull-tab connect with the fixing means, the pull-tab is maintained in a downward state.

127. The bottle cap of claim 125, wherein the fixing means includes a fixing groove provided on a bottom of the tear strip, and the pull-tab is formed having a catch hook formed in a space between the connectors.

128. The bottle cap of claim 125, wherein the fixing means include a catch pin provided on a bottom of the tear strip, and a clasp having a slot is provided on the pull-tab between the connectors.

129. The bottle cap of claim 123, wherein the fixing means is realized through the tear strip, formed able to extend down between and past the clasps such that the pull-tab is maintained in a downward state by the tear strip.

130. The bottle cap of claim 129, wherein clasps are formed facing each other on the bottom of the lower body between the vertical cutting lines, the clasps guiding and fixing the tear strip.

131. The bottle cap of claim 122, wherein the pull-tab is connected to the bottom of the lower body between the vertical cutting lines, the pull-tab extending upward to the upper body, and a catch hook is formed on the reinforcing member.

132. The bottle cap of claim 1, wherein the pull-tab, having a grip formed on a bottom thereof, is formed on the lower body connected to supports through tab cutting lines, the tab cutting lines extending to meet cap cutting lines inside of which is formed a thin cutaway segment, the cut-away segment extending to the top of the upper body to connect to a non-cutting portion around the circumference of which is formed a cavity including a cavity cutting line, and grooves vertically formed on an inside face of the upper body, and a connecting membrane is formed between the supports inside the pull-tab including membrane cutting lines formed on both sides of the connecting membrane.

133. The bottle cap of claim 1, wherein a cavity is formed in an upper part of the upper body corresponding to an outer location of the inner cap and a pull-tab is fixed to the cavity through a ring connector, and, except for a non-cutting portion formed on a side of the cavity opposite where the ring connector is provided, is there is formed a cavity cutting line, the cavity cutting line extending upward to meet upper body cutting lines which, in turn, meet vertical cutting lines.

134. The bottle cap of claim 133, wherein a non-cutting segment is formed on one of the vertical cutting lines.

135. A bottle cap according to claim 1 further comprising a corner reinforcement connected to both the inside of said upper body and the wall of said inner cap, wherein said corner reinforcement controls the elastic force of said side reinforcement.

136. A bottle cap made of synthetic resin comprising:

an upper body comprising:

an inner cap having a wall with inner and outer surfaces and extending along an axis downward from an inside of the upper body;

at least two protruding seals formed on the outer surface of the inner cap and extending circumferentially thereabout for fitting against an inside upper circumference of a bottle;

a side reinforcement connected to the inner surface of the wall of the inner cap, wherein said side reinforcement extends longitudinally along the inner surface of the inner cap and is in axial alignment with said seals, and wherein, said side reinforcement provides resistance against lateral movement of said inner cap;

a corner reinforcement connected to both the inside of said upper body and the wall of said inner cap, wherein said corner reinforcement controls the elastic force of said side reinforcement; and at least one stopper projection for catching on an upper portion of a bottle;

a lower body connected to a lower end of the upper body having at least one stopper projection; and cutting lines formed between the upper body and the lower body.

* * * * *

UNITED STATES PATENT AND TRADEMARK OFFICE

CERTIFICATE OF CORRECTION

PATENT NO. : 6,283,318 B1
DATED : September 4, 2001
INVENTOR(S) : Lee

It is certified that error appears in the above-identified patent and that said Letters Patent is hereby corrected as shown below:

Title page,
Item [56], References Cited, FOREIGN PATENT DOCUMENTS, "WO 84/0269" should read -- WO 84/02694 --.

Column 1,
Line 2, after the heading, insert the sub-heading -- RELATED APPLICATIONS --;
Lines 10, 11, 12, 13 and 14, "1998", each occurrence, should read -- 1996 --.

Column 31,
Lines 53, "all" should read -- an --.

Column 32,
Line 5, "mid" should read -- and --;
Line 64, after "claim 15," insert -- wherein --.

Column 33,
Line 23, "null-tab" should read -- pull-tab --;
Line 31, "hat" should read -- that --;
Line 62, "outsize" should read -- outside --.

Column 34,
Line 41, "lines-are" should read -- lines are --;
Line 43, "claim 21" should read -- claim 27 --.

Column 36,
Lne 4, cancel "106";
Line 38, "on-the" should read -- on the --.

Column 37,
Line 8, after "therebetween" insert a comma (,);
Line 21, "an" should read -- and --;
Line 44, after "least" cancel the colon (:).

Column 38,
Line 20, before "gap" cancel the comma (,).

Column 39,
Line 27, "though" should read -- through --.

UNITED STATES PATENT AND TRADEMARK OFFICE

CERTIFICATE OF CORRECTION

PATENT NO. : 6,283,318 B1
DATED : September 4, 2001
INVENTOR(S) : Lee

It is certified that error appears in the above-identified patent and that said Letters Patent is hereby corrected as shown below:

Column 40,
Line 39, cancel "106".

Column 41,
Line 5, "cutaway" should read -- cut-away --;
Line 18, cancel "is", second occurrence.

Column 42,
Line 13, after "wherein" cancel the comma (,).

Signed and Sealed this

Twenty-third Day of April, 2002

*Attest:*

*Attesting Officer*

JAMES E. ROGAN
*Director of the United States Patent and Trademark Office*